US012722052B2

(12) United States Patent
Nicolette et al.

(10) Patent No.: US 12,722,052 B2
(45) Date of Patent: Sep. 1, 2026

(54) GOLF CLUB HEADS AND METHODS TO MANUFACTURE GOLF CLUB HEADS

(71) Applicant: PARSONS XTREME GOLF, LLC, Scottsdale, AZ (US)

(72) Inventors: Michael R. Nicolette, Scottsdale, AZ (US); Bradley D. Schweigert, Cave Creek, AZ (US); Daniel C. Kirtley, Scottsdale, AZ (US)

(73) Assignee: PARSONS XTREME GOLF, LLC, Scottsdale, AZ (US)

( * ) Notice: Subject to any disclaimer, the term of this patent is extended or adjusted under 35 U.S.C. 154(b) by 0 days.

(21) Appl. No.: 19/564,410

(22) Filed: Mar. 12, 2026

(65) Prior Publication Data

US 2026/0241243 A1 Aug. 20, 2026

Related U.S. Application Data

(63) Continuation of application No. 19/415,218, filed on Dec. 10, 2025, now Pat. No. 12,599,821, which is a continuation-in-part of application No. 19/208,823, filed on May 15, 2025, which is a continuation of application No. 18/830,942, filed on Sep. 11, 2024, now Pat. No. 12,330,028, which is a continuation of application No. 18/613,386, filed on Mar. 22, 2024, now Pat. No. 12,109,464, which is a continuation-in-part of application No. 18/442,782, filed on Feb. 15, 2024, now Pat. No. 12,005,328, which is a continuation of application No.

(Continued)

(51) Int. Cl.
*A63B 60/54* (2015.01)
*A63B 53/04* (2015.01)

(52) U.S. Cl.
CPC .. *A63B 53/0475* (2013.01); *A63B 2053/0479* (2013.01); *A63B 60/54* (2015.10); *A63B 2209/00* (2013.01)

(58) Field of Classification Search
CPC ..... A63B 53/0475; A63B 2053/0479
See application file for complete search history.

(56) References Cited

U.S. PATENT DOCUMENTS 5,830,084 A * 11/1998 Kosmatka ..... A63B 60/00 473/324
5,877,970 A 3/1999 Nesbit et al.
(Continued)

*Primary Examiner* — Jason L Vaughan
*Assistant Examiner* — Amanda Kreiling

(57) ABSTRACT

Embodiments of golf club heads, golf clubs, and methods to manufacture golf club heads and golf clubs are generally described herein. In one example, a face portion of a golf club head includes a perimeter portion, a maximum face portion thickness, a minimum face portion thickness, a first quadrant in an upper toe-side portion comprising a first region including the maximum face portion thickness, a second quadrant in an upper heel-side portion comprising a second region, a third quadrant in a lower heel-side portion comprising a third region, and a fourth quadrant in a lower toe-side portion comprising a fourth region including the maximum face portion thickness. The perimeter portion thickness is greater than the minimum face portion thickness. The first region and the fourth region have different shapes. Other examples and embodiments may be described and claimed.

20 Claims, 18 Drawing Sheets

Related U.S. Application Data

18/526,106, filed on Dec. 1, 2023, now Pat. No. 11,938,385, which is a continuation-in-part of application No. 18/205,019, filed on Jun. 2, 2023, now Pat. No. 11,833,398, which is a continuation of application No. 18/115,222, filed on Feb. 28, 2023, now Pat. No. 11,707,655.

(60) Provisional application No. 63/770,531, filed on Mar. 12, 2025, provisional application No. 63/461,491, filed on Apr. 24, 2023, provisional application No. 63/443,494, filed on Feb. 6, 2023, provisional application No. 63/389,561, filed on Jul. 15, 2022.

(56) References Cited

U.S. PATENT DOCUMENTS

| | | | |
|---|---|---|---|
| 5,971,868 | A | 10/1999 | Kosmatka |
| 6,800,037 | B2 | 10/2004 | Kosmatka |
| 7,018,305 | B2 | 3/2006 | Sugimoto |
| 8,229,710 | B2 | 7/2012 | Matsunaga et al. |
| 9,220,959 | B2 | 12/2015 | Roach et al. |
| 9,452,323 | B2 | 9/2016 | Kronenberg et al. |
| 9,700,766 | B2 | 7/2017 | Sugimae et al. |
| 9,855,477 | B2 | 1/2018 | Franklin et al. |
| 10,434,379 | B2 | 10/2019 | Brunski et al. |
| 11,090,532 | B2 | 8/2021 | Wahl et al. |
| 11,406,883 | B2 | 8/2022 | Clarke et al. |
| 11,738,245 | B2 | 8/2023 | Lambeth et al. |
| 11,759,687 | B2 | 9/2023 | Lambeth et al. |
| 11,786,788 | B2 | 10/2023 | Slaughter et al. |
| 11,861,274 | B1 | 1/2024 | Seluga |
| 11,868,688 | B1 | 1/2024 | Seluga |
| 2007/0015601 | A1 | 1/2007 | Tsunoda et al. |

* cited by examiner

GOLF CLUB HEADS AND METHODS TO MANUFACTURE GOLF CLUB HEADS

CROSS REFERENCE

This application is a continuation of U.S. application Ser. No. 19/415,218, filed Dec. 10, 2025, which claims the benefit of U.S. Provisional Application No. 63/770,531, filed Mar. 12, 2025.

U.S. application Ser. No. 19/415,218, filed Dec. 10, 2025, is a continuation-in-part of U.S. application Ser. No. 19/208,823, filed May 15, 2025, which is a continuation of U.S. application Ser. No. 18/830,942, filed Sep. 11, 2024, now U.S. Pat. No. 12,330,028, which is a continuation of U.S. application Ser. No. 18/613,386, filed Mar. 22, 2024, now U.S. Pat. No. 12,109,464, which is a continuation-in-part of U.S. application Ser. No. 18/442,782, filed Feb. 15, 2024, now U.S. Pat. No. 12,005,328, which is a continuation of U.S. application Ser. No. 18/526,106, filed Dec. 1, 2023, now U.S. Pat. No. 11,938,385, which claims the benefit of U.S. Provisional Application No. 63/461,491, filed Apr. 24, 2023.

U.S. application Ser. No. 18/526,106, filed Dec. 1, 2023, is a continuation-in-part of U.S. application Ser. No. 18/205,019, filed Jun. 2, 2023, now U.S. Pat. No. 11,833,398, which is a continuation of U.S. application Ser. No. 18/115,222, filed Feb. 28, 2023, now U.S. Pat. No. 11,707,655, which claims the benefit of U.S. Provisional Application No. 63/389,561, filed Jul. 15, 2022, and claims the benefit of U.S. Provisional Application No. 63/443,494, filed Feb. 6, 2023.

The disclosures of the above-referenced applications are incorporated by reference herein in their entirety.

COPYRIGHT AUTHORIZATION

The present disclosure may be subject to copyright protection. The copyright owner has no objection to the facsimile reproduction by anyone of the present disclosure and its related documents, as they appear in the Patent and Trademark Office patent files or records, but otherwise reserves all applicable copyrights.

FIELD

The present disclosure generally relates to golf equipment, and more particularly, to golf club heads and methods to manufacture golf club heads.

BACKGROUND

Various materials (e.g., steel-based materials, titanium-based materials, tungsten-based materials, etc.) may be used to manufacture golf club heads. By using multiple materials to manufacture golf club heads, the position of the center of gravity (CG), the moment of inertia (MOI), and/or the configuration and properties of the face of the golf club heads may be optimized to produce certain trajectory and spin rate of a golf ball.

Figure 1:
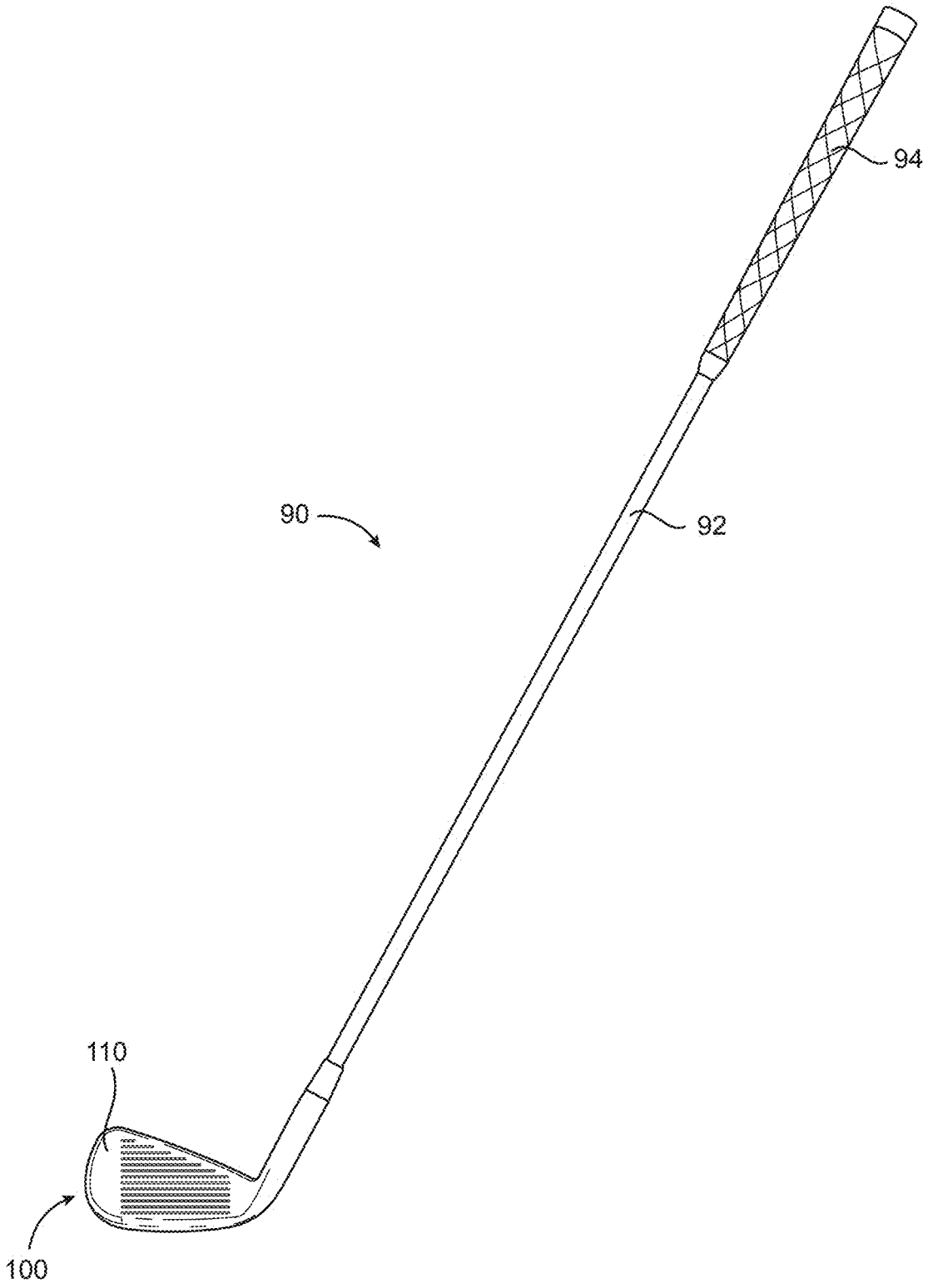
FIG. 1 depicts a golf club head having a golf club according to any embodiment of the apparatus, methods, and articles of manufacture described herein.

For simplicity and clarity of illustration, the drawing figures illustrate the general manner of construction, and descriptions and details of well-known features and techniques may be omitted to avoid unnecessarily obscuring the present disclosure. Additionally, elements in the drawing figures may not be depicted to scale. For example, the dimensions of some of the elements in the figures may be exaggerated relative to other elements to help improve understanding of embodiments of the present disclosure.

DESCRIPTION

The following U.S. Patents and Patent Applications, which are collectively referred to herein as "the incorporated by reference patent documents," are incorporated by reference herein in their entirety: U.S. Pat. Nos. 8,961,336, 9,199,143, 9,421,437, 9,427,634, 9,468,821, 9,533,201, 9,610,481, 9,649,542, 9,675,853, 9,814,952, 9,878,220, 10,029,158, 10,029,159, 10,159,876, 10,232,235, 10,265,590, 10,279,233, 10,286,267, 10,293,229, 10,449,428, 10,478,684, 10,512,829, 10,596,424, 10,596,425, 10,632,349, 10,716,978, 10,729,948, 10,729,949, 10,814,193, 10,821,339, 10,821,340, 10,828,538, 10,864,414, 10,874,919, 10,874,921, 10,905,920, 10,933,286, 10,940,375, 11,058,932, 11,097,168, 11,117,030, 11,141,633, 11,154,755, 11,167,187, 11,173,359, 11,192,003, 11,207,575, 11,235,211; and U.S. Patent Publication Nos. 20170282026, 20170282027, 20170368429, 20180050243, 20180050244, 20180133567, 20180140910, 20180169488, 20180221727, 20180236325, 20190232125, 20190232126, 20190247727, 20200171363, 20210023422, 20210069557, 20210086044, 20210162278, 20210197037, 20210205672, 20210308537, 20220032138, and 20220040541.

In the example of FIG. 1, a golf club 90 may include a golf club head 100, a shaft 92, and a grip 94. The golf club head 100 may be attached to one end of the shaft 92 and the grip 94 may be attached to the opposite end of the shaft 92. An individual can hold the grip 94 and swing the golf club head 100 with the shaft 92 to strike a golf ball (not illustrated).

In the example of FIGS. 2-24, a golf club head 100 may include a body portion 110 having a toe portion 140 with a toe portion edge 142, a heel portion 150 with a heel portion edge 152 that may include a hosel portion 155. A golf club shaft such as the shaft 92 that is illustrated for example in FIG. 1 may include one end coupled to the hosel portion 155 and an opposite end coupled to a golf club grip such as the grip 94 that is illustrated for example in FIG. 1 to form a golf club such as the golf club 90 that is illustrated for example in FIG. 1. The body portion 110 may further include a front portion 160, a back portion 170 with a back wall portion 172, a top portion 180 with a top portion edge 182, and a sole portion 190 with a sole portion edge 192. The toe portion 140, the heel portion 150, the front portion 160, the back portion 170, the top portion 180, and/or the sole portion 190 may partially overlap. The toe portion edge 142, the heel portion edge 152, the top portion edge 182, and the sole portion edge 192 may define a periphery or boundary of the body portion 110. The golf club head 100 may be any type of golf club head described herein, such as, for example, an iron-type golf club head or a wedge-type golf club head. The volume of the golf club head 100, the materials of construction of the golf club head 100, and/or any components thereof may be similar to any of the golf club heads described herein and/or described in any of the incorporated by reference patent documents. The apparatus, methods, and articles of manufacture described herein are not limited in this regard.

The golf club head 100 may include a face portion 162 (i.e., the strike face) that may be integrally formed with the body portion 110 (e.g., a single unitary piece). In one example, as illustrated in FIGS. 2-24, the face portion 162 may be a separate piece coupled (e.g., directly or indirectly, adhesively, mechanically, by welding, and/or by soldering) to the front portion 160 to close a front opening of the front portion 160. The face portion 162 may include a front surface 164 and a back surface 166. The front surface 164 may include front grooves 168 that may extend between the toe portion 140 and the heel portion 150. The front grooves 168 may be similar in many respects to the front grooves of any of the golf club heads described herein or described in any of the incorporated by reference patent documents. The back surface 166 of the face portion 162 may include one or more grooves, slots, channels, depressions, or recesses. In one example, the grooves on the back surface 166 may be similar in many respects to any of the back grooves 2800 and 2900 illustrated in FIGS. 28 and 29, respectively, and described herein. In another example, the grooves on the back surface 166 may be similar to any of the back grooves described in U.S. Pat. Nos. 11,400,352 and 10,449,428, which are incorporated by reference herein. In another example, the back surface 166 may not include any grooves, slots, channels, depressions, or recesses. The face portion 162 and the attachment thereof to the body portion 110 or manufacturing thereof with the body portion 110 may be similar in many respects to any of the face portions described herein or described in any of the incorporated by reference patent documents. The apparatus, methods, and articles of manufacture described herein are not limited in this regard.

Figure 28:
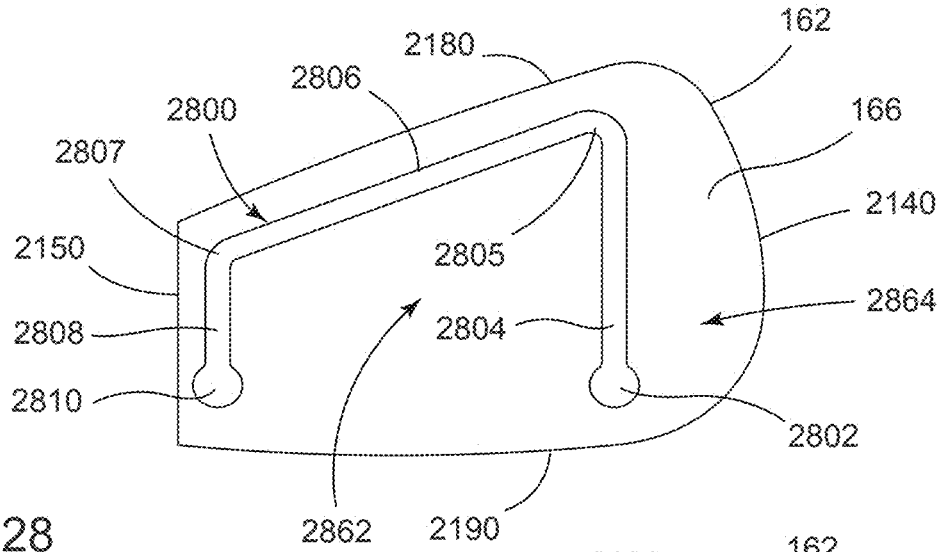

In the illustrated example of FIG. 28, the back surface 166 of the face portion 162 may include a back groove 2800 having a first end portion 2802, a first portion 2804, a first transition portion 2805, a second portion 2806, a second transition portion 2807, a third portion 2808, and a second end portion 2810. In one example, as illustrated in FIG. 28, the first end portion 2802 may be proximate to the face toe edge 2140 and proximate to the face sole edge 2190. The first end portion 2802 may be circular as illustrated in FIG. 28 to eliminate or reduce stress concentration regions on the face portion 162 at or proximate to the first end portion 2802. The first portion 2804 may extend from the first end portion 2802 toward the face top edge 2180. In the illustrated example of FIG. 28, the first portion 2804 may be linear and extend vertically from the first end portion 2802 toward the face top edge 2180. In another example, the first portion 2804 may extend from the first end portion 2802 toward the face top edge 2180 with a curvature that may be similar or substantially similar to the curvature or contour of the face toe edge 2140. In yet another example, the first portion 2804 may be inwardly curved. The first portion 2804 may then transition to the second portion 2806 via the first transition portion 2805 located proximate to the face toe edge 2140 and proximate to the face top edge 2180. The first transition portion 2805 may be curved to eliminate or reduce stress concentration regions on the face portion 162 at or proximate to the first transition portion 2805. The second portion 2806 may extend from the first transition portion 2805 toward the face heel edge 2150. The second portion 2806 may be linear and have the same orientation and contour as the face top edge 2180. The second portion 2806 may then transition to the third portion 2808 via the second transition portion 2807 located proximate to the face heel edge 2150 and proximate to the face top edge 2180. The second transition portion 2807 may be curved to prevent or reduce stress concentration regions on the face portion 162 at or proximate to the second transition portion 2807. The third portion 2808 may extend from the second transition portion 2807 toward the second end portion 2810 to the second end portion 2810. The second portion 2806 may be linear and have the same orientation and contour as the face heel edge 2150. The second end portion 2810 may be located proximate to the face heel edge 2150 and proximate to the face sole edge 2190. The second end portion 2810 may be circular as illustrated in FIG. 28 to eliminate or reduce stress concentration regions on the face portion 162 at or proximate to the second end portion 2810. In another example, the back groove 2800 may have the same as described herein but be in an inverted configuration (i.e., U-shaped or rotated 180 degrees relative to the back groove 2800 shown in FIG. 28). In another example, the back groove 2800 may have the shape as described herein but be rotated 90 degrees clockwise or counterclockwise relative to the back groove 2800 shown in FIG. 28 (i.e., C-shaped). In another example, the grooves on the back surface 166 may be similar to any of the back grooves described in U.S. Pat. Nos. 11,400,352 and 10,449,428, which are incorporated by reference herein. The apparatus, methods, and articles of manufacture described herein are not limited in this regard.

Figure 29:
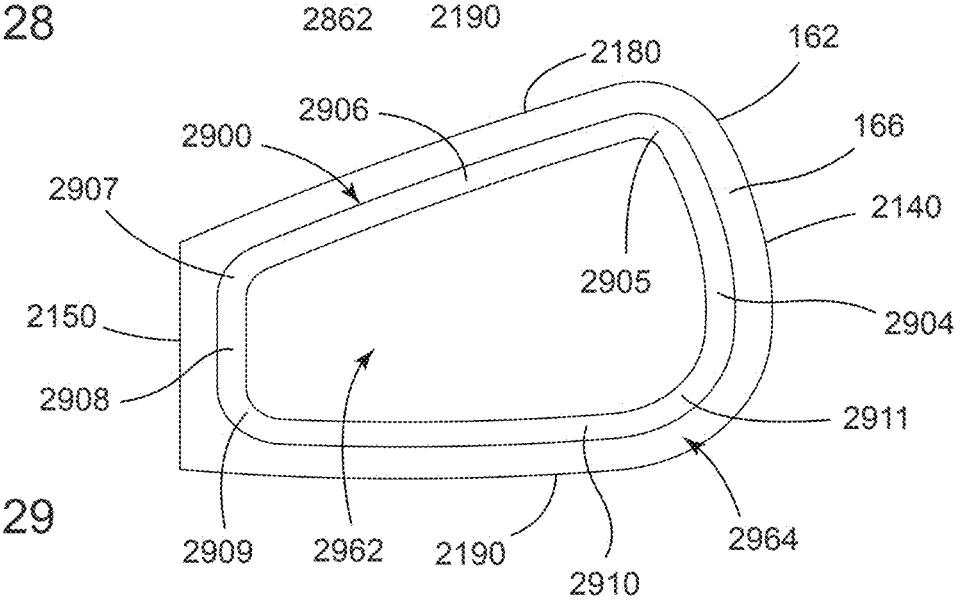

In another example, as illustrated in FIG. 29, the back surface 166 of the face portion 162 may include a back groove 2900, which may have similar back groove width, back groove depth, and/or cross-sectional shape as described and illustrated herein with respect to the back groove 2800. The back groove 2900 may include a first portion 2904, a first transition portion 2905, a second portion 2906, a second transition portion 2907, a third portion 2908, and a third transition portion 2909, a fourth portion 2910, and a fourth transition portion 2911, all of which may be continuous such that the back groove 2900 extends proximate to a perimeter of the back surface 166 of the face portion 162 and generally follows the contour of the perimeter of the face portion 162 without having any sharp corners to prevent stress concentration regions at or near any portion of the back groove 2900. The apparatus, methods, and articles of manufacture described herein are not limited in this regard.

As illustrated in FIGS. 28 and 29, the back grooves 2800 and 2900 may define inner areas 2862 and 2962 and outer areas 2864 and 2964, respectively, of the face portion 162. The inner areas may correspond to or include a portion of the face portion 162 that generally strikes a golf ball. Further, the back grooves may provide a relatively thinner part of the face portion 162 as compared to the remaining parts of the face portion 162. Accordingly, the back grooves may provide enhanced deflection of the inner areas relative to the outer areas as compared to face portion 162 without the back grooves. In other words, the back grooves may provide a trampoline effect for the inner areas of the face portion 162. The enhanced deflection of the inner areas may provide enhanced rebounding of the inner areas after the face portion 162 strikes a golf ball, which may increase ball speed and/or carry distance. The apparatus, methods, and articles of manufacture described herein are not limited in this regard.

In one example, the thickness of the face portion 162, which may be referred to herein as the face thickness, may be greater than or equal to 0.025 inch (0.635 mm) and less than or equal to 0.125 inch (3.175 mm). In another example, the face thickness may be greater than or equal to 0.047 inch (1.181 mm) and less than or equal to 0.078 inch (1.969 mm). In another example, the face thickness may be greater than or equal to 0.054 inch (1.378 mm) and less than or equal to 0.070 inch (1.772 mm). In yet another example, the face thickness may be greater than or equal to 0.060 inch (1.524 mm) and less than or equal to 0.065 inch (1.651 mm). The apparatus, methods, and articles of manufacture described herein are not limited in this regard.

Figure 2:
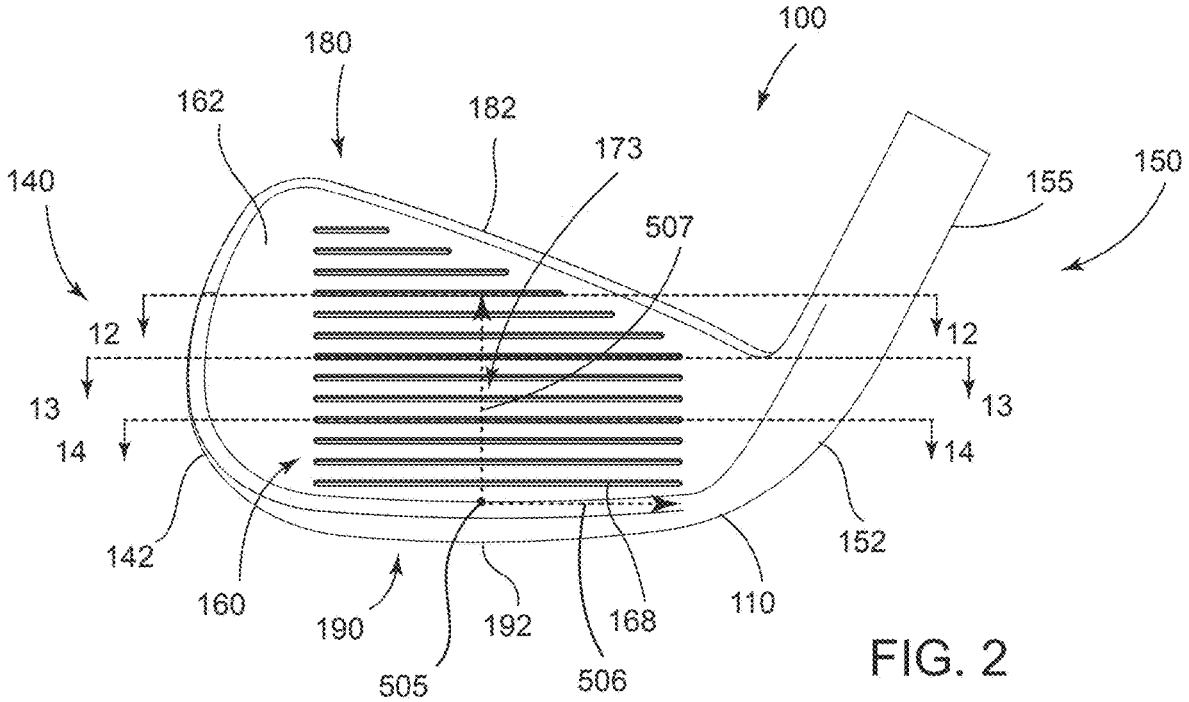
FIGS. 2, 3, 4, 5, 6, 7, 8, 9, 10, 11, 12, 13, 14, 15, 16, 17, 18, 19, 20, 21, 22, 23, 24, 25, and 26 illustrate a front view, a back view, a top view, a bottom view, a heel side view, a toe side view, a cross-sectional view taken at line 8-8 of FIG. 3, a cross-sectional view taken at line 9-9 of FIG. 3, a cross-sectional view taken at line 10-10 of FIG. 3, a cross-sectional view taken at line 11-11 of FIG. 3, a cross-sectional view taken at line 12-12 of FIG. 2, a cross-sectional view taken at line 13-13 of FIG. 2, a cross-sectional view taken at line 14-14 of FIG. 2, a cross-sectional view taken at line 16-16 of FIG. 3, another cross-sectional view taken at line 16-16 of FIG. 3, a back view of a port sleeve, a front view of a port sleeve, a front-side view of a mass portion, a side view of a mass portion, a back view, another back view, a front view without a face portion, a method of manufacturing, a cross-sectional view of another example taken at line 16-16 of FIG. 3, and a perspective view of a filler compression portion, respectively, of a golf club head according to embodiments of the apparatus, methods, and articles of manufacture described herein.
Figure 3:
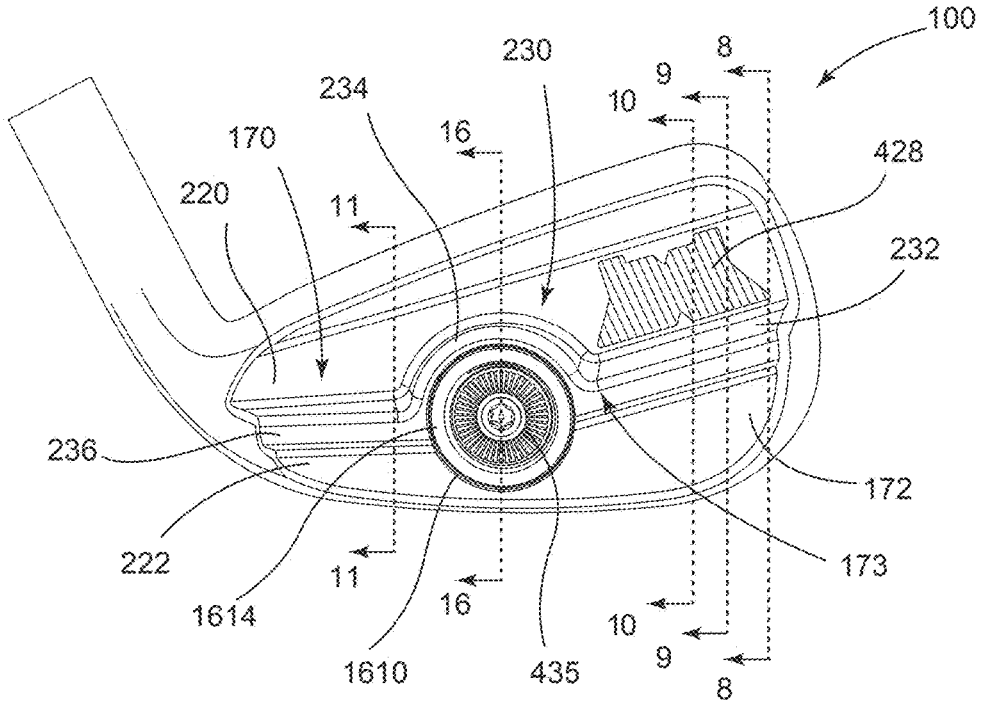
Figure 4:
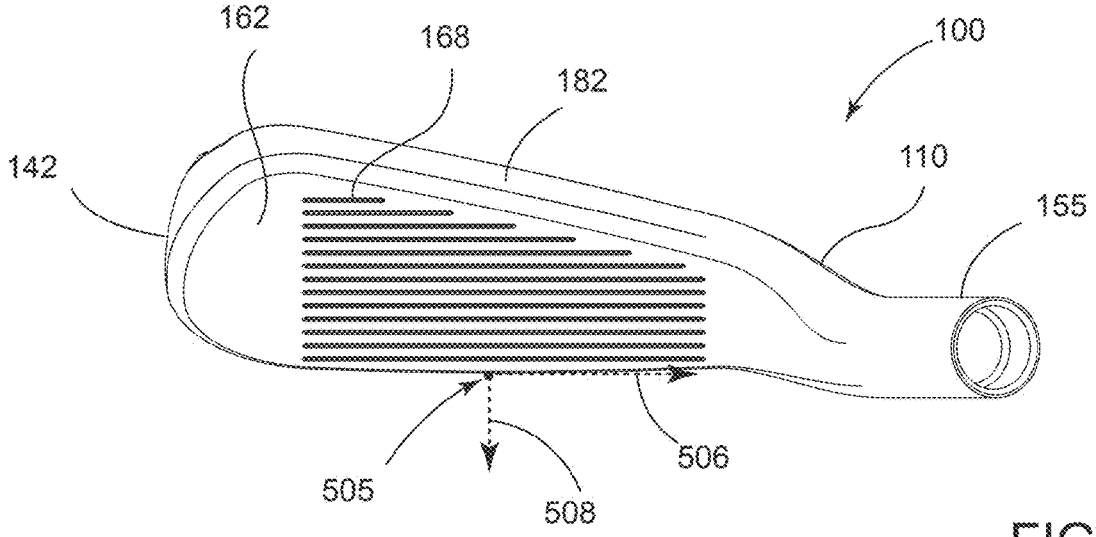
Figure 5:
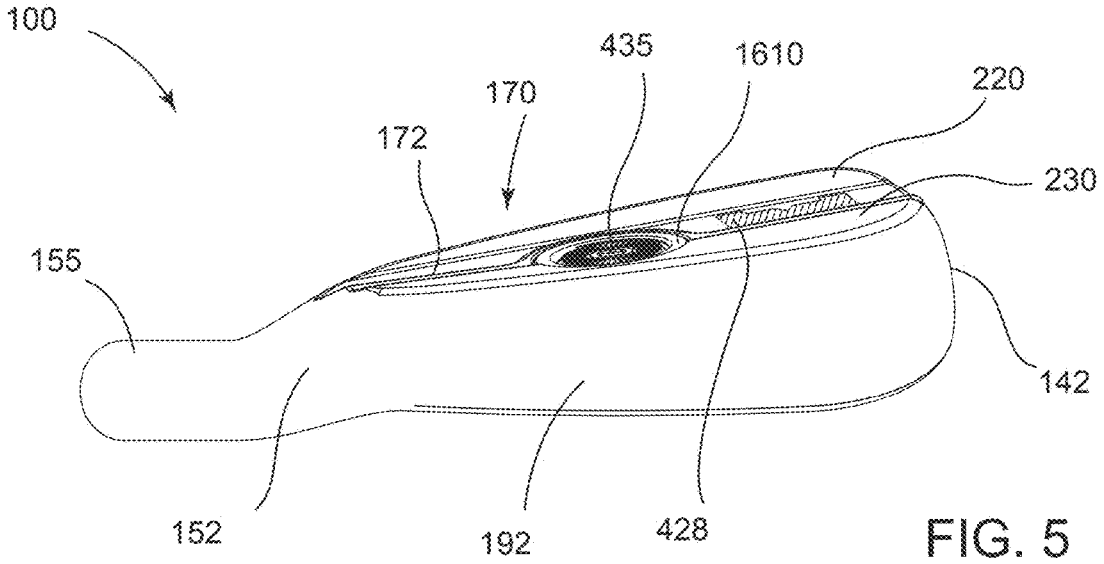
Figure 6:
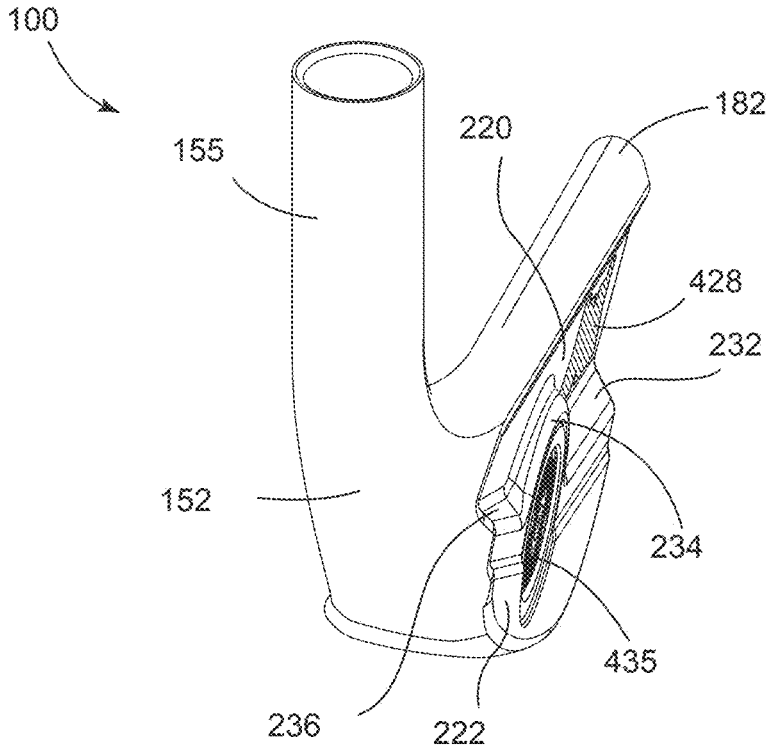
Figure 7:
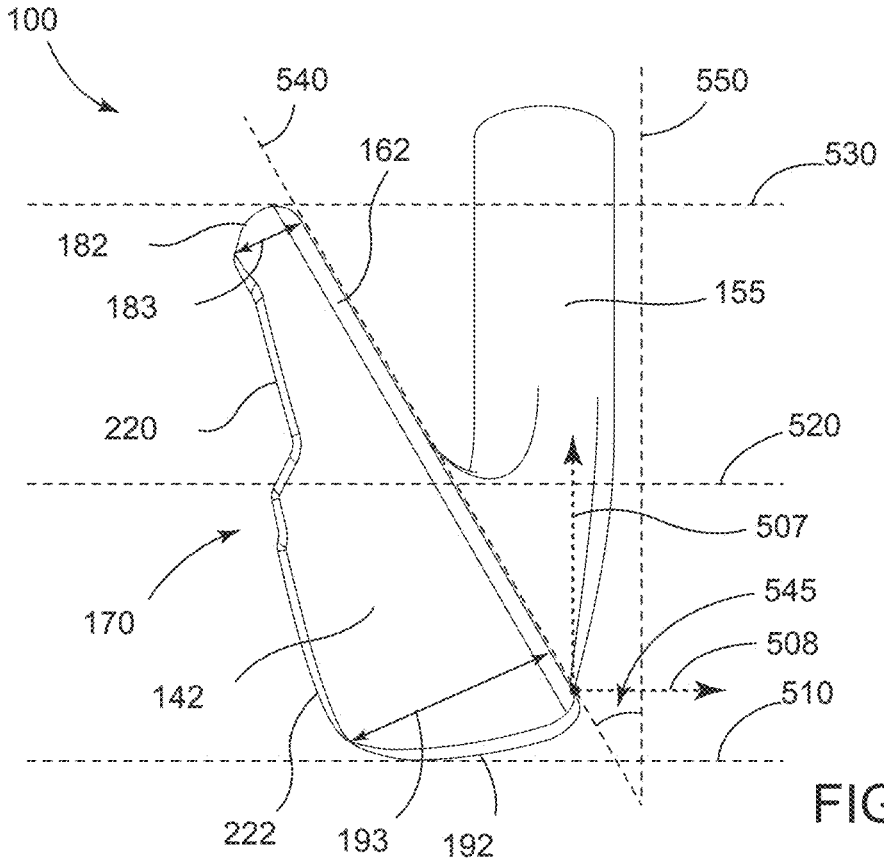
Figure 8:
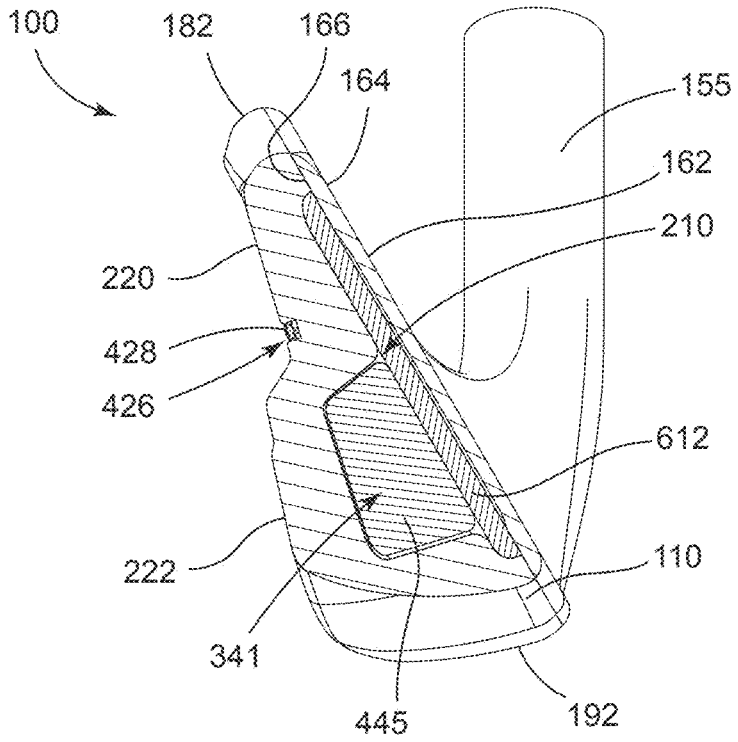
Figure 9:
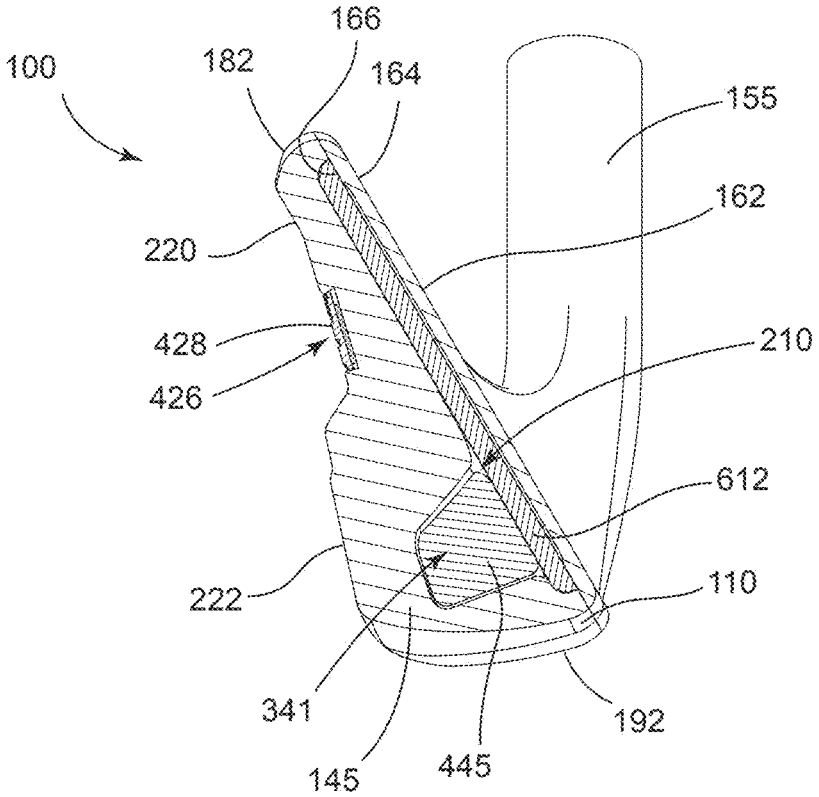
Figure 10:
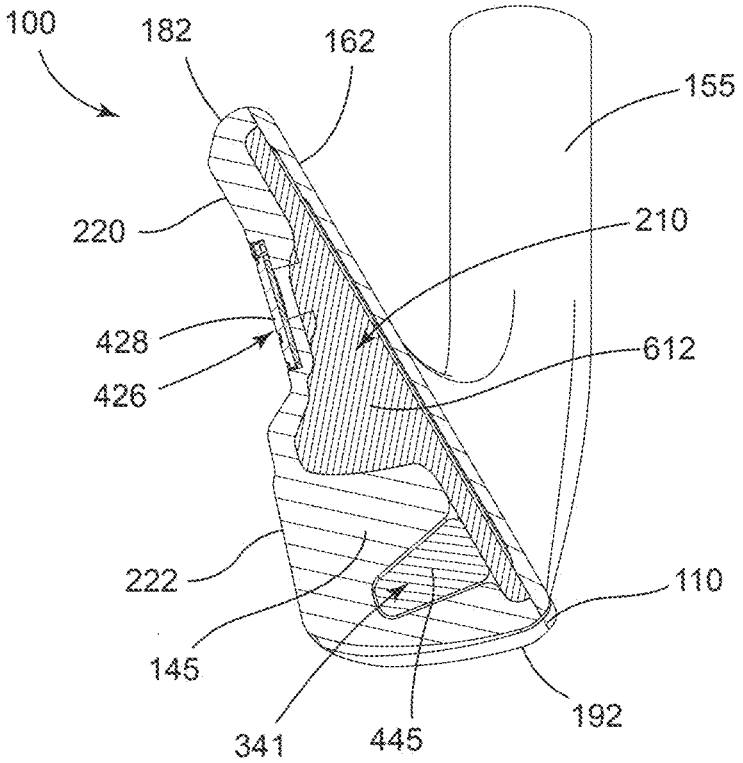
Figure 11:
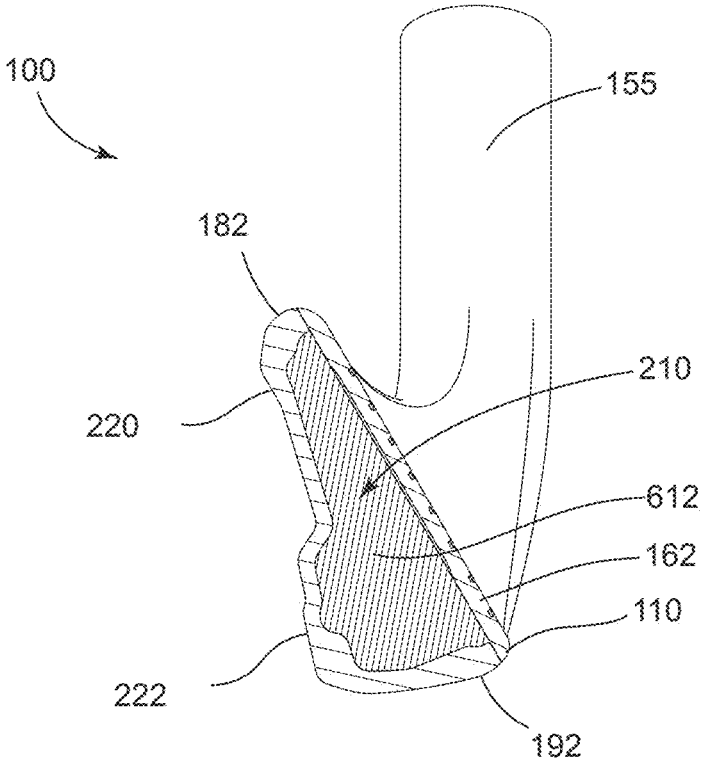
Figure 12:
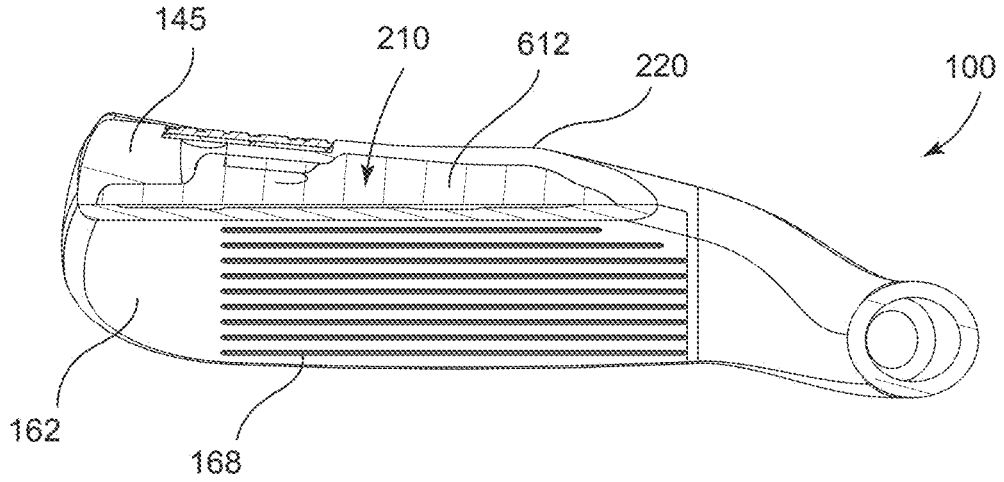
Figure 13:
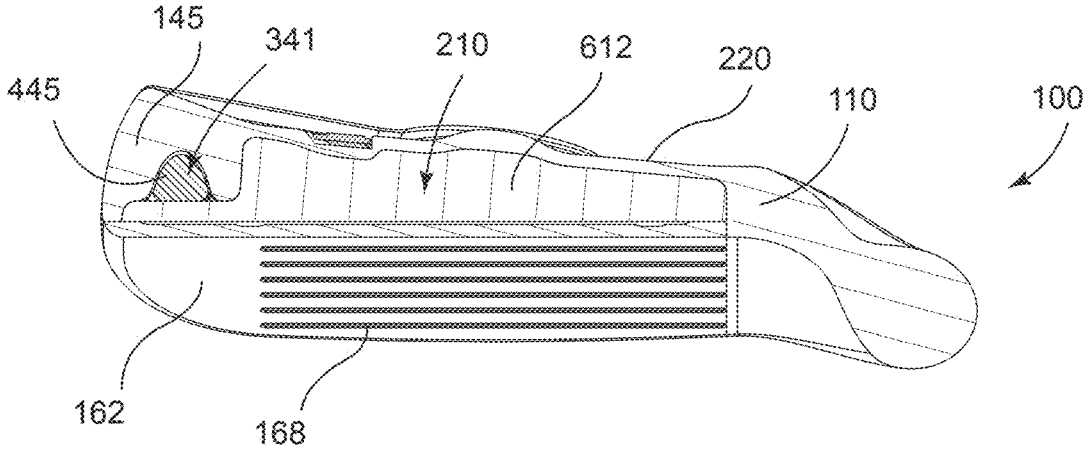

Any location on the golf club head 100 (or any of the golf club heads described herein) may be referenced by x, y, and z coordinates of a reference coordinate system. The coordinate system may have a horizontal x-axis, a vertical y-axis that is orthogonal to the x-axis, and a z-axis that is orthogonal to both the x-axis and the y-axis, all of which intersect at an origin of the coordinate system. In one example, as illustrated in FIGS. 2, 4 and 7, the origin 505 of the coordinate system or the location of coordinates x=0, y=0, and z=0 may be at the lowest point of the planar portion or flat portion of the face portion 162 or the lowest point on the face portion 162 prior to any curved transition portion between the face portion 162 and the sole portion edge 192. The x-axis (shown for example by reference number 506) of the coordinate system may extend in the horizontal and heel-to-toe direction with the positive x-axis extending from the origin 505 in a direction towards the heel portion edge 152. The y-axis (shown for example by reference number 507) of the coordinate system may extend in the vertical direction and be orthogonal to the x-axis with the positive y-axis extending vertically upward from the origin 505. The z-axis (shown for example by reference number 508) of the coordinate system may be orthogonal with both the x-axis and the y-axis with the negative z-axis extending from the origin in a direction towards the back portion 170 (positive z-axis direction is shown in FIGS. 4 and 7). In another example, the location of coordinates x=0, y=0, and z=0 may be at the lowest location of the toe portion edge 142. In another example, the location of coordinates x=0, y=0, and z=0 may be at the center of gravity of the golf club head 100. In yet another example, the location of coordinates x=0, y=0, and z=0 may be at a geometric center of the face portion 162. The location of coordinates x=0, y=0, and z=0 may be at any location on the golf club head 100 or outside the golf club head 100. Additionally, the coordinate system may have the x-axis, y-axis, and the z-axis at different directions (e.g., x direction being vertical and y direction being horizontal) than the coordinate systems described herein. Accordingly, any location on the golf club head 100 may be referenced with x, y, and z coordinates relative to x=0, y=0, and z=0 of a reference coordinate system. The apparatus, methods, and articles of manufacture described herein are not limited in this regard.

The golf club head 100 may be associated with a ground plane 510, a horizontal midplane 520, and a top plane 530. In particular, the ground plane 510 may be a plane that is parallel or substantially parallel to the ground and is tangent to the lowest portion of the sole portion edge 192 when the golf club head 100 is at an address position (e.g., the golf club head 100 aligned to strike a golf ball). A top plane 530 may be a plane that is tangent to the upper most portion of top portion edge 182 when the golf club head 100 is at the address position. The ground plane 510 and the top plane 530 may be parallel or substantially parallel. The horizontal midplane 520 may be vertically halfway between the ground plane 510 and the top plane 530, respectively, and be parallel or substantially parallel to the ground plane 510. Further, the golf club head 100 may be associated with a loft plane 540 defining a loft angle 545 ($\alpha$) of the golf club head 100. The loft plane 540 may be a plane that is tangent to or coplanar with the face portion 162. The loft angle 545 may be defined by an angle between the loft plane 540 and a vertical plane 550 that is normal to the ground plane 510. The apparatus, methods, and articles of manufacture described herein are not limited in this regard.

The back wall portion 172 may include an upper back wall portion 220, a lower back wall portion 222, and a ledge portion 230 between the upper back wall portion 220 and the lower back wall portion 222. The ledge portion 230 may extend outward (i.e., away from the face portion 162) from the upper back wall portion 220 to the lower back wall portion 222 (i.e., the ledge portion 230 may extend inward or toward the face portion 162 from the lower back wall portion 222 to the upper back wall portion 220). The ledge portion 230 may include a first ledge portion 232 that may extend from a location at or proximate to the toe portion edge 142 toward the heel portion 150, a second ledge portion 234 that may be located at or proximate to a center portion 173 of the back wall portion 172, and a third ledge portion 236 that may extend from a location at or proximate to the heel portion edge 152 toward the toe portion 140. The second ledge portion 234 may extend between the first ledge portion 232 and the third ledge portion 236. The first ledge portion 232 may also extend in a downwardly inclined direction from a location at or proximate to the toe portion edge 142 to the second ledge portion 234. The third ledge portion 236 may also extend in a downwardly inclined or horizontal direction from a location at or proximate to the heel portion edge 152 to the second ledge portion 234. Alternatively, the first ledge portion 232 and/or the third ledge portion 236 may be upwardly inclined or horizontally oriented. The ledge portion 230 including the first ledge portion 232, the second ledge portion 234, and the third ledge portion 236 may be similar in many respects (e.g., height, width, orientation, configurations of any sidewall portions, configurations of any ledge portion transition portions, etc.) to any of the ledge portions described herein or described in any of the incorporated by reference patent documents. The apparatus, methods, and articles of manufacture described herein are not limited in this regard.

In one example, as illustrated in FIG. 7, a top rail width 183, which may be defined as a distance between the back wall portion 172 and the face portion 162 at the top portion edge 182, may be greater than equal to 0.25 inch (6.35 mm) and less than or equal to 0.35 inch (8.89 mm), and a sole width 193, which may be defined as a distance between the back wall portion 172 and the face portion 162 at the sole portion edge 192, may be greater than equal to 0.75 inch (19.05 mm) and less than or equal to 1.05 inch (26.67 mm). In another example, the top rail width 183 may be greater than equal to 0.2 inch (5.08 mm) and less than or equal to 0.5 inch (12.7 mm), and the sole width 193 may be greater than equal to 0.5 inch (12.7 mm) and less than or equal to 1.75 inch (44.45 mm). In yet another example, a ratio of the sole width 193 to the top rail width 183 may be greater than or equal to 2.5 and less than or equal to 3.5. Accordingly, a greater portion of the mass portion of the body portion 110 may be located closer to the sole portion edge 192 than the top portion edge 182 to place the center of gravity of the golf club head 100 relatively low or as low as possible while complying with rules established by one or more golf governing bodies to provide optimum performance for the golf club head 100. The apparatus, methods, and articles of manufacture described herein are not limited in this regard.

The body portion 110 may include one or more ports, which may be exterior ports and/or interior ports (e.g., located inside the body portion 110). The one or more ports may be at any location on the body portion 110. The inner walls of the body portion 110 that define the interior cavity 210 may include one or more ports. In one example, as illustrated in FIGS. 2-24, the body portion 110 may include a first port 321 above the first ledge portion 232, a second port 331 located below the second ledge portion 234, and a third port 341 in the interior cavity 210. Accordingly, the first port 321 and the second port 331 may be external ports, i.e., having port openings on an external surface of the body portion 110, whereas the third port 341 may be an internal port having an opening on one or more internal walls of the body portion 110 that define the interior cavity 210. The body portion 110 may include ports that may be similar in many respects to any of the ports described in any of the incorporated by reference patent documents. The apparatus, methods, and articles of manufacture described herein are not limited in this regard.

In one example as illustrated in FIGS. 2-24, the first port 321 may be located above the first ledge portion 232 and proximate to the toe portion edge 142. In another example, the first port 321 may be on the toe portion edge 142. In yet another example, the first port 321 may be below the first ledge portion 232. The first port 321 may have a first port first opening 326 on the back wall portion 172 that may be raised, coplanar, or recessed relative to portions of the back wall portion 172 that surround the first port first opening 326. In one example, as illustrated in FIGS. 2-24, the first port first opening 326 may be inside a recessed portion 426 on the upper back wall portion 220. The first port 321 may be cylindrical and extend from the first port first opening 326 to the interior cavity at a first port second opening 327 to connect to the interior cavity 210. Accordingly, the first port first opening 326 may provide access to the interior cavity 210 from outside of the body portion 110 via the first port second opening 327. As illustrated in FIGS. 2-24, the first port 321 may have a circular cross section (i.e., cylindrical port). In another example, the first port 321 may be elliptical. In yet another example, the first port 321 may have any shape. In one example, as illustrated in FIGS. 2-24, the recessed portion 426 may be configured to receive a cover portion or a badge 428 to cover the first port first opening 326. In another example, the first port 321 may be closed with a mass portion that may be constructed from a material having a different density than a material of the body portion 110. In yet another example, the first port 321 may be closed with a mass portion that may be constructed from a material having the same density as a material of the body portion 110. The apparatus, methods, and articles of manufacture described herein are not limited in this regard.

In one example, the badge 428 may display one or more alphanumeric characters, symbols, shapes or other visual marks to signify a particular feature of or information about of the golf club head 100. Accordingly, the badge 428 may be configured to be inserted and secured in the recessed portion 426. In one example, the badge 428 may be secured in the recessed portion 426 with an adhesive or a bonding agent. In another example, depending on the material of construction of the badge 428, welding or soldering may be used to attach the badge 428 inside the recessed portion 426. In another example, the badge 428 may be press fit into the recessed portion 426. In yet another example, one or more fasteners may be used to attach the badge 428 inside recessed portion 426. As described herein, the badge 428 may cover and/or close the first port 321. In one example, the badge 428 may be plate shaped to fit in the recessed portion 426. In another example, the badge 428 may further have a projection that may be received in the first port 321 to close the first port 321. In another example, the badge 428 may be rectangular, circular, or have any shape. In another example, the badge 428 may be visible and distinguishable from the remaining parts of the body portion 110 by color, texture, materials of construction, and/or other visual features. In yet another example, the badge 428 may be attached to the body portion 110 such as to appear seamless or almost seamless with the body portion 110 and be an integral part of the body portion 110, i.e., indistinguishable or almost indistinguishable from the body portion 110. The apparatus, methods, and articles of manufacture described herein are not limited in this regard.

In one example, as illustrated in FIGS. 2-24, the second port 331 may be larger in diameter than the first port 321. The distance between a center of the second port 331 and the sole portion edge 192 may be less than the distance between the center of the second port 331 and the top portion edge 182. Accordingly, the second port 331 may be closer to the sole portion edge 192 than to the top portion edge 182. The second port 331 may be located at or proximate to the center portion 173 of the back wall portion 172 and may have a diameter that is sized such that portions of the second port 331 may be located at or proximate to the sole portion edge 192. The second port 331 may be located between the sole portion edge 192 and the second ledge portion 234. The second port 331 may have a second port first opening 333 on the back wall portion 172 and port walls 335 that extend from the second port first opening 333 to a second port second opening 337 that may be connected to the interior cavity 210. Accordingly, the interior cavity 210 may be accessed from outside of the body portion 110 through the second port first opening 333 and the second port second opening 337. In one example, an inner diameter of the second port 331 may be greater than or equal to 0.2 inch (5.08 mm) and less than or equal to 1.0 inch (25.4 mm). In another example, the inner diameter of the second port 331 may be greater than or equal to 0.3 inch (7.62 mm) and less than 1.5 inch (38.1 mm). In another example, the inner diameter of the second port 331 may be greater than or equal to 0.4 inch (10.16 mm) and less than or equal to 0.8 inch (20.32 mm). In yet another example, the inner diameter of the second port 331 may be greater than or equal to 0.5 inch (12.7 mm) and less than or equal to 0.7 inch (17.78 mm). The apparatus, methods, and articles of manufacture described herein are not limited in this regard.

As illustrated in FIGS. 2-24, the second ledge portion 234 may partially surround the second port 331. Accordingly, in one example, as illustrated in FIGS. 2-24, the second ledge portion 234 may have a curved or semi-circular shape that may surround the upper portion of the second port 331. Alternatively, the second ledge portion 234 may be similar to any of the second ledge portions described herein or described in any of the incorporated by reference patent documents. The apparatus, methods, and articles of manufacture described herein are not limited in this regard.

The body portion 110 may include any number of ports above and/or below the first ledge portion 232, the second ledge portion 234, and/or the third ledge portion 236. The body portion 110 may include any number of ports above and/or below the horizontal midplane 520. The body portion 110 may include any number of ports on the toe portion edge 142, the heel portion edge 152, the top portion edge 182, and/or the sole portion edge 192. Any port may be connected to the interior cavity 210. The number of ports on the body portion 110, the arrangement and/or the configuration of the ports on the body portion 110 may be similar in many respects to any of the golf club heads described herein or in any of the incorporated by reference patent documents. The apparatus, methods, and articles of manufacture described herein are not limited in this regard.

In one example, as illustrated in FIGS. 2-24, the golf club head may include a port sleeve 1610 that may be sized to be inserted into the second port 331. The port sleeve 1610 may be constructed from any material such as metals, polymers, and/or composite materials. The port sleeve 1610 may be constructed from a material having a lower density than the material of the body portion 110. The lower mass of the port sleeve 1610 relative to a port sleeve 1610 constructed from a material having the same or higher density than the material of the body portion 110, or a golf club head 100 without a port sleeve 1610 (i.e., the space filled by the port sleeve 1610 is filled with a material having the same or higher density than the material of the body portion 110), allows more mass to be shifted to the toe region of the body portion 110 to increase the moment of inertia of the golf club head or optimize the location of the center of gravity of the golf club head 100 without changing or greatly changing the total mass of the golf club head 100. In other words, the port sleeve 1610 allows mass to be shifted from the center portion of the golf club head 100 to other parts of the golf club head 100 to optimize the performance of the golf club head 100. In one example, the port sleeve 1610 may provide a weight savings of greater than or equal to 0.5 gram and less than or equal to 10 grams at the center portion of the golf club head 100 to be shifted to other locations on the golf club head 100 as described herein. In another example, the port sleeve 1610 may provide a weight savings of greater than or equal to 2 gram and less than or equal to 7 grams at the center portion of the golf club head 100 to be shifted to other locations on the golf club head 100 as described herein. In yet another example, the port sleeve 1610 may provide a weight savings of greater than or equal to 1 gram and less than or equal to 5 grams at the center portion of the golf club head 100 to be shifted to other locations on the golf club head 100 as described herein. The apparatus, methods, and articles of manufacture described herein are not limited in this regard.

In one example, as illustrated in FIGS. 2-24, the port sleeve 1610 may be constructed from titanium or any titanium-based materials, whereas all or portions of the body portion 110 may be constructed from steel or steel-based materials. In another example, the port sleeve 1610 may be constructed from a polymer material. In yet another example, the port sleeve 1610 may be constructed from a composite material. For certain applications or configurations of the golf club head 100, the port sleeve 1610 may be constructed from a material having a greater density than the density of the material of the body portion 110 to place more mass at or proximate to the center portion of the golf club head 100. The port sleeve 1610 may be constructed from a material having the same density or a different density as the density of the material of the body portion 110. The apparatus, methods, and articles of manufacture described herein are not limited in this regard.

In one example, as illustrated in FIGS. 2-24, the port sleeve 1610 may include a sleeve body 1612 and a sleeve bezel 1614. The sleeve body 1612 may have an outer diameter that is sized to be movably received in the second port 331 while coupling to or engaging the inner walls of the second port 331 as described herein. In one example, the sleeve body 1612 may be externally threaded and compatible with threaded port walls 335 of the second port 331. Accordingly, the port sleeve 1610 may be inserted into and engage the threaded inner walls of the second port 331 by being screwed into the second port 331. The port sleeve 1610 may include a sleeve bottom 1616 having one or more structures, such as projections, recesses, and/or apertures for engaging a tool to turn the port sleeve 1610 inside the second port 331 and/or to provide access to the interior cavity 210. In one example, as illustrated in FIGS. 2-24, the sleeve bottom 1616 may include a bottom opening 1617 to provide access to the interior cavity 210 from the second port 331 when the port sleeve 1610 is inside the second port 331, and the sleeve bottom 1616 may include recesses 1618 that may be rectangular and configured in a four quadrant arrangement to provide engagement with a correspondingly shaped tool (not shown) to turn the port sleeve 1610 and secure the port sleeve 1610 in the second port 331. A tool that engages the recesses 1618 may also include a cylindrical projection that may be inserted into the bottom opening 1617 to engage the sleeve bottom 1616 and/or function to center the tool on the sleeve bottom 1616 for engagement with the recesses 1618. The sleeve bottom 1616 may have any structure and/or openings for engaging a corresponding tool for turning the port sleeve 1610 inside the second port 331. The apparatus, methods, and articles of manufacture described herein are not limited in this regard.

The sleeve bezel 1614 may have a greater diameter than the sleeve body 1612 and a greater diameter than the internal diameter of the second port 331. Accordingly, the sleeve bezel 1614 may engage the back wall portion 172 surrounding the second port 331 to prevent further insertion of the sleeve body 1612 into the second port 331. In one example, as illustrated in FIGS. 2-24, a portion of the back wall portion 172 surrounding the second port 331 may include a recessed ledge portion 177 that may be sized and shaped to receive the sleeve bezel 1614 therein and prevent further insertion of the sleeve body 1612 into the second port 331. Accordingly, in one example, the sleeve bezel 1614 may sit flush with the back wall portion 172 when the port sleeve 1610 is fully inserted into the second port 331 and the sleeve bezel 1614 is engaged with the recessed ledge portion 177. Alternatively, the sleeve bezel 1614 may not be flush with the back wall portion 172 such that the sleeve bezel 1614 may be partially or fully raised or partially or fully recessed relative to the back wall portion 172. In one example, the sleeve bezel 1614 may also include one or more structures for engaging a correspondingly shaped tool to secure the port sleeve 1610 in the second port 331. The apparatus, methods, and articles of manufacture described herein are not limited in this regard.

In one example, as illustrated in FIGS. 2-24, the length of the port sleeve 1610 may be greater than the length of the second port 331. Accordingly, a sleeve front portion 1620 of the port sleeve 1610 may extend past the second port 331 and into the interior cavity 210. As the port sleeve 1610 is screwed into the second port 331 as described herein, the sleeve front portion 1620 may extend through the second port 331 and enter or penetrate the interior cavity 210. As the port sleeve 1610 is further screwed into the second port 331, the sleeve front portion 1620 may advance farther into the interior cavity 210 until the engagement of the sleeve bezel 1614 with the recessed ledge portion 177 prevents further insertion of the port sleeve 1610 into the second port 331. Accordingly, interior cavity penetration depth of the sleeve front portion 1620 may be adjusted by the port sleeve 1610 being screwed into and out of the second port 331 with the maximum interior cavity penetration depth being defined by engagement of the sleeve bezel 1614 with the recessed ledge portion 177. The apparatus, methods, and articles of manufacture described herein are not limited in this regard.

The body portion 110 may include one or more mass portions (e.g., weight portion(s)) at any location on the body portion 110. The one or more mass portions may be integral mass portion(s) or separate mass portion(s) that may be coupled to the body portion 110 at any exterior or interior location on the body portion 110. In the illustrated example of FIGS. 2-24, the body portion 110 may include an external mass portion 435, which may be also referred to herein as the first mass portion, and an internal mass portion 445, which may be also referred to herein as the second mass portion. In one example, the external mass portion 435 may be disc shaped as illustrated in FIGS. 2-26 and further illustrated in detail in FIG. 27 and referred to as mass portion 2700. Referring to FIG. 27, the mass portion 2700 may be cylindrical or cylindrical shaped with a head portion 2702, a shaft portion 2706 and a top portion 2710 including a tool engagement portion 2712. The diameter 2704 of the mass portion 2700 may be greater than the length 2708 of the mass portion 2700. Accordingly, the mass portion 2700 may be disc shaped as illustrated in FIG. 27. In another example, the external mass portion 435 may be similar to any of the mass portions described. In another example, the external mass portion 435 may be similar to any of the mass portions or the disc-shaped mass portion described in U.S. Pat. Nos. 11,369,847, 11,400,352, and 11,707,655, which are incorporated by reference herein. The apparatus, methods, and articles of manufacture described herein are not limited in this regard.

The diameter of the external mass portion 435 may be determined based on one or more properties (e.g., material density) of the materials of construction of the external mass portion 435. The port sleeve 1610 may be configured to receive the external mass portion 435, which may be inserted and secured into the port sleeve 1610 by any of the methods described herein with respect to any of the golf club heads described herein such as being screwed in, press fitted, secured with an adhesive, or welded. In other words, the port sleeve 1610 may function as a sleeve for receiving the external mass portion 435. In one example, as illustrated in FIGS. 2-24, the inner walls of the port sleeve 1610 may be threaded to engage corresponding threads on the external mass portion 435. Accordingly, the inner diameter of the port sleeve 1610 may correspond to the outer diameter of the external mass portion 435. The external mass portion 435 may be fully inserted into the port sleeve 1610 and engage the sleeve bottom 1616. Accordingly, the outer surface of the external mass portion 435 may define a portion of the back wall portion 172 and be flush with the sleeve bezel 1614. Alternatively, the external mass portion 435 may be recessed relative to the sleeve bezel 1614 or protrude outward relative to the sleeve bezel 1614. The external mass portion 435 may be visible to an individual viewing the golf club head 100. In another example, the external mass portion 435 may be configured (e.g., size of diameter, length, etc.) to be directly inserted (e.g., screwed into) and fastened in the second port 331 as described in U.S. Pat. Nos. 11,369,847, 11,400,352, and 11,707,655, which are incorporated by reference herein. In other words, the golf club head 100 may not include the port sleeve 1610, or optionally the port sleeve 1610 may not be used. The apparatus, methods, and articles of manufacture described herein are not limited in this regard.

A center region or a geometric center of the second port 331 may be located at or proximate to the CG of the golf club head 100. Accordingly, a center of gravity of the external mass portion 435 may also be located at or proximate to the CG of the golf club head 100 when the external mass portion 435 is secured in the second port 331 as described herein. The x, y, and z coordinates of the center of gravity of the golf club head 100 may be denoted herein by $CG_X$, $CG_Y$, and $CG_Z$, respectively, and the x, y, and z coordinates of the center of gravity of the external mass portion 435 may be denoted herein by $CG_{M1X}$, $CG_{M1Y}$, and $CG_{M1Z}$, respectively. In one example, a distance on the x-axis between $CG_{M1X}$ and $CG_X$ may be less than or equal to 0.02 inch (0.51 mm), a distance on the y-axis between $CG_{M1Y}$ and $CG_Y$ may be less than or equal to 0.3 inch (7.62 mm), and/or a distance on the z-axis between $CG_{M1Z}$ and $CG_Z$ may be less than or equal to 0.2 inch (5.08 mm). In another example, a distance on the x-axis between $CG_{M1X}$ and $CG_X$ may be less than or equal to 0.1 inch (2.54 mm), a distance on the y-axis between $CG_{M1Y}$ and $CG_Y$ may be less than or equal to 0.6 inch (15.24 mm), and/or a distance on the z-axis between $CG_{M1Z}$ and $CG_Z$ may be less than or equal to 0.4 inch (10.16 mm). In another example, a distance on the x-axis between $CG_{M1X}$ and $CG_X$ may be less than or equal to 0.01 inch (0.25 mm), a distance on the y-axis between $CG_{M1Y}$ and $CG_Y$ may be less than or equal to 0.15 inch (3.81 mm), and/or a distance on the z-axis between $CG_{M1Z}$ and $CG_Z$ may be less than or equal to 0.1 inch (2.54 mm). In yet another example, a distance on the x-axis between $CG_{M1X}$ and $CG_X$ may be less than or equal to 0.25 inch (6.35 mm), a distance on the y-axis between $CG_{M1Y}$ and $CG_Y$ may be less than or equal to 0.25 inch (6.35 mm), and/or a distance on the z-axis between $CG_{M1Z}$ and $CG_Z$ may be less than or equal to 0.25 inch (6.35 mm). As a result, the external mass portion 435 may be interchangeable with another mass portion having a lower mass or a mass portion having a higher mass without causing a relatively large or a significant shift in the CG of the golf club head 100. In one example, for each gram of mass increase of the external mass portion 435, the CG location of the golf club head may shift by less than 0.5% of the $CG_X$ location (x-axis coordinate of the CG), less than 0.5% of the $CG_Y$ location (y-axis coordinate of the CG), and/or less than 0.2% of the $CG_Z$ location (z-axis coordinate of the CG). In another example, for each gram of mass increase of the external mass portion 435, the CG location of the golf club head may shift by less than 0.35% of the $CG_X$ location, less than 0.35% of the $CG_Y$ location, and/or less than 0.15% of the $CG_Z$ location. In yet another example, for each gram of mass increase of the external mass portion 435, the CG location of the golf club head may shift by less than 0.25% of the $CG_X$ location, less than 0.25% of the $CG_Y$ location, and/or less than 0.10% of the $CG_Z$ location. Thus, the external mass portion 435 may be interchangeable with another mass portion having a lower or a greater mass to provide certain performance characteristics for an individual (i.e., customize the performance of the golf club head 100 for a certain individual) without substantially shifting the CG of the golf club head 100 and/or altering the overall or general performance characteristics of the golf club head 100. In one example, as illustrated in FIGS. 2-24, the entire external mass portion 435 may be below the horizontal midplane 520. In another example, a substantial portion of the external mass portion 435 may be below the horizontal midplane520. The apparatus, methods, and articles of manufacture described herein are not limited in this regard.

Figure 14:
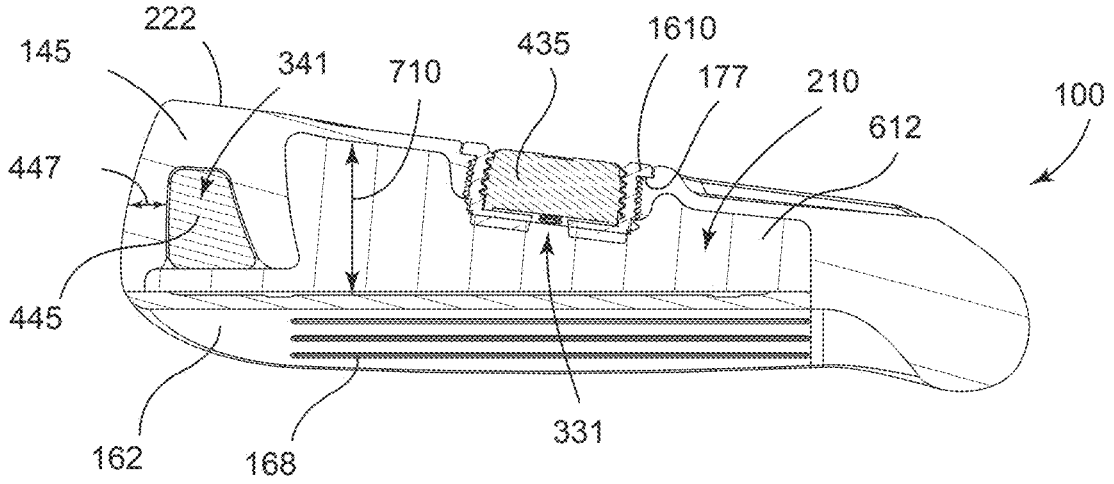
Figure 15:
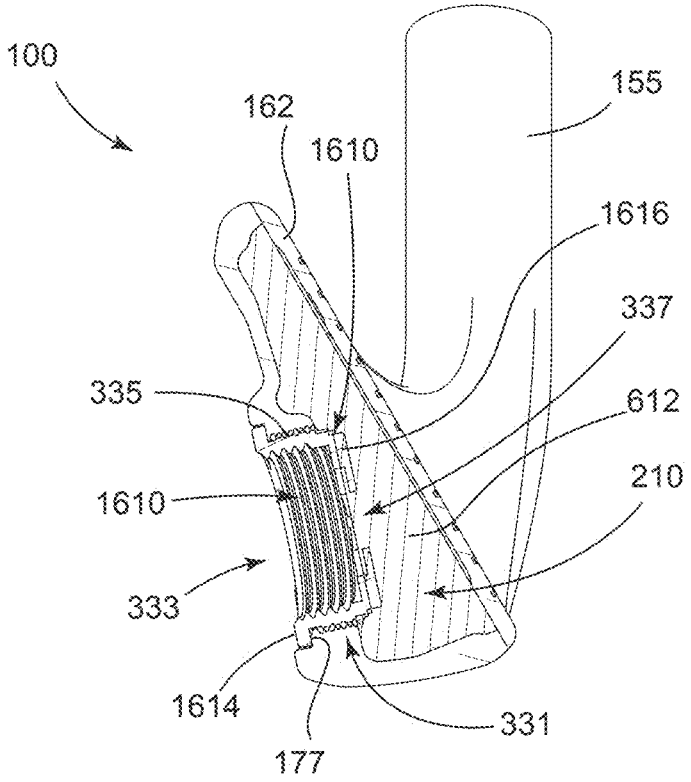
Figure 16:
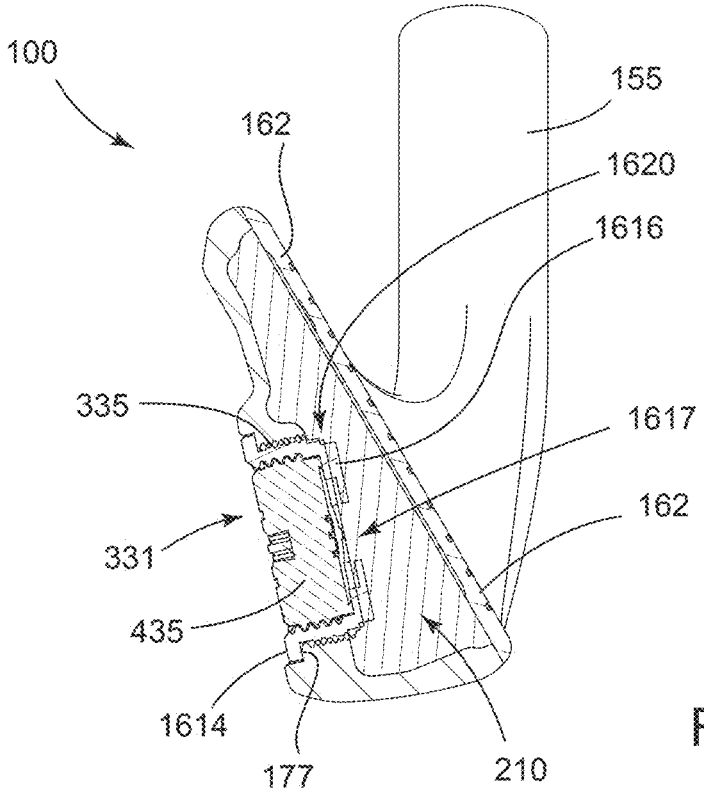
Figure 17:
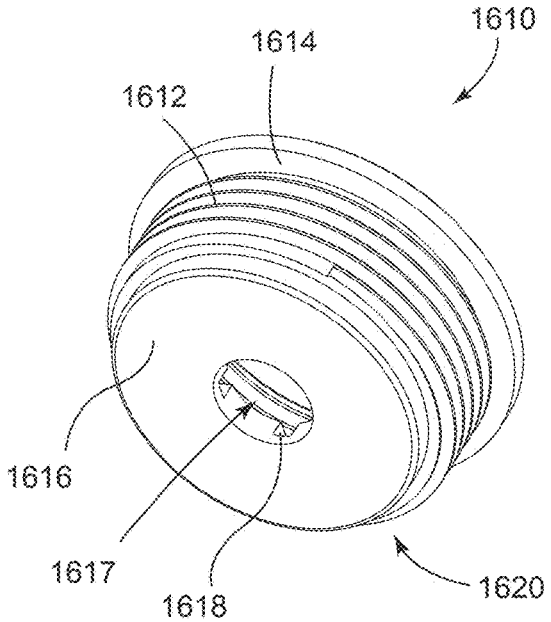
Figure 18:
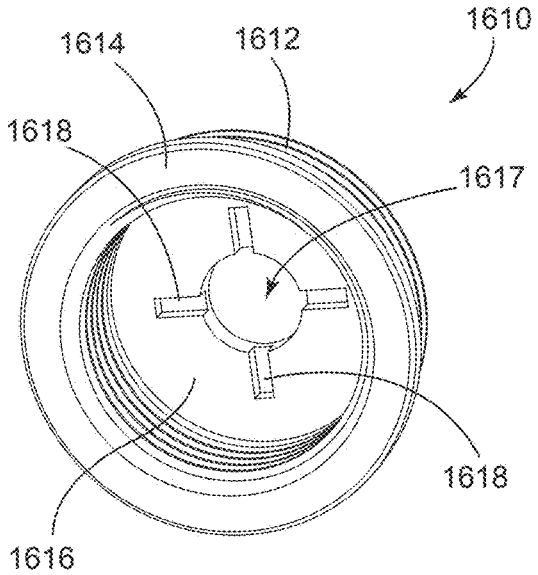
Figure 19:
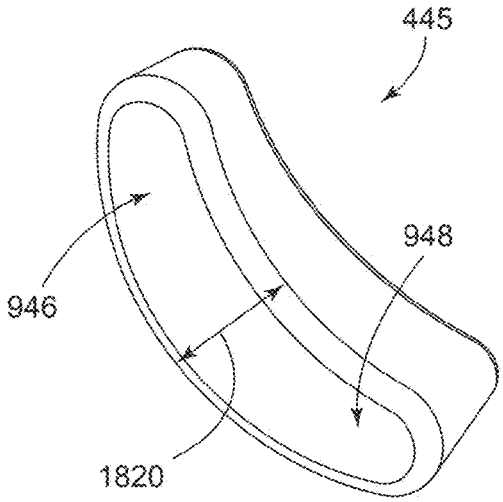
Figure 20:
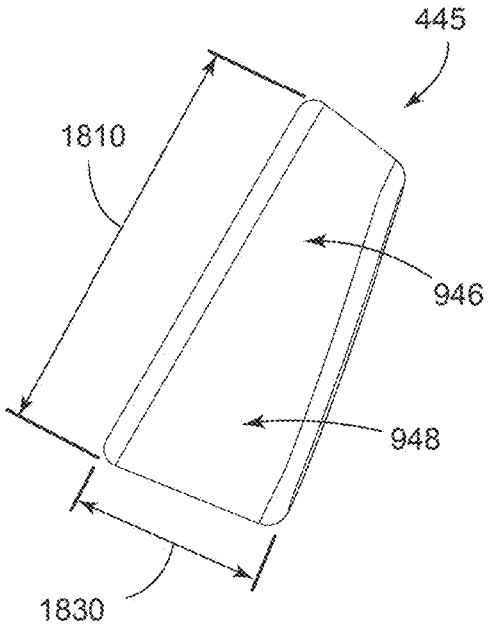
Figure 21:
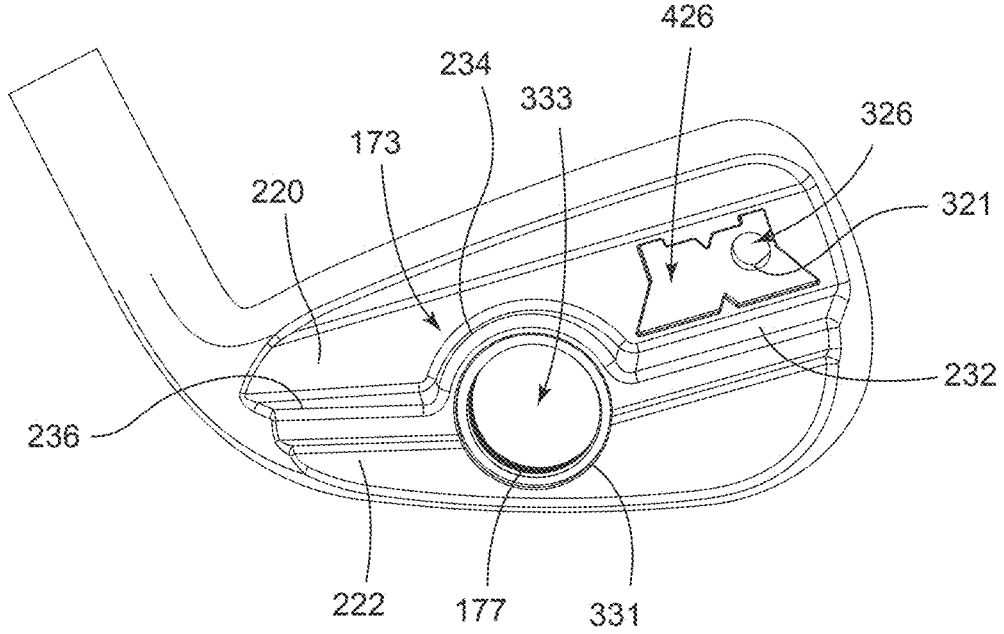
Figure 22:
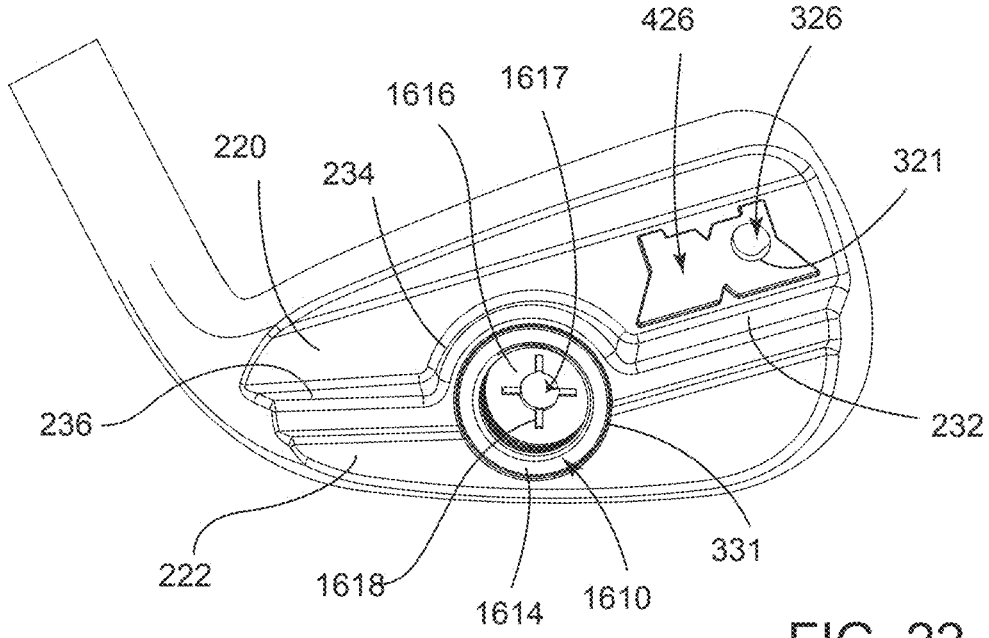
Figure 23:
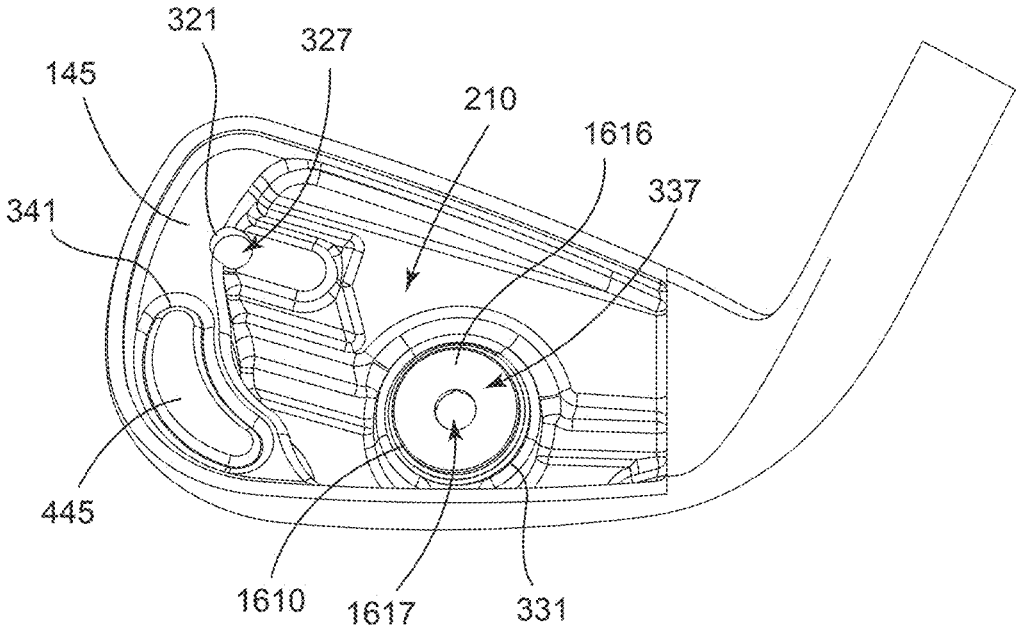

The internal mass portion 445 may be at any location on the body portion 110. In one example, as illustrated in FIGS. 2-24, the internal mass portion 445 may be located proximate to the toe portion edge 142. In another example, the internal mass portion 445 may be located between the external mass portion 435 and the toe portion edge 142. The location of the internal mass portion 445 being proximate to the toe portion edge 142 may increase the moment of inertia of the golf club head 100 to improve performance. All or portions of the internal mass portion 445 may be placed close to the toe portion edge 142 to increase the moment of inertia of the golf club head. Referring to FIGS. 14, in one example, the shortest distance 447 between the internal mass portion 445 and the toe portion edge 142 may be less than or equal to 0.1 inch (2.54 mm). In another example, the shortest distance 447 between the internal mass portion 445 and the toe portion edge 142 may be less than or equal to 0.2 inch (5.08 mm). In another example, the shortest distance 447 between the internal mass portion 445 and the toe portion edge 142 may be less than or equal to 0.3 inch (7.62 mm). In another example, the shortest distance 447 between the internal mass portion 445 and the toe portion edge 142 may be less than or equal to 0.4 inch (10.16 mm). In another example, the shortest distance 447 between the internal mass portion 445 and the toe portion edge 142 may be less than or equal to 0.5 inch (12.70 mm). In another example, the shortest distance 447 between the internal mass portion 445 and the toe portion edge 142 may be less than or equal to half the distance between the external mass portion 435 and the toe portion edge 142. In yet another example, the shortest distance 447 between the internal mass portion 445 and the toe portion edge 142 may be less than or equal to ¼ the distance between the external mass portion 435 and the toe portion edge 142. The apparatus, methods, and articles of manufacture described herein are not limited in this regard.

In one example, as illustrated in FIGS. 2-24, the internal mass portion 445 may have a curved shape that may correspond or approximately correspond to the shape of portions of the toe portion edge 142 that are proximate to the internal mass portion 445. Accordingly, the internal mass portion 445 may be located close to the toe portion edge 142 and have curvature that is the same or substantially the same as the curved shape of the toe portion edge 142. The shape and location of the internal mass portion 445 allows the internal mass portion to be placed close to the toe portion edge and have a mass distribution that closely resembles or resembles the curvature of the portions of the of the toe portion edge that are proximate to the internal mass portion 445. Accordingly, the internal mass portion 445 may increase the moment of inertia (MOI) of the golf club head 100. The location of the internal mass portion 445 along the y-axis and the z-axis may be determined so that the internal mass portion 445 may not greatly affect or shift the location of the CG of the golf club head 100. In other words, the y-coordinate and/or the z-coordinate of the CG of the internal mass portion 445 may be the same or substantially similar (considering manufacturing tolerances) or offset from the y-coordinate and/or z-coordinate of the CG of the golf club head, respectively, by a small amount so that the CG of the golf club head 100 may be maintained relatively low and aft on the golf club head 100. The x, y, and z coordinates of the center of gravity of the internal mass portion 445 may be denoted herein by $CG_{M2X}$, $CG_{M2Y}$, and $CG_{M2Z}$, respectively. In one example, a distance on the x-axis between $CG_{M2X}$ and $CG_X$ may be greater than or equal to 0.5 inch (12.70 mm) and less than or equal to 1.5 inch (38.10 mm), a distance on the y-axis between $CG_{M2Y}$ and $CG_Y$ may be less than or equal to 0.2 inch (5.08 mm), and/or a distance on the z-axis between $CG_{M2Z}$ and $CG_Z$ may be less than or equal to 0.2 inch (5.08 mm). In another example, a distance on the x-axis between $CG_{M2X}$ and $CG_X$ may be greater than or equal to 0.5 inch (12.70 mm) and less than or equal to 2.0 inch (50.80 mm), a distance on the y-axis between $CG_{M2Y}$ and $CG_Y$ may be less than or equal to 0.5 inch (12.70 mm), and/or a distance on the z-axis between $CG_{M2Z}$ and $CG_Z$ may be less than or equal to 0.5 inch (12.70 mm). In another example, a distance on the x-axis between $CG_{M2X}$ and $CG_X$ may be greater than or equal to 0.75 inch (19.05 mm) and less than or equal to 1.75 inch (44.45 mm), a distance on the y-axis between $CG_{M2Y}$ and $CG_Y$ may be less than or equal to 0.25 inch (6.35 mm), and/or a distance on the z-axis between $CG_{M2Z}$ and $CG_Z$ may be less than or equal to 0.25 inch (6.35 mm). In yet another example, a distance on the x-axis between $CG_{M2X}$ and $CG_X$ may be greater than or equal to 1.0 inch (25.40 mm) and less than or equal to 1.75 inch (44.45 mm), a distance on the y-axis between $CG_{M2Y}$ and $CG_Y$ may be less than or equal to 0.75 inch (19.05 mm), and/or a distance on the z-axis between $CG_{M2Z}$ and $CG_Z$ may be less than or equal to 0.75 inch (19.05 mm). In other examples, the internal mass portion 445 may be the same or substantially the same as any of the internal mass portions described herein. The apparatus, methods, and articles of manufacture described herein are not limited in this regard.

The external mass portion 435 and the internal mass portion 445 may be strategically located to lower the center of gravity of the golf club head 100, whereas the internal mass portion 445 may also increase the MOI of the golf club head 100. Accordingly, the distance between the external mass portion 435 and the internal mass portion 445 along the x-axis may be relatively large to increase the MOI of the golf club head 100, whereas the distances between the external mass portion 435 and the internal mass portion 445 along the y-axis and the z-axis, respectively, may be relatively small to maintain a relatively low position for the center of gravity of the golf club head 100. In one example, a distance on the x-axis between $CG_{M1X}$ and $CG_{M2X}$ may be greater than or equal to 0.5 inch (12.70 mm) and less than or equal to 2.0 inch (50.80 mm), a distance on the y-axis between $CG_{M1Y}$ and $CG_{M2Y}$ may be less than or equal to 0.25 inch (6.35 mm), and/or a distance on the z-axis between $CG_{M1Z}$ and $CG_{M2Z}$ may be less than or equal to 0.1 inch (2.54 mm). In another example, a distance on the x-axis between $CG_{M1X}$ and $CG_{M2X}$ may be greater than or equal to 0.75 inch (19.05 mm) and less than or equal to 1.75 inch (44.45 mm), a distance on the y-axis between $CG_{M1Y}$ and $CG_{M2Y}$ may be less than or equal to 0.2 inch (5.08 mm), and/or a distance on the z-axis between $CG_{M1Z}$ and $CG_{M2Z}$ may be less than or equal to 0.2 inch (5.08 mm). In another example, a distance on the x-axis between $CG_{M1X}$ and $CG_{M2X}$ may be greater than or equal to 1.0 inch (25.40 mm) and less than or equal to 2.0 inch (50.80 mm), a distance on the y-axis between $CG_{M1Y}$ and $CG_{M2Y}$ may be less than or equal to 0.5 inch (12.70 mm), and/or a distance on the z-axis between $CG_{M1Z}$ and $CG_{M2Z}$ may be less than or equal to 0.25 inch (6.35 mm). In yet another example, a distance on the x-axis between $CG_{M1X}$ and $CG_{M2X}$ may be greater than or equal to 1.0 inch (25.40 mm) and less than or equal to 1.75 inch (44.45 mm), a distance on the y-axis between $CG_{M1Y}$ and $CG_{M2Y}$ may be less than or equal to 0.4 inch (10.16 mm), and/or a distance on the z-axis between $CG_{M1Z}$ and $CG_{M2Z}$ may be less than or equal to 0.4 inch (10.16 mm). The apparatus, methods, and articles of manufacture described herein are not limited in this regard.

In one example as illustrated in FIGS. 2-24, the top portion 946 of the internal mass portion 445 may have a smaller volume than the bottom portion 948, and the internal mass portion 445 may have a gradually increasing volume from the top portion 946 to the bottom portion 948. Accordingly, to lower a center of gravity of the golf club head 100, a distance between a center of gravity of the internal mass portion 445 and the sole portion edge 192 may be less than or substantially less than a distance between the center of gravity of the internal mass portion 445 and the horizontal midplane 520. In other words, the shape of the internal mass portion 445 as provided herein allows placement of the internal mass portion 445 close to the toe portion edge and placement of a relatively larger portion of the internal mass portion 445 below the horizontal midplane 520 and relatively close to the sole portion edge 192. As illustrated in the example of FIGS. 2-24, the entire internal mass portion 445 may be below the horizontal midplane 520. In another example, a substantial portion of the internal mass portion 445 may be below the horizontal midplane 520. In another example, the internal mass portion 445 may include a plurality of internal mass portions arranged proximate to the toe portion edge 142 in a top-to-sole and toe-to heel direction, with a greater number or all of the mass portions being located below the horizontal midplane 520. In another example, the internal mass portion 445 may include large portions that extend close to the sole portion edge 192. The apparatus, methods, and articles of manufacture described herein are not limited in this regard.

As illustrated in FIGS. 2-24, the internal mass portion 445 may include a height 1810 in a top-to-sole direction, a width 1820 in a toe-to-heel direction, and a depth 1830 in a front-to-back direction. In one example, as illustrated in FIGS. 2-24, the height 1810 may be greater than the width 1820 and greater than the depth 1830. Accordingly, the internal mass portion 445 may extend proximate to a greater portion of the toe portion edge 142 to increase the moment of inertia of the golf club head 100. In another example, as illustrated in FIGS. 2-24, the depth 1830 may increase in a top-to-sole direction to increase the volume and the mass of the internal mass portion 445 in a top-to-sole direction as described herein. In another example, as illustrated in FIGS. 2-24, the depth 1830 may be greater than the width 1820. Accordingly, the internal mass portion 445 may extend proximate to a greater portion of the toe portion edge 142 and farther aft to increase the moment of inertia of the golf club head 100 and move the center of gravity of the golf club head 100 lower and farther aft. In one example, the height 1810 may be greater than or equal to 0.5 inch (12.70 mm) and less than or equal to 1.25 inch (31.75 mm). In another example, the height 1810 may be greater than or equal to 0.8 inch (20.32 mm) and less than or equal to 1.1 inch (27.94 mm). In yet another example, the height 1810 may be greater than or equal to 0.9 inch (22.86 mm) and less than or equal to 1.0 inch (25.40 mm). In one example, the width 1820 and the depth 1830 may have the same values with any variation being due to manufacturing tolerances. In another example, the width 1820 may be greater than equal to 75% and less than or equal to 125% of the depth 1830. In another example, the depth 1830 may be greater than or equal to 75% and less than or equal to 125% of the width 1820. In another example, the width 1820 and/or the depth 1830 may be greater than or equal to 0.2 inch (5.08 mm) and less than or equal to 0.5 inch (12.70 mm). In another example, the width 1820 and/or the depth 1830 may be greater than or equal to 0.27 inch and less than or equal to 0.37 inch. In another example, the width 1820 and/or the depth 1830 may be greater than or equal to 0.3 inch (7.62 mm) and less than or equal to 0.35 inch (8.89 mm). In another example, the width 1820 and/or the depth 1830 may be greater than or equal to 10% of the height 1810 and less than or equal to 50% of the height 1810. The apparatus, methods, and articles of manufacture described herein are not limited in this regard.

The third port 341 may define a recess or cavity in the body portion 110 that may be shaped to correspond to the shape of the internal mass portion 445 to receive the internal mass portion 445. In one example, as illustrated in FIGS. 2-24, the third port 341 may be shaped to completely receive the internal mass portion 445 so that the outer surface of the internal mass portion is flush with the interior walls of the body portion 110 defining the interior cavity 210. The internal mass portion 445 may be secured inside the third port 341 with one or more adhesives or bonding agents, by welding or soldering, and/or by being press fit. The third port 341 may be defined by a cavity inside a body mass portion 145, which may be an integral portion of the body portion 110, formed with the body portion 110, and/or include the same materials as the materials of the body portion 110. The body mass portion 145 may be located in the toe portion 140 and may extend to the toe portion edge 142 to increase the moment of inertial of the golf club head 100. In the illustrated example of FIGS. 2-24, the body mass portion may extend from the top portion edge 182 to the sole portion edge 192 and extend into the interior cavity 210 from the toe portion edge 142. The shape, size, volume, and/or mass of the body mass portion 145 may be determined to provide certain performance characteristics for the golf club head 100. In one example, as illustrated in FIGS. 2-24, the body mass portion 145 may be located in the toe portion 140, extend to the toe portion edge 142, and extend from the top portion edge 182 to the sole portion edge 192. The shape, size, volume, and/or mass of the body mass portion 145 may vary and depend on various properties of the golf club head 100 including the loft angle 545. The apparatus, methods, and articles of manufacture described herein are not limited in this regard.

The interior cavity 210 may vary in width between the toe portion 140 and the heel portion 150. An interior cavity width 710 may be smaller proximate to the toe portion edge 142 than the interior cavity width 710 at the center portion of the body portion or at the heel portion 150 due to the presence of the body mass portion 145. Accordingly, a greater portion of the mass of the body portion 110 may be closer to the toe portion edge 142 than the heel portion edge 152 to increase the moment of inertia of the body portion 110. In one example, as illustrated in FIGS. 2-24, the interior cavity width 710 may have a maximum value at a location between the external mass portion 435 and the internal mass portion 445. As illustrated in the example of FIGS. 2-24, portions of the interior cavity 210 may extend vertically below the port sleeve 1610 and/or the external mass portion 435 and be farther from the face portion 162 than portions of the port sleeve 1610 and/or the external mass portion 435. Accordingly, in the example illustrated in FIGS. 2-24, a maximum value of the interior cavity width 710, which may be measured in a face-to-back direction, may be between the external mass portion 435 and the internal mass portion 445 in a toe-to-heel direction and between the sole portion edge 192 and the external mass portion 435 in a top-to sole direction. In one example, the maximum value of the interior cavity width 710 may be greater than or equal to 0.4 inch (10.16 mm) and less than or equal to 0.9 inch (22.86 mm). In another example, the maximum value of the interior cavity width 710 may be greater than or equal to 0.5 inch (12.70 mm) and less than or equal to 0.8 inch (20.32 mm). In yet another example, the maximum value of the interior cavity width 710 may be greater than or equal to 0.6 inch (15.24 mm) and less than or equal to 0.7 inch (17.78 mm). As illustrated in the example of FIGS. 2-24, portions of the interior cavity 210 located vertically above the port sleeve 1610 and/or the external mass portion 435 may be farther from the face portion 162 than portions of the port sleeve 1610 and/or the external mass portion 435. The apparatus, methods, and articles of manufacture described herein are not limited in this regard.

In one example, as illustrated in FIGS. 2-24, the second port 331, the badge 428, and the internal mass portion 445 may be located between the external mass portion 435 and the toe portion edge 142. As described herein, the external mass portion 435 may function to lower the center of gravity of the golf club head 100 and shift the center of gravity rearward. The internal mass portion 445 may function to increase the moment of inertia of the golf club head 100. The internal mass portion 445 may also lower and/or shift rearward the center of gravity of the golf club head 100. Additionally, with the bottom portion 948 of the internal mass portion 445 having a greater mass than the top portion 946, a vertical location of the center of gravity of the golf club head 100 may not be largely shifted by the internal mass portion 445 while placing more mass toward the toe portion edge to increase the MOI of the golf club head 100. The apparatus, methods, and articles of manufacture described herein are not limited in this regard.

In one example, the badge 428 may be constructed from a material having a lower density than the material of the body portion 110 to not have a large effect on the mass distribution of the body portion 110. In yet another example, the badge 428 may be made from a material having a relatively large density such as the material form which any of the mass portions may be constructed. Accordingly, the badge 428 may function to increase the moment of inertia of the golf club head 100. The apparatus, methods, and articles of manufacture described herein are not limited in this regard.

The interior cavity 210 may be partially or entirely filled with one or more filler materials (i.e., a cavity filling material), which may include one or more similar or different types of materials. In one example, as illustrated in FIGS. 2-24, the filler material 612 may be a urethane elastomer material that may be curable at room temperature or higher temperatures to accelerate the curing process. In one example, the filler material 612 may be injected into the interior cavity 210 from the first port 321 and/or the second port 331 to fill the interior cavity 210 partially or completely. The first port 321 may serve as an injection port whereas the second port 331 may serve as an exhaust port to allow the air that is displaced in the interior cavity 210 by the filler material to exit the interior cavity 210. Alternatively, the second port 331 may serve as an injection port whereas the first port 321 may serve as an exhaust port. Accordingly, as illustrated in FIGS. 2-24, the filler material 612 may be molded in the shape of the interior cavity 210. After injection of the filler material 612 into the interior cavity 210, the filler material 612 may be allowed to cure. In one example, the filler material 612 may cure at room temperature. In another example, the filler material 612 may be cured at 50 degrees Celsius. In another example, the filler material 612 may be cured at 70 degrees Celsius. In yet another example, the filler material 612 may be cured at 80 degrees Celsius. In another example, the filler material 612 may be similar to any of the filler materials described herein or in any of the incorporated by reference patent documents. In yet another example, the interior cavity 210 may be filled with a first filler material and a second filler material that may be similar to the first filler material and the second filler material of any of the golf club heads described in any of the incorporated by reference patent documents. The apparatus, methods, and articles of manufacture described herein are not limited in this regard.

In one example, the golf club head 100 may have a total weight of greater than or equal to 180 grams and less than or equal to 340 grams. In another example, the golf club head 100 may have a total weight of greater than or equal to 220 grams and less than or equal to 300 grams. In yet another example, the golf club head 100 may have a total weight of greater than or equal to 250 grams and less than or equal to 270 grams. In one example, the weight of the filler material may be greater than or equal to 15 grams and less than or equal to 35 grams. In another example, the weight of the filler material may be greater than or equal to 22 grams and less than or equal to 30 grams. In yet another example, the weight of the filler material may be greater than or equal to 22 grams and less than or equal to 28 grams. The total weight of the filler material 612 may be expressed as a percentage of the total weight of the golf club head 100. Accordingly, the weight of the filler material may comprise greater than or equal to 5% and less than or equal to 19% of the total weight of the golf club head 100. The apparatus, methods, and articles of manufacture described herein are not limited in this regard.

As described herein, the sizes and weights of the external mass portion 435, the internal mass portion 445, and/or the port sleeve 1610 may be determined to affect the moments of inertia and CG location of the golf club head 100 to provide certain performance characteristics for the golf club head 100. The internal mass portion 445 may have a total weight that may be greater than the total weight of the external mass portion 435, the total weight of the port sleeve 1610, and/or the sum of the total weights of the external mass portion 435 and the port sleeve 1610 to increase the MOI of the golf club head 100. In one example, the total weight of the internal mass portion 445 may be greater than or equal to 10 grams and less than or equal to 20 grams. In another example, the total weight of the internal mass portion 445 may be greater than or equal to 12 grams and less than or equal to 16 grams. In yet another example, the total weight of the internal mass portion 445 may be greater than or equal to 13 grams and less than or equal to 15 grams. The apparatus, methods, and articles of manufacture described herein are not limited in this regard.

In one example, the total weight of the external mass portion 435 may be greater than or equal to 5 grams and less than or equal to 11 grams. In another example, the total weight of the external mass portion 435 may be greater than or equal to 7 grams and less than or equal to 9 grams. In another example, the total weight of the external mass portion 435 may be greater than or equal to 6 grams and less than or equal to 8 grams. In another example, the total weight of the external mass portion 435 may be greater than or equal to 25% and less than or equal to 75% of the total weight of the internal mass portion 445. In another example, the total weight of the external mass portion 435 may be greater than or equal to 40% and less than or equal to 60% of the total weight of the internal mass portion 445. In another example, a ratio of a weight of the internal mass portion 445 to a weight of the external mass portion may be greater than or equal to 1.0. In another example, a ratio of a weight of the internal mass portion 445 to a weight of the external mass portion may be greater than or equal to 1.25. In yet another example, a ratio of a weight of the internal mass portion 445 to a weight of the external mass portion may be greater than or equal to 1.25 and less than or equal to 2.0. The apparatus, methods, and articles of manufacture described herein are not limited in this regard.

The port sleeve 1610 may be constructed from a material that has a lower density than the density of the material of the body portion 110 and the density of the material of the external mass portion 435 so that the weight savings from using the port sleeve 1610 may be strategically transferred to other portions of the golf club head 100 to achieve certain performance characteristics. In one example, the port sleeve 1610 may be constructed from an aluminum-based material. In another example, the port sleeve 1610 may be constructed from a titanium-based material. In yet another example, the port sleeve 1610 may be constructed from a polymer material. As described herein, the external mass portion 435 may be constructed from a material having a greater density than the density of the material of the body portion 110. In one example, the external mass portion 435 may be constructed from a tungsten-based material. Accordingly, the total weight of the external mass portion 435 may be greater than the total weight of the port sleeve 1610. In one example, the total weight of the port sleeve 1610 may be greater than or equal to 3 grams and less than or equal to 6 grams. In another example, the total weight of the port sleeve 1610 may be greater than or equal to 3.5 grams and less than or equal to 5 grams. In another example, the total weight of the port sleeve 1610 may be greater than or equal to 4 grams and less than or equal to 4.75 grams. In another example, the total weight of the port sleeve 1610 may be greater than or equal to 25% and less than or equal to 75% of the total weight of the external mass portion 435. In yet another example, the total weight of the port sleeve 1610 may be greater than or equal to 40% and less than or equal to 60% of the total weight of the external mass portion 435. The apparatus, methods, and articles of manufacture described herein are not limited in this regard.

As described herein, the interior cavity 210 may be partially or entirely filled with one or more filler materials (i.e., a cavity filling material), which may include one or more similar or different types of materials. The amount (i.e., volume and/or mass) filler material may be determined for each golf club head (i.e., having a certain loft angle) to (i) provide vibration dampening or sound dampening (e.g., consistent and/or pleasing sound and feel when the golf club head strikes a golf ball as perceived by an individual using the golf club head), (ii) provide structural support for the face portion, and/or (iii) optimize ball travel distance, ball speed, ball launch angle, ball spin rate, ball peak height, ball landing angle and/or ball dispersion. The interior cavity 210 may be filled with a filler material such that the back surface 166 of the face portion is covered with the filler material. Accordingly, the filler material may provide structural support for the relatively thinner portions of the face portion 162.

The resilience of the filler material 612 of the golf club head 100, which is referred to herein as GC1 (i.e., Golf Club No. 1), was tested and compared with the resilience of the filler materials of three example golf clubs, which are referred to herein as GC2, GC3, and CG4. To test each golf club head, the face portion of each golf club head was removed by a milling machine by cutting around the perimeter of the face portion and exposing the filler material in intact for by carefully removing the face portion. The resilience of the filler material of each golf club head was tested using the test equipment and procedures used by United States Golf Association to determine the characteristic time (CT) of a golf club head as provided in R&A Rules Limited and United States Golf Association PROTOCOL FOR MEASURING THE FLEXIBLITY OF A GOLF CLUBHEAD, TPX3004 Rev. 2.0, 9 Apr. 2019; and United States Golf Association PROCEDURE FOR MEASURING THE FLEXIBILITY OF A GOLF CLUBHEAD, USGA-TPX3004 Revision 1.0.0 May 1, 2008. In other words, the CT test equipment used by the United States Golf Association, which includes a pendulum striking the face of a test golf club, was used to determine the resilience of the filler material. Each golf club head was mounted in the fixture of the CT test equipment such that the pendulum struck the face portion at a location approximately 0.75 inch (19.05 mm) from the leading edge of the sole portion edge 192 and at a center of a face groove at that location. Additionally, each golf club head was mounted in the fixture such that the heel-to-toe direction of the golf club head was in a vertical orientation (i.e., face groove oriented vertically). The pendulum was equipped with an accelerometer and accelerometer data was sampled at 10240 Hz to determine the maximum velocity of the pendulum in meters per second (m/s) before contact with the filler material and the maximum velocity of the pendulum in m/s after contact with the filler material during the rebound of the pendulum. For all tests, the average pendulum velocity when striking the filler material was between 0.79 and 0.81 m/s. In one example, the maximum rebound velocity obtained from multiple tests for GC1 was greater than 2.0 m/s and less than 2.09 m/s with an average maximum rebound velocity of 2.06 m/s; the maximum rebound velocity obtained from multiple tests for GC2 was greater than 1.9 m/s and less than 1.98 m/s with an average maximum rebound velocity of 1.95 m/s; the maximum rebound velocities obtained from multiple tests for GC3 and CG4 were similar and greater than 1.71 m/s and less than 1.79 m/s with an average maximum rebound velocity of 1.76. Accordingly, the average maximum rebound velocity of GC1 or golf club head 100 may be greater than the maximum rebound velocity of GC2 by 5%, and greater than the maximum rebound velocities of GC3 and GC4 by 15%. The golf swing speed of an individual may vary between 60 miles per hour (27 m/s) to 170 miles per hour (76 m/s). Accordingly, the increased rebound or resiliency of the filler material 612 of the golf club head 100 as evidenced by the increase in the average maximum rebound velocity of GC1 relative to the average maximum rebound velocities of GC2, CG3, and CG4, may represent a significant improvement in ball speed and consequently ball carry distance when a golf club having a golf club head 100 is used by an individual.

In one example, as the sleeve front portion 1620 penetrates the interior cavity 210 as described herein by the port sleeve 1610 being screwed into the second port 331, the sleeve front portion 1620 may compress the filler material 612 between the sleeve front portion 1620 and the face portion 162 at or proximate to the ball strike region of the face portion 162. Accordingly, driving the port sleeve 1610 into the interior cavity 210 may provide preloading of the filler material 612 at or around the ball strike region of the golf club head 100 to provide a higher coefficient of restitution (COR) for the golf club head 100. The COR of the golf club head 100 may be adjusted by the depth of penetration of the port sleeve 1610 into the interior cavity 210. Accordingly, by engaging the port sleeve 1610 with a tool to screw the port sleeve 1610 into or out of the second port 331, the COR of the golf club head 100 may be adjusted. The COR may be adjusted to a certain value to comply with rules of certain golf governing bodies. For example, the COR of the golf club head 100 may be adjusted to a maximum or a near maximum value permitted by a certain golf governing body such as the United States Golf Association (USGA). In one example, the COR of the golf club head 100 may be greater than or equal to 0.80 and less than or equal to 0.86. In another example, the COR of the golf club head 100 may be greater than or equal to 0.82 and less than or equal to 0.85. In yet another example, the COR of the golf club head may be greater than or equal to 0.82 and less than or equal to a COR value that complies with the maximum COR value allowed by a golf governing body. The apparatus, methods, and articles of manufacture described herein are not limited in this regard.

Figure 24:
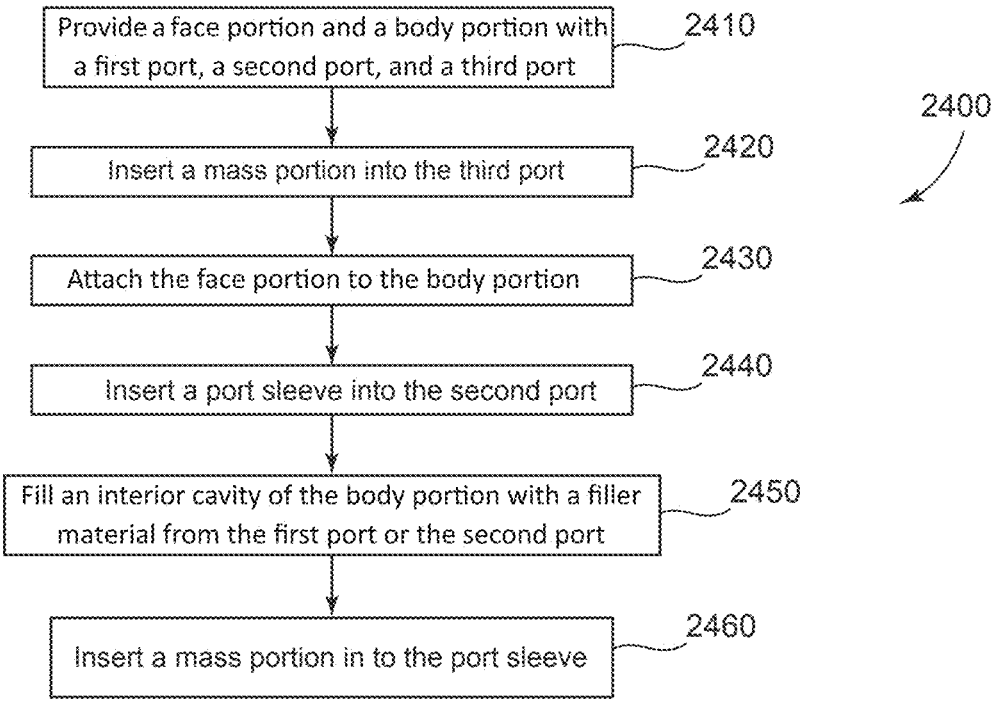

In one example, as illustrated in FIG. 24, a method 2400 of manufacturing the golf club head 100 includes providing a body portion 110, a face portion 162, an external mass portion 435, an internal mass portion 445, a port sleeve 1610, and a badge 428 as described herein (block 2410). The internal mass portion 445 is inserted and/or attached to the body portion 110 inside the third port 341 (block 2420) as described herein. The face portion 162 is attached to the body portion 110 to enclose the interior cavity 210 at the front portion 160 of the body portion 110 (block 2430). The port sleeve 1610 is inserted into the second port 331 by being screwed into the second port 331 (block 2440) as described herein. In one example, the port sleeve 1610 may be completely screwed into the second port 331 until further penetration into the interior cavity 210 is prevented by the sleeve bezel 1614 as described herein. In another example, the port sleeve 1610 may be partially screwed into the second port 331 to allow preloading of one or more filler materials in the interior cavity 210 as described herein. In yet another example, the port sleeve 1610 may be partially screwed into the second port 331 to allow the filler material to fill portions of the second port 331. The interior cavity 210 may be filled with a filler material (block 2450) from the first port 321 or the second port 331 as described herein. The filler material may then cure at room temperature, at a temperature greater than room temperature, and/or using one or more cure cycles. The badge 428 may then be coupled to the body portion 110 over the first port 321 to close the first port 321. As described herein, the badge 428 may be attached to the body portion 110 by being inserted and/or secured inside the recessed portion 426. The external mass portion 435 may then be secured into the second port 331 (block 2460) as described herein. The external mass portion 435 may be removed if required to change the penetration depth of the port sleeve 1610 as described herein and reinstalled inside the second port 331. In other words, the preloading of the filler material 612 may be adjusted at any time. The apparatus, methods, and articles of manufacture described herein are not limited in this regard.

Figure 25:
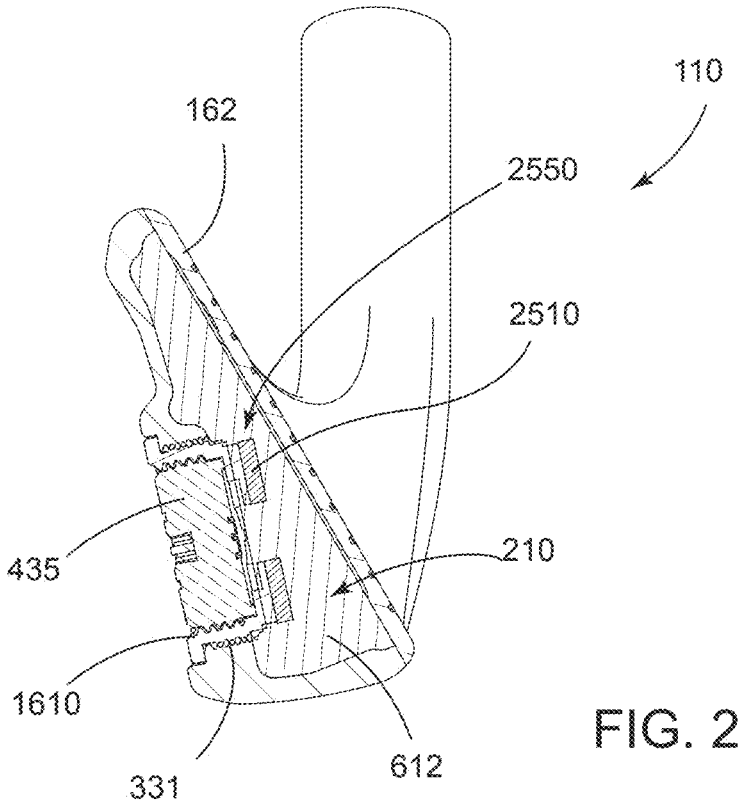
Figure 26:
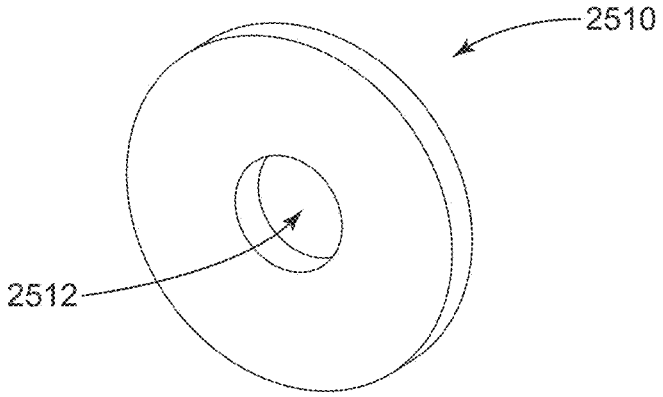
Figure 27:
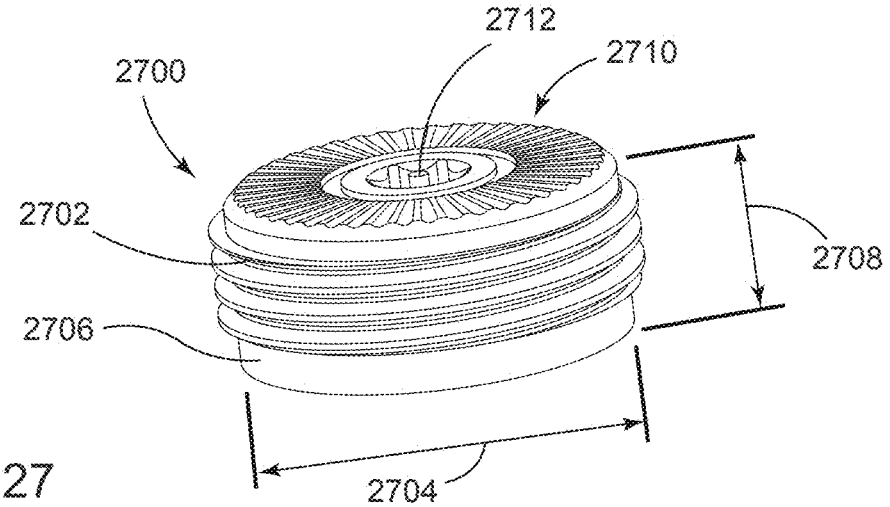
FIGS. 27, 28 and 29 are a mass portion, an example face portion, and another example face portion, respectively, for the golf club head of FIG. 2 according to embodiments of the apparatus, methods, and articles of manufacture described herein.

In one example, as illustrated in FIGS. 25 and 26, the golf club head 100 may include a filler compression portion 2510 between the port sleeve 1610 and the filler material 612. The filler compression portion 2510 may have any shape, size, orientation and/or configuration. In one example, as illustrated in FIGS. FIGS. 25 and 26, the filler compression portion 2510 may be annular and include a center hole 2512. The outer diameter of the filler compression portion 2510 may be the same, greater or smaller than the outer diameter of the port sleeve 1610. In one example, as illustrated in FIGS. FIGS. 25 and 26, the filler compression portion 2510 may have the same or substantially the same outer diameter as the outer diameter of the port sleeve 1610. In another example, the sleeve front portion 1620 may include a circular recess to receive the filler compression portion 2510 therein. As the sleeve front portion 1620 penetrates the interior cavity 210 as described herein by the port sleeve 1610 being screwed into the second port 331, the filler compression portion 2510 may compress the filler material 612 behind the face portion 162 and at or proximate to the ball strike region of the face portion 162. Accordingly, driving the port sleeve 1610 into the interior cavity 210 and using the filler compression portion 2510 may provide preloading of the filler material 612 to provide a higher coefficient of restitution (COR) for the golf club head 100 as described herein. To avoid an excessive force on the face portion 162 due to the preloading of the filler material 612 and possible bulging of the face portion 162, portions of the filler material 612 may flow, displace or move due to the elasticity of the filler material 612 into the center hole 2512 of the filler compression portion 2510 and gaps 2550 inside the interior cavity 210 around the port sleeve 1610 and the filler compression portion 2510. Accordingly, the center hole 2512 and the gaps 2550 may provide certain compression relief to the filler material 612 to prevent bulging of the face portion 162. The apparatus, methods, and articles of manufacture described herein are not limited in this regard.

The filler compression portion 2510 may be constructed from a polymer material having a higher COR than the filler material 612. Accordingly, the filler compression portion 2510 may compress and rebound during use and contribute to increasing the COR of the golf club head 100. In other words, the filler compression portion 2510 may increase the COR of the golf club head 100 by preloading the filler material 612 and by providing a rebounding force on the face during a golf ball strike. Alternatively, the filler compression portion 2510 may be constructed from a relatively more rigid material to provide preloading of the filler material 612. In one example, the filler compression portion 2510 may be constructed from any of the filler materials described herein such as any urethane-based materials, and the filler material 612 may be constructed from a polymer material having a lower COR than the filler compression portion 2510. For example, the filler material 612 may be constructed from a polybutadiene material or any of the filler materials described herein. The filler compression portion, however, may be constructed from any type of material. The apparatus, methods, and articles of manufacture described herein are not limited in this regard.

Figure 30:
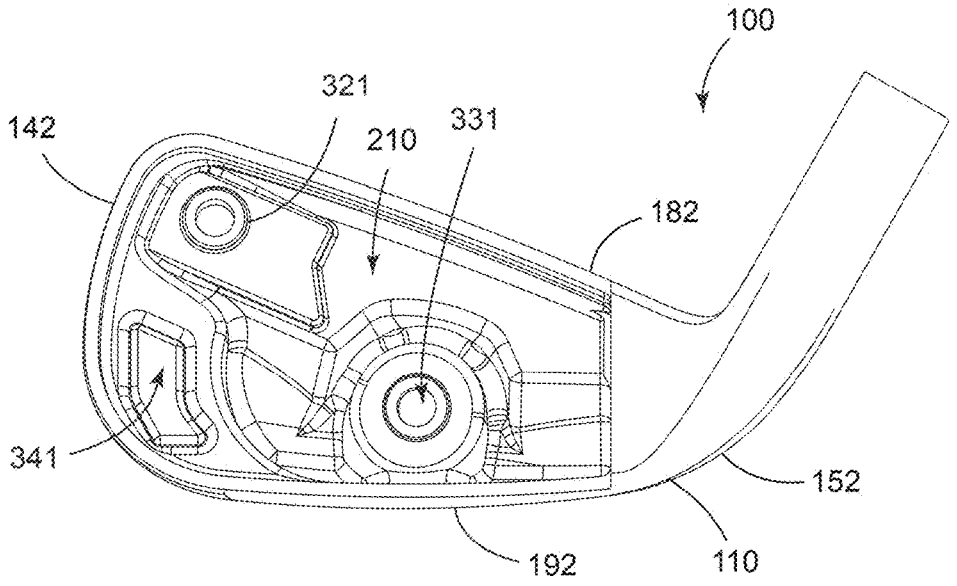
FIGS. 30, 31, 32, and 33, illustrate a front view with the face portion removed, a side view of an internal mass portion, a side perspective view of the internal mass portion of FIG. 31, and a front perspective view of the internal mass portion of FIG. 31, respectively, for another example of the golf club head of FIG. 2 according to embodiments of the apparatus, methods, and articles of manufacture described herein.
Figure 31:
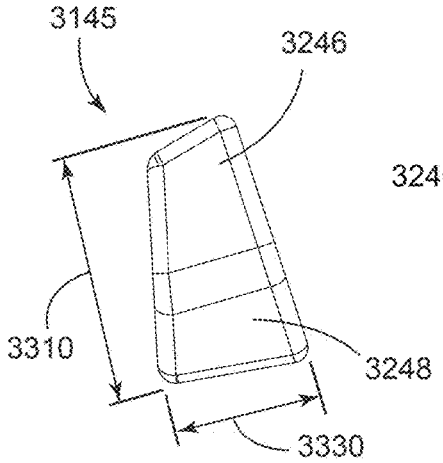
Figure 32:
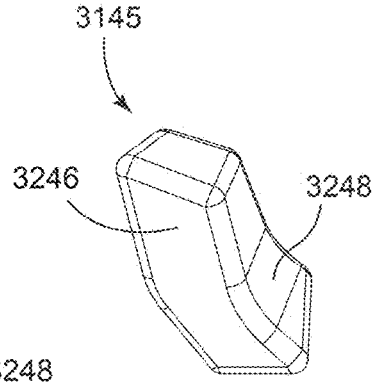
Figure 33:
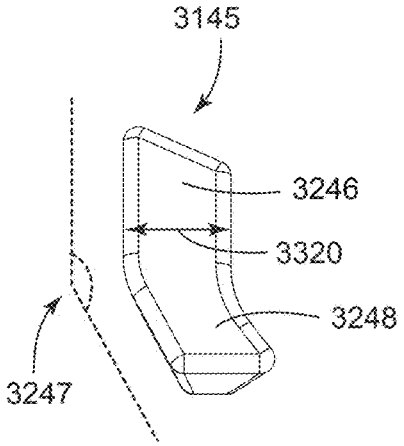

FIG. 30 illustrates another example of the golf club head 100 with an internal mass portion 3145 having a different configuration than the internal mass portion 445. As illustrated in FIGS. 31-33, the internal mass portion 3145 may have an angled shape that may approximately correspond to the shape of the toe portion edge 142. Accordingly, a top portion 3246 of the internal mass portion 3145 may be oriented at an obtuse angle 3247 relative to a bottom portion 3248 of the internal mass portion 3145 to discreetly simulate the curvature of the toe portion edge 142. In another example (not shown), the internal mass portion 3145 may be located close to the toe portion edge 142 and have more than two angled portions oriented at obtuse angles relative to each other to closely discreetly but more closely simulate the curved shape of the toe portion edge 142. In another example, the internal mass portion 3145 may include two separate mass portions that may be located close to the toe portion edge 142. In yet another example, the internal mass portion 3145 may include a plurality of separate mass portions that may be arranged close to the toe portion edge 142 to correspond to the shape of the toe portion edge 142. The apparatus, methods, and articles of manufacture described herein are not limited in this regard.

In one example as illustrated in FIGS. 31-33, the top portion 3246 of the internal mass portion 3145 may have a smaller volume than the bottom portion 3248, and the internal mass portion 3145 may have a gradually increasing volume from the top portion 3246 to the bottom portion 3248. Accordingly, to lower a center of gravity of the golf club head 100, all or a larger portion of the internal mass portion 3145 may be below the horizontal midplane 520, and/or a distance between a center of gravity of the internal mass portion 3145 and the sole portion edge 192 may be less than or substantially less than a distance between the center of gravity of the internal mass portion 3145 and the top portion edge 182. In other words, the shape of the internal mass portion 3145 as provided herein allows placement of the internal mass portion 3145 close to the toe portion edge and placement of all or a relatively larger portion of the internal mass portion 3145 below the horizontal midplane 520. In another example, all portions of the internal mass portion 3145 may be below the horizontal midplane 520. In another example, the internal mass portion 3145 may include a plurality of internal mass portions arranged proximate to the toe portion edge 142 in a top-to-sole and toe-to heel direction, with a greater number or all of the mass portions being located below the horizontal midplane 520. In another example, the internal mass portion 3145 may include large portions that extend close to the sole portion edge 192. The apparatus, methods, and articles of manufacture described herein are not limited in this regard.

As illustrated in FIGS. 31-33, the internal mass portion 3145 may include a height 3310 in a top-to-sole direction, a width 3320 in a toe-to-heel direction, and a depth 3330 in a front-to-back direction. In one example, as illustrated in FIGS. 31-33, the height 3310 may be greater than the width 3320 and greater than the depth 3330. Accordingly, the internal mass portion 3145 may extend proximate to a greater portion of the toe portion edge 142 to increase the moment of inertia of the golf club head 100. In another example, as illustrated in FIGS. 31-33, the depth 3330 may increase in a top-to-sole direction to increase the volume and the mass of the internal mass portion 3145 in a top-to-sole direction as described herein. In another example, as illustrated in FIGS. 31-33, the depth 3330 may be greater than the width 3320. Accordingly, the internal mass portion 3145 may extend proximate to a greater portion of the toe portion edge 142 and farther aft to increase the moment of inertia of the golf club head 100 and move the center of gravity of the golf club head 100 lower and farther aft. The apparatus, methods, and articles of manufacture described herein are not limited in this regard.

The third port 341 may define a recess or cavity in the body portion 110 that may be shaped to correspond to the shape of the internal mass portion 3145 to receive the internal mass portion 3145. In one example, as illustrated in FIGS. 31-33, the third port 341 may be shaped to completely receive the internal mass portion 3145 so that the outer surface of the internal mass portion is flush with the interior walls of the body portion 110 defining the interior cavity 210. The internal mass portion 3145 may be secured inside the third port 341 with one or more adhesives or bonding agents, by welding or soldering, and/or by being press fit. The third port 341 may be defined by a cavity inside a body mass portion 145, which may be an integral portion of the body portion 110, formed with the body portion 110, and/or include the same materials as the materials of the body portion 110. The apparatus, methods, and articles of manufacture described herein are not limited in this regard.

Figure 34:
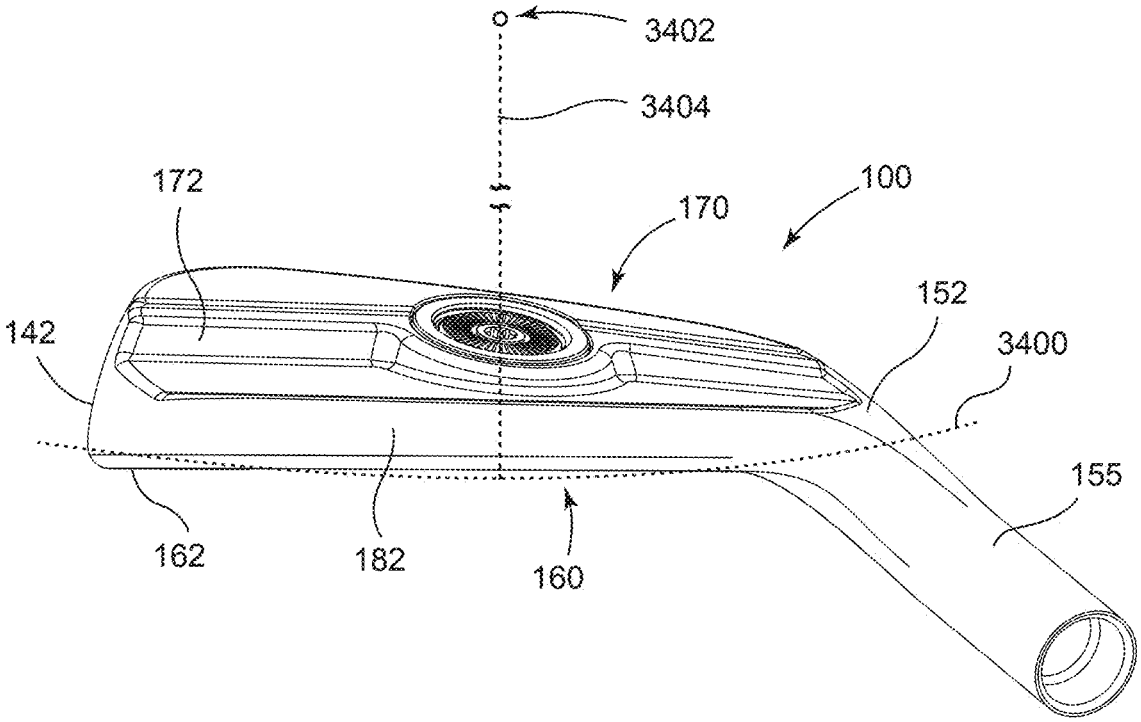
FIGS. 34 and 35 show a top view and a side view, respectively, of another example of a golf club head according to any embodiment of the apparatus, methods, and articles of manufacture described herein.

In one example, as illustrated in FIG. 34, the face portion 162 or the front surface 164 of the face portion 162 may include horizontal curvature 3400 (schematically illustrated in FIG. 34), which may also be referred to herein as face bulge, extending between the toe portion edge 142 and the heel portion edge 152. The horizontal curvature 3400 may be defined by a segment of a circle having a center 3402 located aft of the golf club head 100 with a bulge radius 3404. In one example, the bulge radius 3404 may be greater than or equal to 7 inches (152.4 mm) and less than or equal to 15 inches (381 mm). In another example, the bulge radius 3404 may be greater than or equal to 8 inches (203.2 mm) and less than or equal to 12 inches (304.8 mm). In another example, the bulge radius 3404 may be greater than or equal to 6 inches (152.4 mm) and less than or equal to 10 inches (254 mm). In yet another example, the bulge radius 3404 may be greater than or equal to 6 inches (152.4 mm) and less than or equal to 25 inches (635 mm). For an off-center golf ball strike on the face portion 162, the horizontal curvature 3400 or bulge may impart a horizontal spin on the ball to optimize ball trajectory toward a target line (i.e., a target line of an on-center hit). The apparatus, methods, and articles of manufacture described herein are not limited in this regard.

Figure 35:
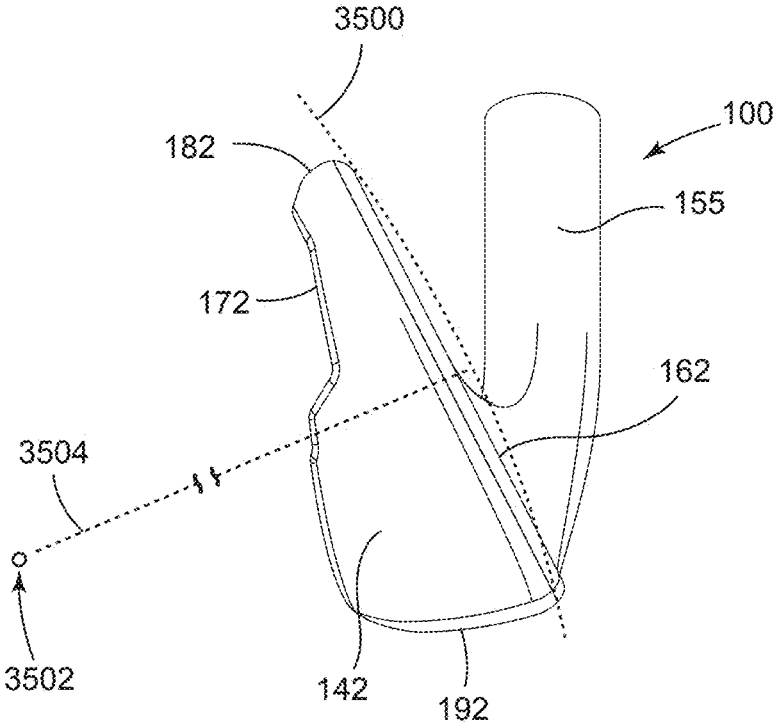

In one example, as illustrated in FIG. 35, the face portion 162 or the front surface 164 of the face portion 162 may include vertical curvature 3500 (schematically illustrated in FIG. 35), which may also be referred to herein as face roll, extending between the top portion edge 182 and the sol portion edge 192. The vertical curvature 3500 may be defined by a segment of a circle having a center 3502 located aft of the golf club head 100 with a roll radius 3504. In one example, the roll radius 3504 may be greater than or equal to 7 inches (152.4 mm) and less than or equal to 15 inches (381 mm). In another example, the roll radius 3504 may be greater than or equal to 8 inches (203.2 mm) and less than or equal to 12 inches (304.8 mm). In another example, the roll radius 3504 may be greater than or equal to 6 inches (152.4 mm) and less than or equal to 10 inches (254 mm). In yet another example, roll radius 3504 may be greater than or equal to 6 inches (152.4 mm) and less than or equal to 25 inches (635 mm). For an off-center golf ball strike on the face portion 162, the vertical curvature 3500 or bulge may impart a vertical spin on the ball to optimize ball trajectory toward a target line (i.e., a target line of an on-center hit). The apparatus, methods, and articles of manufacture described herein are not limited in this regard.

In one example, as illustrated in FIGS. 36-45, a face portion 3602 may include a front side 3604 having one or more front grooves 3608, a back side 3606, and a perimeter edge 3610 defined by a face toe edge 3612, a face heel edge 3614, a face top edge 3616 and a face sole edge 3618. The face portion 3602 may be used with any golf club head such as any of the golf club heads described herein or described in any of the incorporated by reference patent documents (e.g., one shown as the golf club head 100 in FIGS. 1-16). The apparatus, methods, and articles of manufacture described herein are not limited in this regard.

In one example, as illustrated in FIGS. 36-45, to describe the characteristics and/or properties of the face portion 3602, a horizontal midplane 3620 of the golf club head to which the face portion 3602 may be coupled and a vertical plane 3622 bisecting the face portion 3602 may divide the face portion 3602 to define face portion quadrants (e.g., generally shown as 3642, 3644, 3646, and 3648). The vertical plane 3622 divides the face portion 3602 into a toe-side portion and a heel-side portion, and the horizontal midplane 3620 divides the face portion 3602 into a top-side portion and a sole-side portion. Accordingly, the face portion 3602 may be defined by a toe-top quadrant or a first quadrant 3642 (i.e., an upper toe-side portion of the face portion 3602), a heel-top quadrant or a second quadrant 3644 (i.e., an upper heel-side portion of the face portion 3602), a heel-sole quadrant or a third quadrant 3646 (i.e., a lower heel-side portion of the face portion 3602), and a toe-sole quadrant or a fourth quadrant 3648 (i.e., a lower toe-side portion of the face portion 3602). The horizontal midplane 3620 may be the same as any of the horizontal midplanes described herein (e.g., the horizontal midplane 520 illustrated in FIG. 7), which may be a plane that is equidistant from and parallel with a top plane and a ground plane with the golf club at an address position. The apparatus, methods, and articles of manufacture described herein are not limited in this regard.

Each of the first quadrant 3642, the second quadrant 3644, the third quadrant 3646, and the fourth quadrant 3648 may include a maximum face thickness portion and a minimum face thickness portion. In one example, a maximum face thickness portion in one or more of the first quadrant 3642, the second quadrant 3644, the third quadrant 3646, and the fourth quadrant 3648 may include the maximum thickness of the face portion 3602, whereas in another example, a maximum face thickness portion in one or more of the first quadrant 3642, the second quadrant 3644, the third quadrant 3646, and the fourth quadrant 3648 may have a thickness that is less than the maximum thickness of the face portion 3602. In one example, a minimum face thickness portion in one or more of the first quadrant 3642, the second quadrant 3644, the third quadrant 3646, and the fourth quadrant 3648 may include the minimum thickness of the face portion 3602, whereas in another example, a minimum face thickness portion in one or more of the first quadrant 3642, the second quadrant 3644, the third quadrant 3646, and the fourth quadrant 3648 may have a thickness that is greater than the minimum thickness of the face portion 3602. The apparatus, methods, and articles of manufacture described herein are not limited in this regard.

In one example, the maximum thickness and the minimum thickness of the face portion 3602 may be in the first quadrant 3642. In another example, the maximum thickness of the face portion 3602 may be in the first quadrant 3642, and the minimum thickness of the face portion 3602 may be in the second quadrant 3644, the third quadrant 3646, and/or the fourth quadrant 3648 (i.e., one or a plurality of locations having the minimum thickness of the face portion 3602). In yet another example, the minimum thickness of the face portion 3602 may be in the first quadrant 3642, and the maximum thickness of the face portion 3602 may be in the second quadrant 3644, the third quadrant 3646, and/or the fourth quadrant 3648 (i.e., one or a plurality of locations having the maximum thickness of the face portion 3602). In the example where the first quadrant 3642 includes the maximum thickness of the face portion 3602, the thickness of the face portion 3602 may transition from the maximum thickness of the face portion 3602 in the first quadrant 3642 to the minimum thickness of the face portion 3602 according to a first thickness gradient. The first thickness gradient may vary (i.e., a plurality of first thickness gradients) depending on the location of the maximum thickness of the face portion 3602 in the first quadrant 3642 and one or more locations of the minimum thickness of the face portion 3602 in the first quadrant 3642, the second quadrant 3644, the third quadrant 3646, and/or the fourth quadrant 3648. The apparatus, methods, and articles of manufacture described herein are not limited in this regard.

In one example, the maximum thickness and the minimum thickness of the face portion 3602 may be in the second quadrant 3644. In another example, the maximum thickness of the face portion 3602 may be in the second quadrant 3644, and the minimum thickness of the face portion 3602 may be in the first quadrant 3642, the third quadrant 3646, and/or the fourth quadrant 3648 (i.e., one or a plurality of locations having the minimum thickness of the face portion 3602). In yet another example, the minimum thickness of the face portion 3602 may be in the second quadrant 3644, and the maximum thickness of the face portion 3602 may be in the first quadrant 3642, the third quadrant 3646, and/or the fourth quadrant 3648 (i.e., one or a plurality of locations having the maximum thickness of the face portion 3602). In the example where the second quadrant 3644 includes the maximum thickness of the face portion 3602, the thickness of the face portion 3602 may transition from the maximum thickness of the face portion 3602 in the second quadrant 3644 to the minimum thickness of the face portion 3602 according to a second thickness gradient. The second thickness gradient may vary (i.e., a plurality of second thickness gradients) depending on the location of the maximum thickness of the face portion 3602 in the second quadrant 3644 and one or more locations of the minimum thickness of the face portion 3602 in the first quadrant 3642, the second quadrant 3644, the third quadrant 3646, and/or the fourth quadrant 3648. The apparatus, methods, and articles of manufacture described herein are not limited in this regard.

In one example, the maximum thickness and the minimum thickness of the face portion 3602 may be in the third quadrant 3646. In another example, the maximum thickness of the face portion 3602 may be in the third quadrant 3646, and the minimum thickness of the face portion 3602 may be in the first quadrant 3642, the second quadrant 3644, and/or the fourth quadrant 3648 (i.e., one or a plurality of locations having the minimum thickness of the face portion 3602). In yet another example, the minimum thickness of the face portion 3602 may be in the third quadrant 3646, and the maximum thickness of the face portion 3602 may be in the first quadrant 3642, the second quadrant 3644, and/or the fourth quadrant 3648 (i.e., one or a plurality of locations having the maximum thickness of the face portion 3602). In the example where the third quadrant 3646 includes the maximum thickness of the face portion 3602, the thickness of the face portion 3602 may transition from the maximum thickness of the face portion 3602 in the third quadrant 3646 to the minimum thickness of the face portion 3602 according to a third thickness gradient. The third thickness gradient may vary (i.e., a plurality of third thickness gradients) depending on the location of the maximum thickness of the face portion 3602 in the third quadrant 3646 and one or more locations of the minimum thickness of the face portion 3602 in the first quadrant 3642, the second quadrant 3644, the third quadrant 3646, and/or the fourth quadrant 3648. The apparatus, methods, and articles of manufacture described herein are not limited in this regard.

In one example, the maximum thickness and the minimum thickness of the face portion 3602 may be in the fourth quadrant 3648. In another example, the maximum thickness of the face portion 3602 may be in the fourth quadrant 3648, and the minimum thickness of the face portion 3602 may be in the first quadrant 3642, the second quadrant 3644, and/or the third quadrant 3646 (i.e., one or a plurality of locations having the minimum thickness of the face portion 3602). In yet another example, the minimum thickness of the face portion 3602 may be in the fourth quadrant 3648, and the maximum thickness of the face portion 3602 may be in the first quadrant 3642, the second quadrant 3644, and/or the third quadrant 3646 (i.e., one or a plurality of locations having the maximum thickness of the face portion 3602). In the example where the fourth quadrant 3648 includes the maximum thickness of the face portion 3602, the thickness of the face portion 3602 may transition from the maximum thickness of the face portion 3602 in the fourth quadrant 3648 to the minimum thickness of the face portion 3602 according to a fourth thickness gradient. The fourth thickness gradient may vary (i.e., a plurality of fourth thickness gradients) depending on the location of the maximum thickness of the face portion 3602 in the fourth quadrant 3648 and one or more locations of the minimum thickness of the face portion 3602 in the first quadrant 3642, the second quadrant 3644, the third quadrant 3646, and/or the fourth quadrant 3648. The apparatus, methods, and articles of manufacture described herein are not limited in this regard.

In various examples, the first thickness gradient, the second thickness gradient, the third thickness gradient, and the fourth thickness gradient may be symmetric or asymmetric with respect to one another. In one example, two or more of the thickness gradients may have substantially the same gradient slope or rate of change between the maximum thickness and the minimum thickness of the face portion 3602, which may result in or correspond to a generally symmetric thickness transition about one or more axes or quadrants of the face portion 3602. In another example, one or more of the thickness gradients may have different gradient slopes or rates of change between the maximum thickness and the minimum thickness of the face portion 3602, which may result in or correspond to an asymmetric thickness transition across the face portion 3602. The gradient slope may also vary depending on the direction of movement from the maximum thickness toward the minimum thickness of the face portion 3602, such that a first directional path may exhibit a different slope or rate of change than a second directional path. In some examples, the gradient slope may vary continuously or stepwise as the direction of movement across the face portion 3602 changes. The symmetric or asymmetric nature of the thickness gradients may depend on the relative locations of the maximum thickness and the minimum thickness of the face portion 3602, the magnitude of the change in thickness between such locations, and the geometric configuration of the face portion 3602. The apparatus, methods, and articles of manufacture described herein are not limited in this regard.

In various examples, a maximum face thickness portion or a minimum face thickness portion located in one of the first quadrant 3642, the second quadrant 3644, the third quadrant 3646, and the fourth quadrant 3648 may be contiguous with a maximum face thickness portion or a minimum face thickness portion located in one or more of the other quadrants. For instance, in one example, a portion of a quadrant may be contiguous with a corresponding portion of an adjacent quadrant, such as between the first quadrant 3642 and the second quadrant 3644, between the second quadrant 3644 and the third quadrant 3646, between the third quadrant 3646 and the fourth quadrant 3648, or between the fourth quadrant 3648 and the first quadrant 3642. In another example, a portion of a quadrant may be contiguous with a corresponding portion of a non-adjacent quadrant, such as between the first quadrant 3642 and the third quadrant 3646, or between the second quadrant 3644 and the fourth quadrant 3648. In yet another example, a maximum face thickness portion or a minimum face thickness portion of one quadrant may be separate or non-contiguous from a maximum face thickness portion or a minimum face thickness portion of any or all of the other quadrants. In still other examples, two or more quadrants may include contiguous portions while other quadrants include separate portions, or all four quadrants may include contiguous portions, or all four quadrants may include separate portions. The apparatus, methods, and articles of manufacture described herein are not limited in this regard.

In one example, as illustrated in FIGS. 37-45, the back side 3606 of the face portion 3602 may include a perimeter portion 3702 and a recessed portion 3704. The perimeter portion 3702 may define a portion of the back side 3606 of the face portion 3602 that may be attached to a body portion of a golf club head. In one example, the thickness of the face portion 3602 at the perimeter portion 3702 may define the maximum thickness, and one or more portions of the recessed portion 3704 may define the minimum thickness of the face portion 3602. In another example, one or more portions of the recessed portion 3704 may define the maximum thickness of the face portion 3602, whereas other one or more portions of the recessed portion 3704 may define the minimum thickness of the face portion 3602. The perimeter portion 3702 may transition to the recessed portion 3704 by a transition portion 3703, which may be a ledge (linear or curved), groove, channel or any depth transition structure. While FIGS. 37-45 may depict the transition portion 3703 as an example to define a boundary between the perimeter portion 3702 and the recessed portion 3704, the face portion 3602 may or may not include the transition portion 3703 at or proximate to the perimeter portion 3702 or the recessed portion 3704. The apparatus, methods, and articles of manufacture described herein are not limited in this regard.

The perimeter portion 3702 may extend inward from the perimeter edge 3610 for a certain distance, which may be referred to herein as perimeter portion width 3716. In one example, as illustrated in FIGS. 37-45, the perimeter portion 3702 may have a perimeter portion width 3716 that may vary at different locations of the perimeter portion 3702. The perimeter portion width 3716 at or proximate to the face toe edge 3612 and at or proximate the face heel edge 3614 may be constant or substantially constant (i.e., a variation of less than or equal to 10%). The perimeter portion width 3716 may vary or be constant or substantially constant along a transition region of the perimeter portion 3702 between the face toe edge 3612 and the face top edge 3616, between the face toe edge 3612 and the face sole edge 3618, between the face heel edge 3614 and the face top edge 3616, and/or between the face heel edge 3614 and the face sole edge 3618. The apparatus, methods, and articles of manufacture described herein are not limited in this regard.

Figure 37:
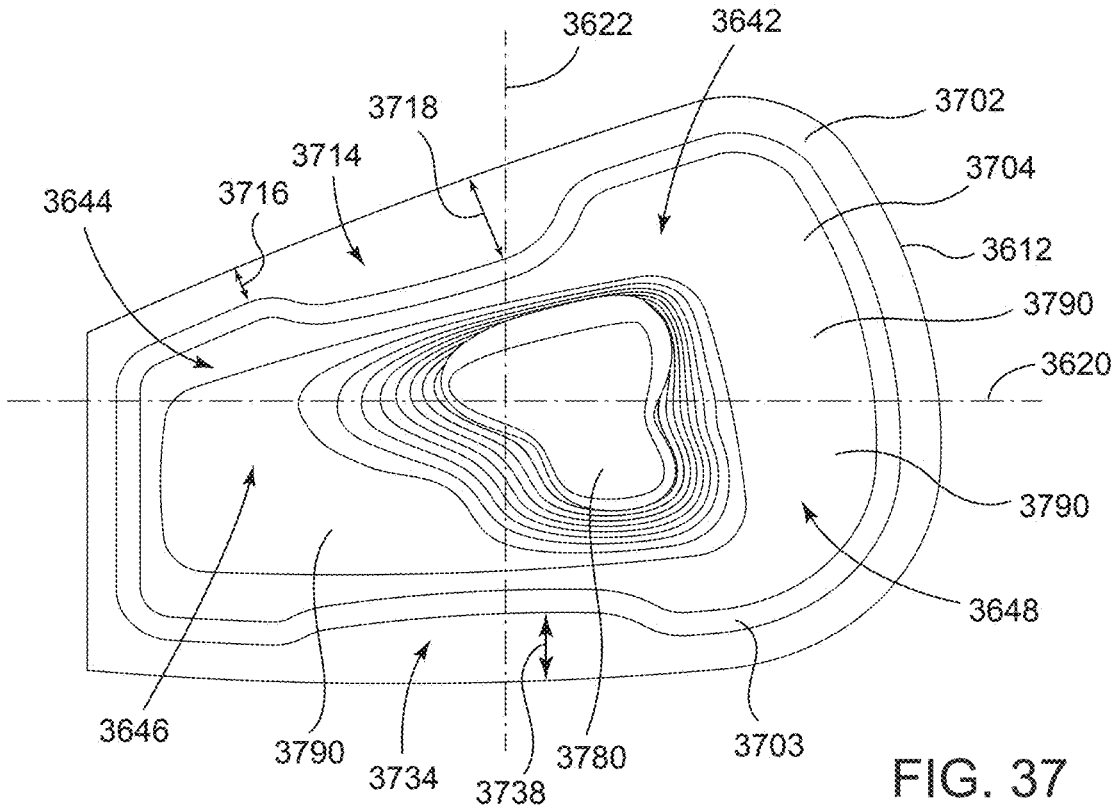

The perimeter portion 3702 may include an upper center perimeter portion 3714 with a perimeter portion width 3716 that may be greater than the adjacent portions of the perimeter portion 3702. The upper center perimeter portion 3714 may have a width profile such that the perimeter portion width 3716 increases from the perimeter portion width 3716 to a maximum upper perimeter portion width 3718 in a heel to toe direction and then decreases back to the perimeter portion width 3716, with the width increase at both end portions of the upper center perimeter portion 3714 being gradual or curved to reduce stress concentration at both end portions. The perimeter portion 3702 may include a lower center perimeter portion 3734 with a perimeter portion width 3716 that may be greater than the adjacent portions of the perimeter portion 3702. The lower center perimeter portion 3734 may have a width profile such that the perimeter portion width 3716 increases from the perimeter portion width 3716 to a maximum lower perimeter portion width 3738 in a heel to toe direction and then decreases back to the perimeter portion width 3716, with the width increase at both end portions of the lower center perimeter portion 3734 being gradual or curved to reduce stress concentration at both end portions. As illustrated in the example of FIG. 37, the upper center perimeter portion 3714 and the lower center perimeter portion 3734 may be generally centered on the face portion 3602. Accordingly, upper center perimeter portion 3714 and the lower center perimeter portion 3734, which may define relatively thicker portions of the face portion 3602 as described herein, may provide structural support for regions of the face portion 3602 that may experience high forces and deflections. Accordingly, upper center perimeter portion 3714 and the lower center perimeter portion 3734 allow portions of the recessed portion 3704 to be relatively thin to provide maximum deflection of the face portion 3602 at or surrounding the regions of the face portion 3602 that strike a golf ball. The apparatus, methods, and articles of manufacture described herein are not limited in this regard.

Referring to FIG. 37, the back side 3606 of the face portion 3602 may include thickness variations within the recessed portion 3704 for controlled stress distribution, maximizing deflection without compromising the structural integrity of the face portion 3602, and optimized energy transfer. The recessed portion 3704 may include one or more separate and/or contiguous maximum thickness portions 3780, which may define the maximum thickness of the face portion 3602 within the recessed portion 3704, and one or more separate and/or contiguous minimum thickness portions 3790, which may define the minimum thickness of the face portion 3602 within the recessed portion 3704. The apparatus, methods, and articles of manufacture described herein are not limited in this regard.

In one example, as illustrated in FIG. 37, the recessed portion 3704 may include a maximum thickness portion 3780 that may be contiguous and located in portions of the first quadrant 3642, the second quadrant 3644, the third quadrant 3646, and the fourth quadrant 3648. As illustrated in the example of FIG. 37, relatively large portions of the maximum thickness portion 3780 may be in the first quadrant 3642 and the fourth quadrant 3648, with the smallest portion of the maximum thickness portion 3780 being in the third quadrant 3646. Accordingly, a significant portion of the maximum thickness portion 3780 may be between the vertical plane 3622 and the face toe edge 3612. As illustrated in FIG. 37 by gradient lines, the thickness of the face portion 3602 may progressively or gradually decrease from the maximum thickness portion 3780 outward toward the perimeter edge 3610 to the minimum thickness portions 3790 of the recessed portion 3704. As illustrated in the example of FIG. 37, the thickness of the face portion 3602 may decrease from the maximum thickness portion 3780 to the minimum thickness portion 3790 rapidly in a direction toward the face top edge 3616, relatively less rapidly in a direction toward the face toe edge 3612 and the face sole edge 3618, and gradually in a direction toward the face heel edge 3614. The apparatus, methods, and articles of manufacture described herein are not limited in this regard.

The shape, size, and location of the maximum thickness portion 3780 of the golf club face, as well as the manner (i.e., size, shape, location, gradient slope, etc.) in which the thickness gradually or rapidly transitions in different directions to the minimum thickness portion 3790 may be determined by using numerical simulation data and/or experimental data with numerical analytical techniques such as finite element analysis (FEA) combined with post-analysis optimization methods. As illustrated in the example of FIG. 37, the shape of the maximum thickness portion 3780 as well as the manner in which the thickness gradually or rapidly transitions in different directions to the minimum thickness portion 3790 may be irregular or non-geometric, and the maximum thickness portion 3780 may be located off center. Numerical analyses in combination with optimization methods may allow for the strategic design of thickness variations on the back side 3606 of the face portion 3602 to maximize face deflection while minimizing stress, ensuring optimal energy transfer without compromising structural integrity. As illustrated in the example of FIG. 37, to enhance performance of a golf club, the recessed portion 3704 may have controlled thickness variations, with a larger portion of the maximum thickness portion 3780 strategically placed in the first quadrant 3642 and the fourth quadrant 3648, as well as the face thickness gradually or rapidly transitioning in different directions to the minimum thickness portion 3790. The thickness of the face portion 3602 gradually or rapidly transitioning from the maximum thickness portion 3780 to the minimum thickness portion 3790 depending on the direction may provide an optimized stress distribution. The apparatus, methods, and articles of manufacture described herein are not limited in this regard.

In one example, experimental data used for the analytical methods described herein may be obtained by striking different locations of a face portion 3602 (e.g., an experimental face portion) with a golf ball launched at various speeds and delivery conditions, thereby allowing observation and measurement of face deformation, localized strain behavior, vibrational response, and energy transfer under realistic impact conditions. High-speed digital image correlation, strain gauges, or laser displacement sensors may be employed to capture transient face deflection profiles, peak displacements, rebound characteristics, and the time-dependent rate of energy return. The resulting empirical dataset may be used both to validate analytical models and to provide boundary conditions for subsequent computational analyses. Additionally, simulation data may be obtained by mathematically modeling golf ball strikes through static, quasi-static, and dynamic loading schemes, where point forces, distributed loads, time-varying pressure functions, or explicit impact models are exerted on selected regions of a mathematically modeled golf club head and face portion 3602. In one example, a finite element analysis (FEA) model of the club head may incorporate nonlinear material properties, strain-rate-dependent behavior, and contact algorithms between the ball and the face. The FEA model may be iteratively solved to determine deflection patterns, peak stress locations, modal responses, and energy-absorption characteristics during the impact event. Mesh refinement studies may be used to ensure accuracy in regions of high curvature or thin-wall geometry, including the perimeter region, the face center, and any transitions between the face portion 3602 and adjacent structural components. In certain embodiments, the experimentally validated FEA model may be incorporated into an optimization framework that varies structural and geometric parameters of the face portion 3602 such as local thicknesses, face curvature, rib configurations, backwall offsets, or polymer placement to achieve target performance metrics. These target metrics may include, for example, maximizing coefficient of restitution (COR), increasing overall ball speed, reducing stress concentrations to improve durability, or shifting vibrational modes outside of audible or feel-sensitive ranges. Optimization algorithms, such as gradient-based solvers, genetic algorithms, or multi-objective design techniques, may automatically adjust the modeled geometry and material layout to converge on a configuration that balances deflection, stiffness, and structural integrity. In some cases, the optimization routine may include manufacturing constraints, allowable tolerances, or weight-distribution requirements to ensure that the resulting geometry is practical for production. These combined numerical and experimental approaches may enable precise refinement and performance tuning of the face portion 3602, allowing identification of optimal thickness distributions, reinforcement features, and material combinations that enhance ball speed, energy efficiency, forgiveness, and long-term durability while maintaining overall structural integrity of the golf club head. The apparatus, methods, and articles of manufacture described herein are not limited in this regard.

As described herein, the maximum thickness portion 3780, as well as the way the thickness gradually or rapidly transitions in different directions to the minimum thickness portion 3790 of the golf club face may optimize stress distribution and deflection. Additionally, the maximum thickness portion 3780, and more specifically, the size, shape, and location of the maximum thickness portion 3780 may also serve additional functional benefits related to vibration damping and energy transfer. The maximum thickness portion 3780 may function as a mass damper, which may help to reduce excessive vibrations upon impact, and which may improve the feel of a golf ball strike. By strategically positioning the maximum thickness portion 3780, as well as the manner in which the thickness gradually or rapidly transitions in different directions to the minimum thickness portion 3790 in specific regions, unwanted oscillations may be mitigated, which may lead to a more stable and controlled energy transfer to the golf ball. Additionally, the momentum of the maximum thickness portion 3780 may also assist in the rebound effect of the face portion 3602, which may contribute to an increase in ball speed. Upon impact, the stored energy in the face portion 3602, combined with the inertia of the maximum thickness portion 3780, may facilitate a more powerful restoration of the face portion 3602 to its original position. This effect may enhance the coefficient of restitution (COR), meaning that a greater portion of the impact energy is transferred back to the ball, ultimately increasing its launch velocity. By balancing these effects through numerical analysis and experimental validation as described herein, the thickness distribution of the face portion 3602 may be fine-tuned to achieve an optimal combination of vibration control and energy return, ensuring improved overall performance, feel, and consistency in golf shots. The apparatus, methods, and articles of manufacture described herein are not limited in this regard.

Additionally, the optimal design of the face thickness distribution may also depend on other factors, including the loft angle of the face portion 3602, the type of golf club head, and the material of construction of the face portion 3602. The loft angle may directly influence the impact dynamics and energy transfer characteristics, affecting how the face portion 3602 flexes and rebounds upon ball contact. Different types of golf club heads, such as drivers, irons, or wedges, have varying performance goals and design constraints that necessitate tailored thickness profiles. Furthermore, the material composition of the face portion 3602, whether titanium, stainless steel, composite materials or other metal or non-metal materials, may dictate mechanical properties such as elasticity, strength, and fatigue resistance, all of which may play a role in optimizing face deflection and durability. The apparatus, methods, and articles of manufacture described herein are not limited in this regard.

In one example, the maximum thickness of the face portion 3602 may be greater than or equal to 0.050 inch (1.270 mm) and less than or equal to 0.100 inch (2.540 mm). In another example, the maximum thickness of the face portion 3602 may be greater than or equal to 0.060 inch (1.524 mm) and less than or equal to 0.075 inch (1.905 mm). In another example, the maximum thickness of the face portion 3602 may be greater than or equal to 0.070 inch (1.778 mm) and less than or equal to 0.080 inch (2.032 mm). In another example, the maximum thickness of the face portion 3602 may be greater than or equal to 0.065 inch (1.651 mm) and less than or equal to 0.090 inch (2.286 mm). In yet another example the maximum thickness of the face portion 3602 may be greater than or equal to 0.055 inch (1.397 mm) and less than or equal to 0.070 inch (1.778 mm). The apparatus, methods, and articles of manufacture described herein are not limited in this regard.

In one example, the minimum thickness of the face portion 3602 may be greater than or equal to 0.020 inch (0.508 mm) and less than or equal to 0.050 inch (1.270 mm). In another example, the minimum thickness of the face portion 3602 may be greater than or equal to 0.025 inch (0.635 mm) and less than or equal to 0.045 inch (1.143 mm). In another example, the minimum thickness of the face portion 3602 may be greater than or equal to 0.035 inch (0.889 mm) and less than or equal to 0.049 inch (1.245 mm). In another example, the minimum thickness of the face portion 3602 may be greater than or equal to 0.040 inch (1.016 mm) and less than or equal to 0.070 inch (1.778 mm). In yet another example, the minimum thickness of the face portion 3602 may be greater than or equal to 0.030 inch (0.762 mm) and less than or equal to 0.055 inch (1.397 mm). The apparatus, methods, and articles of manufacture described herein are not limited in this regard.

Figure 36:
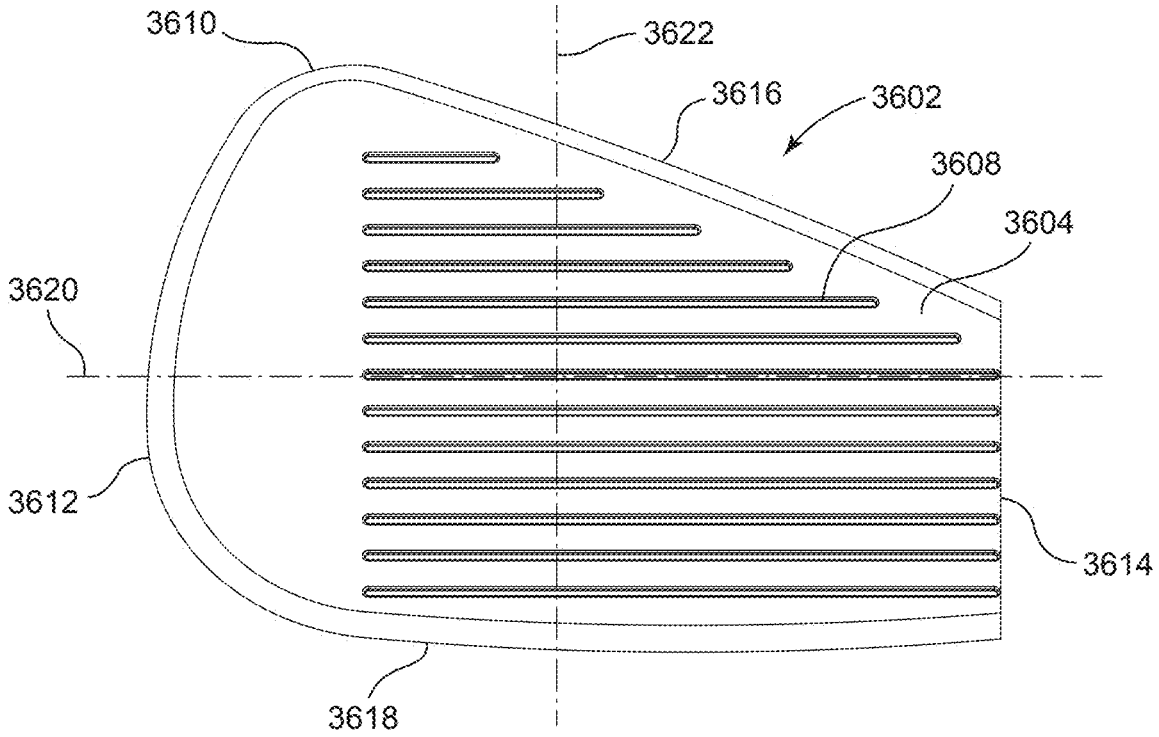
FIGS. 36-45 illustrate examples of various face portions for a golf club head according to any embodiment of the apparatus, methods, and articles of manufacture described herein.
Figure 38:
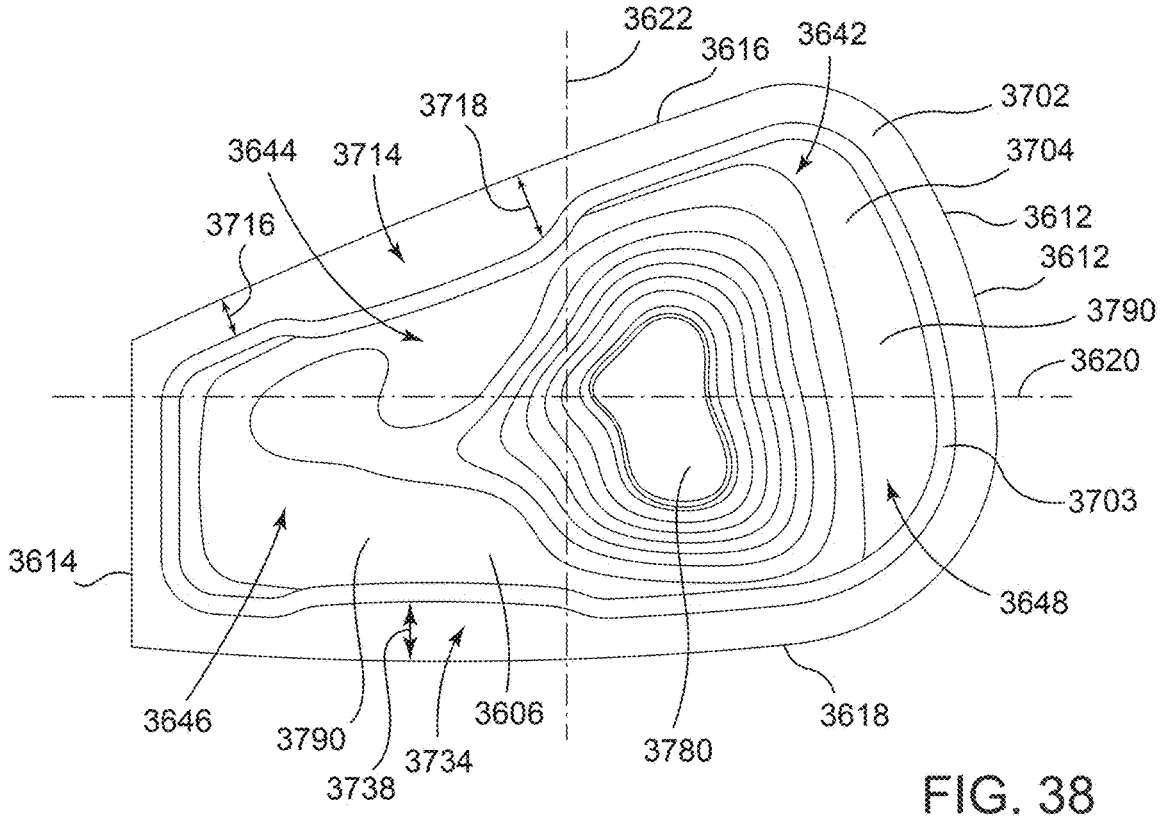
Figure 39:
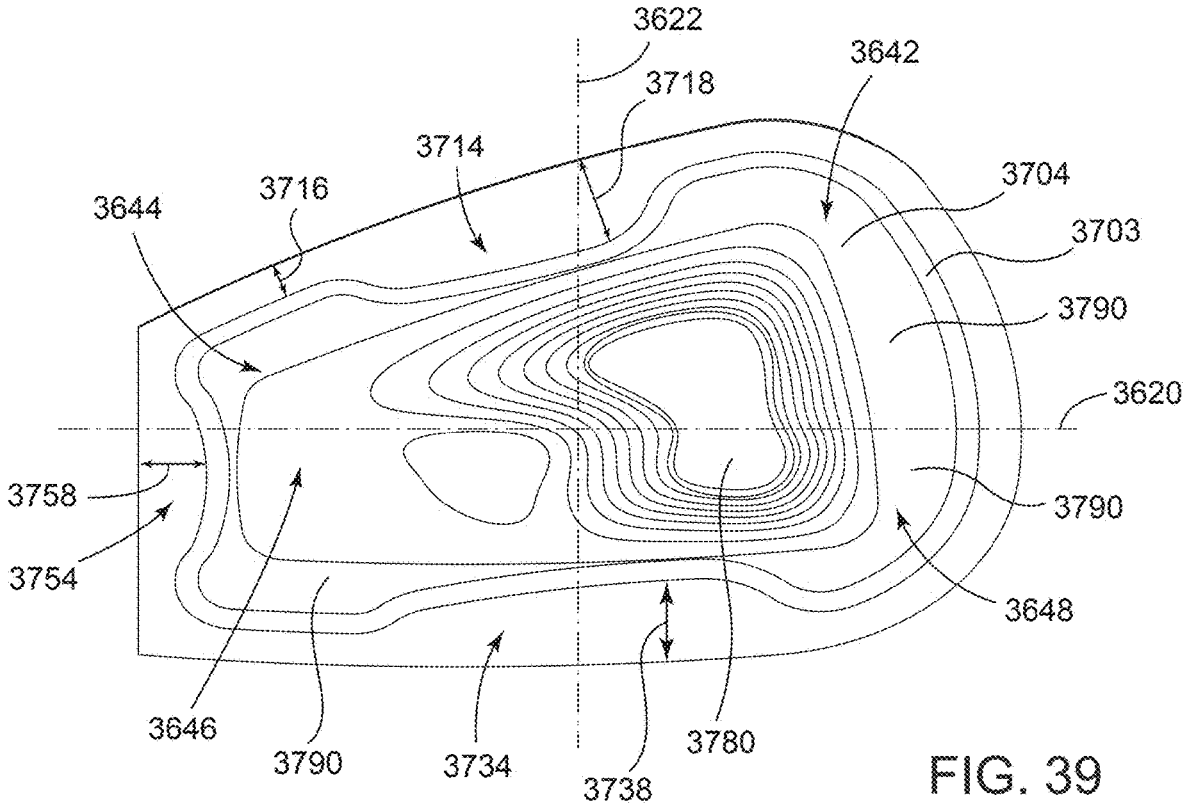

The thickness distribution of the face portion 3602 or the shape, size, location, and/or other features of the one or more maximum thickness portions 3780 may depend on the type of golf club head (e.g., 4-iron, 7-iron, 9-iron). FIGS. 36 and 37 illustrate for example the face portion 3602 of a 7-iron golf club head. In the example of FIG. 38, a face portion 3602 for a 4-iron golf club is shown, which may have a loft angle that is less than the loft angle of the face portion 3602 of FIGS. 36 and 37. In the example of FIG. 39, a face portion 3602 for a pitching wedge (PW) golf club is shown, which may have a loft angle that is greater than the loft angle of the face portion 3602 of FIGS. 36 and 37. A 7-iron golf club may have for example a typical loft angle range of 30-35 degrees, a 4-iron golf club may have for example a typical loft angle range of 19-25 degrees, and a PW golf club may have for example a typical loft angle range of 44-50 degrees. The apparatus, methods, and articles of manufacture described herein are not limited in this regard.

The 7-iron (i.e., the face portion 3602 of FIGS. 36 and 37), which may typically have a moderate loft angle between 30-35 degrees, may feature a balanced face thickness distribution across the face portion 3602. The maximum face thickness may be positioned more towards the face toe edge 3612 with a top-side bias, and the face thickness reduction may follow a smooth and shallow gradient toward the face heel edge 3614 to provide consistent energy transfer upon impact and maintain both distance and control. The thickness of the face portion 3602 reduces progressively in the second quadrant 3644 and the third quadrant 3646 to allow for a controlled degree of flexibility that may enhance ball flight consistency. Accordingly, the face portion 3602 of the example of FIGS. 36 and 37, which may represent a 7-iron golf club head, may provide an optimal blend of distance and accuracy without compromising forgiveness. The apparatus, methods, and articles of manufacture described herein are not limited in this regard.

In the example of FIG. 38, the recessed portion 3704 may include a maximum thickness portion 3780 that may be contiguous and located in portions of the first quadrant 3642 and the fourth quadrant 3648. As illustrated in the example of FIG. 38, relatively large portions of the maximum thickness portion 3780 may be in the first quadrant 3642 and the fourth quadrant 3648, with the portion of the maximum thickness portion 3780 in the fourth quadrant 3648 being greater than the portion of the maximum thickness portion 3780 in the first quadrant 3642. Accordingly, all of the maximum thickness portion 3780 may be between the vertical plane 3622 and the face toe edge 3612. As illustrated in FIG. 38 by gradient lines, the thickness of the face portion 3602 may progressively or gradually decrease from the maximum thickness portion 3780 outward toward the perimeter edge 3610 to the minimum thickness portions 3790 of the recessed portion 3704 at the same or substantially the same gradient slopes (i.e., steepness of the gradient). In one example, a portion of the gradient slope of the transition from the maximum thickness portion 3780 to the minimum thickness portion 3790 may be more gradual in a direction toward the face heel edge 3614 to provide structural support for the portion of the face portion 3602 that may typically experience the highest number of golf ball strikes for individuals of different skill levels (e.g., at or around the sweet spot of the face portion 3602). The apparatus, methods, and articles of manufacture described herein are not limited in this regard.

The 4-iron (i.e., the face portion 3602 of FIG. 38), which typically may have a loft angle of 19-25 degrees, may have a certain face thickness distribution to provide for long-distance shots. Comparing the face portion 3602 of the 4-iron of the example illustrated in FIG. 38 to the face portion 3602 of the 7-iron of the example illustrated in FIGS. 36 and 37, the 4-iron's thickness may be more evenly distributed but still with a toe-side bias, with a more uniform reduction across all quadrants as illustrated by gradient lines of FIG. 38. The second quadrant 3644 and the third quadrant 3646 may be less reinforced (i.e., face thickness relative to the face portion 3602 of FIGS. 36 and 37) to provide more flexibility and ball speed generation. Accordingly, the face portion 3602 of FIG. 38 may provide a relatively enhanced energy transfer efficiency, which may maximize distance while maintaining a lower launch angle and improving forgiveness to provide acceptable or reasonable ball distances for mishits. The apparatus, methods, and articles of manufacture described herein are not limited in this regard.

In the example of FIG. 39, the recessed portion 3704 may include a maximum thickness portion 3780 that may be contiguous and located in portions of the first quadrant 3642 and the fourth quadrant 3648. As illustrated in the example of FIG. 39, relatively large portions of the maximum thickness portion 3780 may be in the first quadrant 3642 and the fourth quadrant 3648, with the portion of the maximum thickness portion 3780 in the first quadrant 3642 being greater than the portion of the maximum thickness portion 3780 in the fourth quadrant 3648. Accordingly, all of the maximum thickness portion 3780 may be between the vertical plane 3622 and the face toe edge 3612. As illustrated in FIG. 39 by gradient lines, the thickness of the face portion 3602 may progressively or gradually decrease from the maximum thickness portion 3780 outward toward the perimeter edge 3610 to the minimum thickness portions 3790 of the recessed portion 3704 at the same or substantially the same gradient slopes (i.e., steepness of the gradient). In one example, a portion of the gradient slope of the transition from the maximum thickness portion 3780 to the minimum thickness portion 3790 may be more gradual in a direction toward the face heel edge 3614 and above the horizontal midplane 3620 to provide structural support for the portion of the face portion 3602 that may typically experience the highest number of golf ball strikes for individuals of different skill levels (e.g., at or around the sweet spot of the face portion 3602). The apparatus, methods, and articles of manufacture described herein are not limited in this regard.

The face portion 3602 example illustrated in FIG. 39 (i.e., the pitching wedge (PW)), which has the highest loft angle (44-50 degrees) relative to the face portions 3602 of FIGS. 36-38, may have a more concentrated thickness distribution that may prioritize precision over distance. As illustrated in the example of FIG. 39, a large portion of the maximum thickness portion 3780 may be in the first quadrant 3642, and hence a toe-side and top-side bias. The first quadrant 3642 may be relatively structurally reinforced by the maximum thickness portion 3780, which may help maintain stability and spin control, whereas the face thickness in the second quadrant 3644 and the third quadrant 3646 may facilitate higher launch angles. Accordingly, with the face thickness profile illustrated in FIG. 39, the example face portion 3602 of the pitching wedge may generate the high spin and loft necessary for short approach shots, where precision and stopping power takes precedence over raw distance, while also enhancing feel and feedback to provide an individual with the ability to execute delicate, controlled shots with confidence. The apparatus, methods, and articles of manufacture described herein are not limited in this regard.

In one example, as illustrated in FIG. 39, the perimeter portion 3702 may include a center-heel perimeter portion 3754. The center-heel perimeter portion 3754 may have a width profile such that the perimeter portion width 3716 increases from the perimeter portion width 3716 in a top to sole direction to a maximum heel perimeter portion width 3758 and then decreases back to the perimeter portion width 3716 with the width increase at both end portions being gradual or curved to reduce stress concentration at both end portions. The center-heel perimeter portion 3754 may provide structural support for regions of the face portion 3602 in the second quadrant 3644 and third quadrant 3646, which have large portions of the minimum thickness portion 3790. The apparatus, methods, and articles of manufacture described herein are not limited in this regard.

The thickness distributions of the example face portion 3602 of FIGS. 36-39 (i.e., the 7-iron, 4-iron, and pitching wedge) as described herein may be determined by the analytical methods based on the functional requirements of each club and as also described herein based on real, experimental, and/or numerical simulation data. The 4-iron, being a long-distance club, may have a relatively thinner, more flexible face, which may maximize ball speed and forgiveness. The 7-iron, which is a mid-range golf club, may feature a balanced face thickness distribution, which may provide a blend of control and power. The pitching wedge may have more concentrated thickness profile, which may reinforce stability and precision, making it ideal for high-spin and controlled shots. The apparatus, methods, and articles of manufacture described herein are not limited in this regard.

As illustrated in the examples of FIGS. 36-39 and described herein, the maximum thickness of the face portion 3602 may be generally positioned within the first quadrant 3642 and the fourth quadrant 3648 with the shape, size, location, and thickness distribution and gradient varying depending on the several factors such as the loft angle as described herein. During impact of a golf ball with the face portion 3602, the maximum thickness portion 3780 in the first quadrant 3642 and the fourth quadrant 3648 may stabilize the face portion 3602 by controlling torsional forces and unwanted vibrations, particularly on off-center hits. Additionally, because of the second quadrant 3644 and third quadrant 3646 having additional structural support from the hosel and the shaft connection, the first quadrant 3642 and fourth quadrant 3648 may require additional thickness to maintain structural integrity and optimize performance. The apparatus, methods, and articles of manufacture described herein are not limited in this regard.

As also illustrated in the example of FIGS. 36-41 and described herein, the thickness distribution in the recessed portion 3704 may be based on a controlled gradient, with the highest thickness generally concentrated in the first quadrant 3642 and the fourth quadrant 3648, gradually tapering off toward the perimeter edge 3610. The slope of the thickness gradient may be determined by the methods described herein to facilitate progressive energy dissipation, allowing for optimal face flex and efficient rebound characteristics upon ball impact. The strategic variation in thickness distribution and slope of the thickness gradient, which may be determined as described herein, may provide each club with optimal intended function optimally, whether that be maximizing distance and forgiveness in long irons or control and spin in wedges. The apparatus, methods, and articles of manufacture described herein are not limited in this regard.

Figure 40:
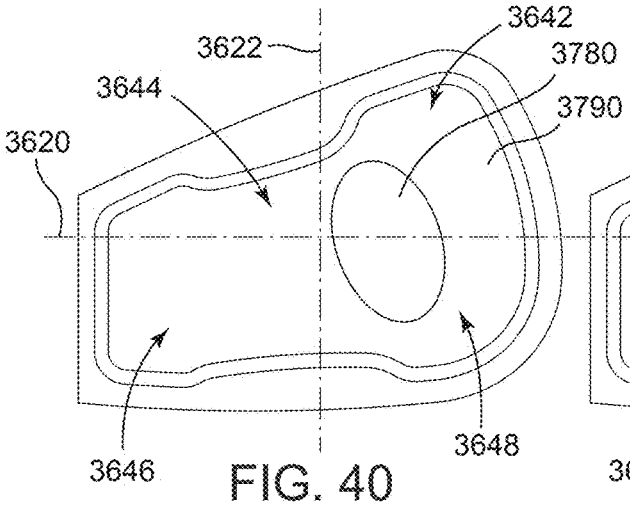
Figure 41:
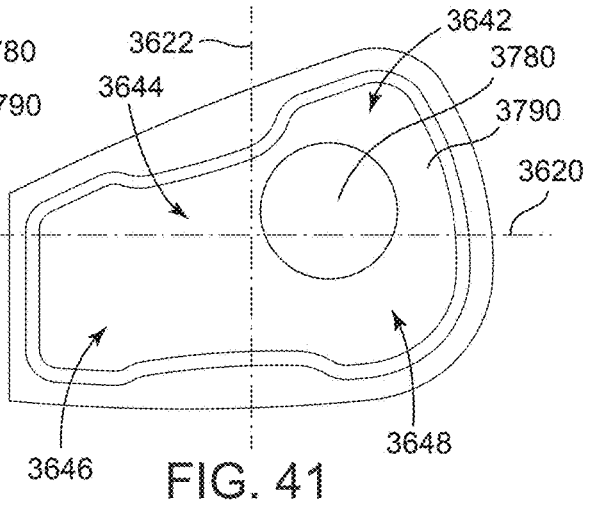
Figure 42:
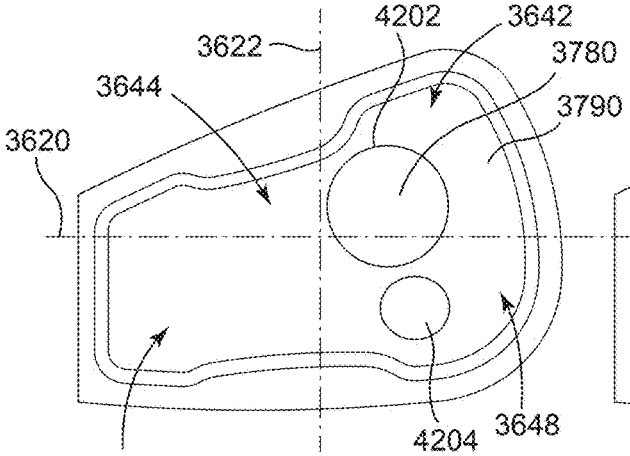
Figure 43:
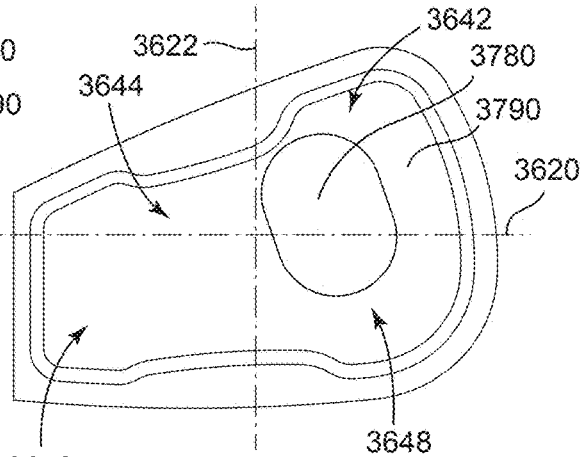
Figure 44:
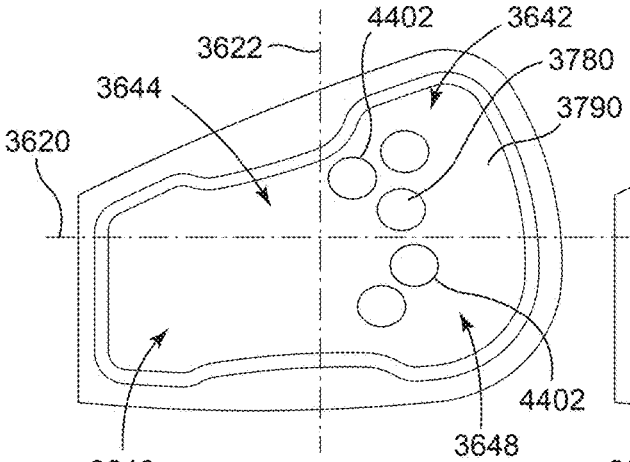
Figure 45:
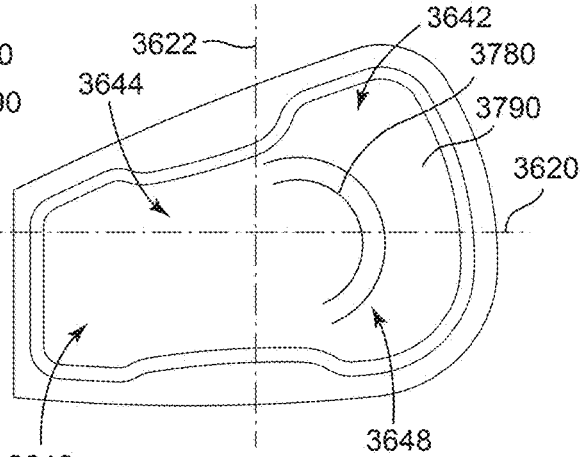

FIGS. 40-45 illustrate examples of face portions 3602 having various thickness profiles according to the apparatus, methods, and articles of manufacture described herein. In the example of FIG. 40, the maximum thickness portion 3780 may be elliptical and located in the first quadrant 3642 and the fourth quadrant 3648. The maximum thickness portion 3780 may then transition to the minimum thickness portions 3790 in all outward directions according to certain thickness gradient slopes to optimize performance of the golf club head as described herein. In the example of FIG. 41, the maximum thickness portion 3780 may be circular and located in the first quadrant 3642 and the fourth quadrant 3648 with a large portion of the maximum thickness portion 3780 being in the first quadrant 3642. The maximum thickness portion 3780 may then transition to the minimum thickness portion 3790 in all outward directions according to certain thickness gradient slopes to optimize performance of the golf club head as described herein. In the example of FIG. 42, the maximum thickness portion 3780 may include a first circular portion 4202 in the first quadrant 3642 and a second circular portion 4204 in the fourth quadrant 3648 with the first circular portion 4202 being larger than the second circular portion 4204. The thickness of the face portion 3602 outside the first circular portion 4202 and the second circular portion 4204 may then transition to the minimum thickness portion 3790 in all outward directions according to certain thickness gradient slopes to optimize performance of the golf club head as described herein. The thickness of the face portion 3602 between the first circular portion 4202 and the second circular portion 4204 may transition to a thickness that may be less than the maximum thickness portion 3780 and/or greater than the minimum thickness portion 3790. The sizes of the first circular portion 4202 and the second circular portion 4204 may be the same or vary as shown in FIG. 42 with one circular portion being smaller or larger than the other. In the example of FIG. 43, the maximum thickness portion 3780 may be stadium shaped (i.e., rectangular with curved or semicircular ends) and located in the first quadrant 3642 and the fourth quadrant 3648 with a large portion of the maximum thickness portion 3780 being in the first quadrant 3642. The maximum thickness portion 3780 may then transition to the minimum thickness portion 3790 in all outward directions according to certain thickness gradient slopes to optimize performance of the golf club head as described herein. In the example of FIG. 44, the maximum thickness portion 3780 may include a plurality of alike or different sized circular portions 4402 that may be located in the first quadrant 3642 and the fourth quadrant 3648, with a greater number of the circular portions 4402 being in the first quadrant 3642. The thickness of the face portion 3602 outside the circular portions 4402 may then transition to the minimum thickness portion 3790 in all outward directions according to certain thickness gradient slopes to optimize performance of the golf club head as described herein. The thickness of the face portion 3602 outside each of the circular portions 4402 and between adjacent circular portions 4402 may transition to a thickness that may be less than the maximum thickness portion 3780 and/or greater than the minimum thickness portion 3790. In the example of FIG. 45, the maximum thickness portion 3780 may be semi-circular and located in the first quadrant 3642 and the fourth quadrant 3648. The maximum thickness portion 3780 may then transition to the minimum thickness portion 3790 in all outward directions according to certain thickness gradient slopes to optimize performance of the golf club head as described herein. According to the examples illustrated in FIGS. 40-45, one or more separate and/or contiguous maximum thickness portions 3780 may have any shape, size, and/or location in the first quadrant

3642, the second quadrant 3644, the third quadrant 3646, and/or the fourth quadrant 3648 to optimize performance of the face portion 3602 as described herein. The apparatus, methods, and articles of manufacture described herein are not limited in this regard.

In one example, as described herein, the face thickness at the perimeter portion 3702 and the maximum thickness portion 3780 may be the same or substantially the same. In another example, the face thickness at the perimeter portion 3702 may be greater than the face thickness at the maximum thickness portion 3780. In yet another example, the face thickness at the perimeter portion 3702 may be less than the face thickness at the maximum thickness portion 3780. The apparatus, methods, and articles of manufacture described herein are not limited in this regard.

Any of the mass portions described herein may be constructed from a material having a greater density than one or more materials of a body portion of a golf club head. In one example, any of the mass portions described herein may be constructed from tungsten or tungsten-based materials, whereas the body portion may be constructed from one or more materials having a lower density than tungsten or tungsten-based materials such as aluminum, steel, titanium, and/or composite materials. Any of the mass portions described herein may be similar in some physical properties but different in other physical properties. For example, a mass portion may be made from an aluminum-based material or an aluminum alloy whereas another mass portion may be made from a tungsten-based material or a tungsten alloy. In another example, a mass portion may be made from a polymer material whereas another mass portion may be made from a steel-based material. Any of the mass portions described herein may be constructed from a material having a lower density than one or more materials of a body portion of a golf club head. The apparatus, methods, and articles of manufacture described herein are not limited in this regard.

Any of the golf club heads described herein may be an iron-type golf club head (e.g., a 1-iron, a 2-iron, a 3-iron, a 4-iron, a 5-iron, a 6-iron, a 7-iron, an 8-iron, a 9-iron, etc.), or a wedge-type golf club head (e.g., a pitching wedge, a lob wedge, a sand wedge, an n-degree wedge such as 44 degrees (°), 48°, 52°, 56°, 60°, etc.). Although a particular type of club head may be depicted and described, the apparatus, methods, and articles of manufacture described herein may be applicable to other types of club heads (e.g., a driver-type club head, a fairway wood-type club head, a hybrid-type club head, a putter-type club head, etc.). The apparatus, methods, and articles of manufacture described herein are not limited in this regard.

The body portion and/or the face portion of any of the golf club heads described herein may be partially or entirely made of a steel-based material (e.g., 17-4 PH stainless steel, Nitronic® 50 stainless steel, alloy steel 8620, maraging steel or other types of stainless steel), a titanium-based material, an aluminum-based material (e.g., a high-strength aluminum alloy or a composite aluminum alloy coated with a high-strength alloy), any combination thereof, non-metallic materials, composite materials, and/or other suitable types of materials. The body portion and/or the face portion may be constructed with materials that are similar to any of the body portions and/or face portions described herein or in any of the incorporated by reference patent documents. The apparatus, methods, and articles of manufacture described herein are not limited in this regard.

In one example, the area of the front surface of the face portion of any of the golf club heads described herein may be greater than or equal to 330 $mm^2$ and less than or equal to 5000 $mm^2$. In another example, the area of the front surface of the face portion of any of the golf club heads described herein may be greater than or equal to 1000 $mm^2$ and less than or equal to 5300 $mm^2$. In yet another example, the area of the front surface of the face portion of any of the golf club heads described herein may be greater than or equal to 1500 $mm^2$ and less than or equal to 4800 $mm^2$. While the above examples may describe particular areas, the area of the front surface may greater than or less than those numbers. The apparatus, methods, and articles of manufacture described herein are not limited in this regard.

In one example, a filler material as described herein may include an elastic polymer or an elastomer material, a thermoplastic elastomer material (TPE), a thermoplastic polyurethane material (TPU), other polymer material(s), bonding material(s) (e.g., adhesive), and/or other suitable types of materials that may absorb shock, isolate vibration, and/or dampen noise. In another example, a filler material may be one or more thermoset polymers having bonding properties. In another example, a filler material may include low-viscosity, organic, solvent-based solutions and/or dispersions of polymers and other reactive chemicals. In another example, a filler material may be a polymer material such as an ethylene copolymer material that may absorb shock, isolate vibration, and/or dampen noise when a golf club head strikes a golf ball via the face portion. In another example, a filler material may be a high density ethylene copolymer ionomer, a fatty acid modified ethylene copolymer ionomer, a highly amorphous ethylene copolymer ionomer, an ionomer of ethylene acid acrylate terpolymer, an ethylene copolymer comprising a magnesium ionomer, an injection moldable ethylene copolymer that may be used in conventional injection molding equipment to create various shapes, an ethylene copolymer that can be used in conventional extrusion equipment to create various shapes, an ethylene copolymer having high compression and low resilience similar to thermoset polybutadiene rubbers, and/or a blend of highly neutralized polymer compositions, highly neutralized acid polymers or highly neutralized acid polymer compositions, and fillers. In another example, any one or more of the filler materials described herein may be formed from one or more metals or metal alloys, such as aluminum, copper, zinc, and/or titanium. A filler material not specifically described in detail herein may include one or more similar or different types of materials described herein and in any of the incorporated by reference patent documents. The apparatus, methods, and articles of manufacture described herein are not limited in this regard.

Any of the filler materials described herein may be subjected to different processes during manufacturing of any of the golf club heads described herein. Such processes may include one or more filler materials being heated and/or cooled by conduction, convection, and/or radiation during one or more injection molding processes or post injection molding curing processes. For example, all the heating and cooling processes may be performed by using heating or cooling systems that employ conveyor belts that move a golf club head described herein through a heating or cooling environment for a period of time as described herein. The processes of manufacturing a golf club head with one or more filler materials may be similar to any of the processes described in any of the incorporated by reference patent documents. The apparatus, methods, and articles of manufacture described herein are not limited in this regard.

While each of the above examples may describe a certain type of golf club head, the apparatus, methods, and articles of manufacture described herein may be applicable to other types of golf club heads (e.g., a driver-type golf club head, a fairway wood-type golf club head, a hybrid-type golf club head, an iron-type golf club head, a putter-type golf club head, etc.).

Procedures defined by golf standard organizations and/or governing bodies such as the United States Golf Association (USGA) and/or the Royal and Ancient Golf Club of St. Andrews (R&A) may be used for measuring the club head volume of any of the golf club heads described herein. For example, a club head volume may be determined by using the weighted water displacement method (i.e., Archimedes Principle). Although the figures may depict particular types of club heads (e.g., a driver-type club head or iron-type golf club head), the apparatus, methods, and articles of manufacture described herein may be applicable to other types of club head (e.g., a fairway wood-type club head, a hybrid-type club head, a putter-type club head, etc.). Accordingly, any golf club head as described herein may have a volume that is within a volume range corresponding to certain type of golf club head as defined by golf governing bodies. A driver-type golf club head may have a club head volume of greater than or equal to 300 cubic centimeters ($cm^3$ or cc). In another example, a driver-type golf club head may have a club head volume of 460 cc. A fairway wood golf club head may have a club head volume of between 100 cc and 300 cc. In one example, a fairway wood golf club head may have a club head volume of 180 cc. An iron-type golf club head may have a club head volume of between 25 cc and 100 cc. In one example, an iron-type golf club head may have a volume of 50 cc. Any of the golf clubs described herein may have the physical characteristics of a certain type of golf club (i.e., driver, fairway wood, iron, etc.), but have a volume that may fall outside of the above-described ranges. The apparatus, methods, and articles of manufacture described herein are not limited in this regard.

Any of the golf club heads and/or golf clubs described herein may include one or more sensors (e.g., accelerometers, strain gauges, etc.) for sensing linear motion (e.g., acceleration) and/or forces in all three axes of motion and/or rotational motion (e.g., angular acceleration) and rotational forces about all three axes of motion. In one example, the one or more sensors may be internal sensors that may be located inside the golf club head, the hosel, the shaft, and/or the grip. In another example, the one or more sensors may be external sensors that may be located on the grip, on the shaft, on the hosel, and/or on the golf club head. In yet another example, the one or more sensors may be external sensors that may be attached by an individual to the grip, to the shaft, to the hosel, and/or to the golf club head. In one example, data collected from the sensors may be used to determine any one or more design parameters for any of the golf club heads and/or golf clubs described herein to provide certain performance or optimum performance characteristics. In another example, data from the sensors may be collected during play to assess the performance of an individual. The apparatus, methods, and articles of manufacture described herein are not limited in this regard.

Any of the apparatus, methods, or articles of manufacture described herein may include one or more visual identifiers such as alphanumeric characters, colors, images, symbols, logos, and/or geometric shapes. For example, one or more visual identifiers may be manufactured with one or more portions of a golf club such as the golf club head (e.g., casted or molded with the golf club head), painted on the golf club head, etched on the golf club (e.g., laser etching), embossed on the golf club head, machined onto the golf club head, attached as a separate badge or a sticker on the golf club head (e.g., adhesive, welding, brazing, mechanical lock(s), any combination thereof, etc.), or any combination thereof. The visual identifier may be made from the same material as the golf club head or a different material than the golf club head (e.g., a plastic badge attached to the golf club head with an adhesive). Further, the visual identifier may be associated with manufacturing and/or brand information of the golf club head, the type of golf club head, one or more physical characteristics of the golf club head, or any combination thereof. In particular, a visual identifier may include a brand identifier associated with a manufacturer of the golf club (e.g., trademark, trade name, logo, etc.) or other information regarding the manufacturer. In addition, or alternatively, the visual identifier may include a location (e.g., country of origin), a date of manufacture of the golf club or golf club head, or both.

The visual identifier may include a serial number of the golf club or golf club head, which may be used to check the authenticity to determine whether or not the golf club or golf club head is a counterfeit product. The serial number may also include other information about the golf club that may be encoded with alphanumeric characters (e.g., country of origin, date of manufacture of the golf club, or both). In another example, the visual identifier may include the category or type of the golf club head (e.g., 5-iron, 7-iron, pitching wedge, etc.). In yet another example, the visual identifier may indicate one or more physical characteristics of the golf club head, such as one or more materials of manufacture (e.g., visual identifier of "Titanium" indicating the use of titanium in the golf club head), loft angle, face portion characteristics, mass portion characteristics (e.g., visual identifier of "Tungsten" indicating the use of tungsten mass portions in the golf club head), interior cavity and filler material characteristics (e.g., one or more abbreviations, phrases, or words indicating that the interior cavity is filled with a polymer material), any other information that may visually indicate any physical or play characteristic of the golf club head, or any combination thereof. Further, one or more visual identifiers may provide an ornamental design or contribute to the appearance of the golf club, or the golf club head.

Any of the golf club heads described herein may be manufactured by casting from metal such as steel. However, other techniques for manufacturing a golf club head as described herein may be used such as 3D printing or molding a golf club head from metal or non-metal materials such as ceramics.

All methods described herein may be performed in any suitable order unless otherwise indicated herein or otherwise clearly contradicted by context. Although a particular order of actions may be described herein with respect to one or more processes, these actions may be performed in other temporal sequences. Further, two or more actions in any of the processes described herein may be performed sequentially, concurrently, or simultaneously.

The terms "and" and "or" may have both conjunctive and disjunctive meanings. The terms "a" and "an" are defined as one or more unless this disclosure indicates otherwise. The term "coupled," and any variation thereof, refers to directly or indirectly connecting two or more elements chemically, mechanically, and/or otherwise. The phrase "removably connected" is defined such that two elements that are "removably connected" may be separated from each other without breaking or destroying the utility of either element.

The term "substantially" when used to describe a characteristic, parameter, property, or value of an element may represent deviations or variations that do not diminish the characteristic, parameter, property, or value that the element may be intended to provide. Deviations or variations in a characteristic, parameter, property, or value of an element may be based on, for example, tolerances, measurement errors, measurement accuracy limitations and other factors. The term "proximate" is synonymous with terms such as "adjacent," "close," "immediate," "nearby," "neighboring," etc., and such terms may be used interchangeably as appearing in this disclosure.

Recitation of ranges of values herein is merely intended to serve as a shorthand method of referring individually to each separate value falling within the range. Unless otherwise indicated herein, each individual value is incorporated into the specification as if it were individually recited herein. A numerical range defined using the word "between" includes numerical values at both end points of the numerical range. A spatial range defined using the word "between" includes any point within the spatial range and the boundaries of the spatial range. A location expressed relative to two spaced apart or overlapping elements using the word "between" includes (i) any space between the elements, (ii) a portion of each element, and/or (iii) the boundaries of each element.

The use of any and all examples, or exemplary language (e.g., "such as") provided herein is intended merely for clarification and does not pose a limitation on the scope of the present disclosure. No language in the specification should be construed as indicating any non-claimed element essential to the practice of any embodiments discussed herein.

Groupings of alternative elements or embodiments disclosed herein are not to be construed as limitations. Each group member may be referred to and claimed individually or in any combination with other members of the group or other elements disclosed herein. One or more members of a group may be included in, or deleted from, a group for reasons of convenience and/or patentability. When any such inclusion or deletion occurs, the specification is deemed to contain the group as modified thus fulfilling the written description of all Markush groups used in the appended claims.

While different features or aspects of an embodiment may be described with respect to one or more features, a singular feature may comprise multiple elements, and multiple features may be combined into one element without departing from the scope of the present disclosure. Further, although methods may be disclosed as comprising one or more operations, a single operation may comprise multiple steps, and multiple operations may be combined into one step without departing from the scope of the present disclosure.

The apparatus, methods, and articles of manufacture described herein may be implemented in a variety of embodiments, and the foregoing description of some of these embodiments does not necessarily represent a complete description of all possible embodiments. Instead, the description of the drawings, and the drawings themselves, disclose at least one embodiment, and may disclosure alternative embodiments.

As the rules of golf may change from time to time (e.g., new regulations may be adopted or old rules may be eliminated or modified by golf standard organizations and/or governing bodies such as the USGA, the R&A, etc.), golf equipment related to the apparatus, methods, and articles of manufacture described herein may be conforming or non-conforming to the rules of golf at any particular time. Accordingly, golf equipment related to the apparatus, methods, and articles of manufacture described herein may be advertised, offered for sale, and/or sold as conforming or non-conforming golf equipment. The apparatus, methods, and articles of manufacture described herein are not limited in this regard.

Further, while the above examples may be described with respect to golf clubs, the apparatus, methods and articles of manufacture described herein may be applicable to other suitable types of sports equipment such as a fishing pole, a hockey stick, a ski pole, a tennis racket, etc. Although certain example apparatus, methods, and articles of manufacture have been described herein, the scope of coverage of this disclosure is not limited thereto. On the contrary, this disclosure covers all apparatus, methods, and articles of articles of manufacture fairly falling within the scope of the appended claims either literally or under the doctrine of equivalents.

What is claimed is:

1. A golf club head comprising:

a body portion; and a face portion coupled to the body portion, the face portion comprising:

a perimeter portion having a perimeter portion thickness and a perimeter portion edge defined by a face toe edge, a face heel edge, a face top edge, and a face sole edge;

a maximum face portion thickness;

a minimum face portion thickness;

a first quadrant in an upper toe-side portion, the first quadrant comprising a first region including the maximum face portion thickness;

a second quadrant in an upper heel-side portion, the second quadrant comprising a second region;

a third quadrant in a lower heel-side portion, the third quadrant comprising a third region; and a fourth quadrant in a lower toe-side portion, the fourth quadrant comprising a fourth region including the maximum face portion thickness, wherein the perimeter portion thickness is greater than the minimum face portion thickness, and wherein the first region and the fourth region have different shapes.

2. A golf club head as defined in claim 1, wherein the first region and the fourth region are connected to define a continuous region extending from the upper toe-side portion to the lower toe-side portion and including the maximum face portion thickness.

3. A golf club head as defined in claim 1, wherein the first region is larger than the fourth region.

4. A golf club head as defined in claim 1, wherein the fourth region is larger than the first region.

5. A golf club head as defined in claim 1, wherein at least one of the first region or the fourth region has an irregular shape.

6. A golf club head as defined in claim 1, wherein a distance between the first region and the second quadrant is less than a distance between the first region and the face toe edge.

7. A golf club head as defined in claim 1, wherein a distance between the fourth region and the third quadrant is less than a distance between the fourth region and the face toe edge.

8. A set of iron-type golf club heads comprising:

a first golf club head having a first loft angle and a second golf club head having a second loft angle different from the first loft angle, each golf club head including a face portion comprising:

a maximum face portion thickness and a minimum face portion thickness;

a first quadrant in an upper toe-side portion, the first quadrant comprising a first region including the maximum face portion thickness;

a second quadrant in an upper heel-side portion, the second quadrant comprising a second region;

a third quadrant in a lower heel-side portion, the third quadrant comprising a third region; and a fourth quadrant in a lower toe-side portion, the fourth quadrant comprising a fourth region including the maximum face portion thickness, wherein the first region and the fourth region have different shapes, wherein the first region of the first golf club head and the first region of the second golf club head have different shapes, and wherein the fourth region of the first golf club head and the fourth region of the second golf club head have different shapes.

9. A set of iron-type golf club heads as defined in claim 8, wherein the second quadrant of at least one of the first golf club head and the second golf club head comprises a second region including the maximum face portion thickness.

10. A set of iron-type golf club heads as defined in claim 8, wherein the third quadrant of at least one of the first golf club head and the second golf club head comprises a third region including the maximum face portion thickness.

11. A set of iron-type golf club heads as defined in claim 8, wherein the first region and the fourth region of at least one of the first golf club head and the second golf club head are connected to define a continuous toe-side region including the maximum face portion thickness.

12. A set of iron-type golf club heads as defined in claim 8, wherein for each golf club head, the maximum face portion thickness transitions to the minimum face portion thickness according to a gradient having different gradient slopes in at least two directions.

13. A set of iron-type golf club heads as defined in claim 8, wherein the second quadrant of the face portion of each of the first golf club head and the second golf club head comprises a second region including the maximum face portion thickness, wherein the second region of the first golf club head and the second region of the second golf club head have different shapes, wherein the second region of the first golf club head is smaller than the first region of the first golf club head, and wherein the second region of the second golf club head is smaller than the first region of the second golf club head.

14. A set of iron-type golf club heads as defined in claim 8, wherein the third quadrant of the face portion of each of the first golf club head and the second golf club head comprises a third region including the maximum face portion thickness, wherein the third region of the first golf club head and the third region of the second golf club head have different shapes, wherein the third region of the first golf club head is smaller than the first region of the first golf club head, and wherein the third region of the second golf club head is smaller than the first region of the second golf club head.

15. A golf club head comprising:

a body portion; and a face portion coupled to the body portion, the face portion comprising:

a front side having at least one groove and a back side opposite the front side;

a perimeter portion having a perimeter portion thickness and a perimeter portion edge defined by a face toe edge, a face heel edge, a face top edge, and a face sole edge;

a center region defined by an intersection of a horizontal plane of the body portion and a vertical plane bisecting the face portion;

a maximum face portion thickness at a location offset from the center region toward the face toe edge;

a minimum face portion thickness; and a face portion thickness transition portion that transitions from the maximum face portion thickness toward the perimeter portion along a plurality of gradients comprising a first gradient having a first gradient slope and a second gradient having a second gradient slope, wherein the first gradient extends from the maximum face portion thickness toward the face toe edge, wherein the second gradient extends from the maximum face portion thickness toward the face heel edge, and wherein the first gradient slope and the second gradient slope are different.

16. A golf club head as defined in claim 15, wherein the perimeter portion thickness is greater than the minimum face portion thickness.

17. A golf club head as defined in claim 15, wherein the perimeter portion thickness is greater than or equal to the maximum face portion thickness.

18. A golf club head as defined in claim 15, wherein the minimum face portion thickness is located between the maximum face portion thickness and the face heel edge.

19. A golf club head as defined in claim 15, wherein the plurality of gradients further comprises a third gradient extending from the maximum face portion thickness toward the face top edge of the face portion, the third gradient having a third gradient slope, and a fourth gradient extending from the maximum face portion thickness toward the face sole edge of the face portion, the fourth gradient having a fourth gradient slope different from the third gradient slope.

20. A golf club head as defined in claim 15, wherein the maximum face portion thickness is located in an upper toe-side portion of the face portion, and wherein the face portion further comprises a second maximum face portion thickness located in a lower toe-side portion of the face portion.

* * * * *